US011970313B2

(12) United States Patent
Morris et al.

(10) Patent No.: US 11,970,313 B2
(45) Date of Patent: Apr. 30, 2024

(54) INSULATING CONTAINER

(71) Applicant: YETI Coolers, LLC, Austin, TX (US)

(72) Inventors: Liza Morris, Austin, TX (US); Andrew J. Winterhalter, Austin, TX (US); Robert Secker, Austin, TX (US); Dustin R. Bullock, Austin, TX (US); Elizabeth Ruchte, Austin, TX (US); Ryan Nixon, Austin, TX (US); Derek G. Sullivan, Austin, TX (US); John Loudenslager, Austin, TX (US); John Fritz, Austin, TX (US); Erik Steven Larson, Austin, TX (US); Lance Harrison, Austin, TX (US); Michael Christopher Cieszko, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 10 days.

(21) Appl. No.: 17/743,075

(22) Filed: May 12, 2022

(65) Prior Publication Data

US 2022/0267056 A1 Aug. 25, 2022

Related U.S. Application Data

(63) Continuation-in-part of application No. 17/533,238, filed on Nov. 23, 2021, which is a continuation of (Continued)

(51) Int. Cl.
*B65D 43/16* (2006.01)
*A45C 11/20* (2006.01)

(Continued)

(52) U.S. Cl.
CPC ..... *B65D 43/164* (2013.01); *B65D 81/3834* (2013.01); *A45C 11/20* (2013.01); *B65D 43/22* (2013.01); *B65D 45/20* (2013.01)

(58) Field of Classification Search
CPC .. B65D 43/164; B65D 81/3834; B65D 43/22; B65D 45/20; A45C 11/20

(Continued)

(56) References Cited

U.S. PATENT DOCUMENTS 1,004,688 A 10/1911 Hunt
2,555,126 A 5/1951 Greve (Continued)

FOREIGN PATENT DOCUMENTS

BE 463027 A 3/1946
CA 152932 A 1/1914

(Continued)

OTHER PUBLICATIONS

Apr. 8, 2021—(NZ) Examination Report 2—App. No. 427609.

(Continued)

*Primary Examiner* — J. Gregory Pickett
*Assistant Examiner* — Niki M Eloshway
(74) *Attorney, Agent, or Firm* — Banner & Witcoff, Ltd.

(57) ABSTRACT

An insulating container having a base and a lid is provided. The lid may be rotatable about a hinge from a closed configuration to an open configuration and may be secured, via one or more latching devices, in the closed configuration. In some examples, the insulating container further includes a pull handle assembly with a telescopic three-stage arm configuration defined by a stowed configuration, a partially extended configuration, and a fully extended configuration. In other examples, the insulating container further includes a wheel assembly with a pair of wheels mounted with one or two axles, and further including a wheel grommet for absorbing shock and cushioning the axle. In still other examples, the insulating container further includes a drain plug assembly on the rear sidewall adjacent to the bottom portion of the base, the drain plug assembly comprising a (Continued)

main tube that cooperatively engages with an outer tube with a plurality of ratchet teeth that engage one or more ratchet keys on the main tube.

16 Claims, 46 Drawing Sheets

Related U.S. Application Data application No. 16/928,693, filed on Jul. 14, 2020, now Pat. No. 11,180,291, which is a continuation of application No. 16/218,089, filed on Dec. 12, 2018, now Pat. No. 10,766,672.

(51) Int. Cl.
*B65D 45/20* (2006.01)
*B65D 81/38* (2006.01)
*B65D 43/22* (2006.01)

(58) Field of Classification Search
USPC ..... 220/836
See application file for complete search history.

(56) References Cited

U.S. PATENT DOCUMENTS 2,652,698 A 9/1953 Schlumbohm
2,663,391 A 12/1953 Kuhns
2,706,895 A 4/1955 Thompson et al.
2,803,368 A 8/1957 Koch
2,850,885 A 9/1958 Mohr et al.
2,856,092 A 10/1958 Knapp
3,035,733 A 5/1962 Knapp
3,414,160 A 12/1968 Weber
3,591,194 A 7/1971 Vega
D249,456 S 9/1978 Testa
4,143,695 A 3/1979 Hoehn
4,162,029 A 7/1979 Gottsegen et al.
D255,312 S 6/1980 Uyeda
4,351,165 A 9/1982 Gottsegen et al.
4,368,819 A 1/1983 Durham
4,459,827 A 7/1984 Rhodes
4,484,682 A 11/1984 Crow
4,537,044 A 8/1985 Putnam
D281,695 S 12/1985 Ryan, Jr.
4,592,482 A 6/1986 Seager
4,623,076 A 11/1986 Karpal
4,648,512 A 3/1987 Tarozzi et al.
D290,080 S 6/1987 Carlson
4,724,681 A 2/1988 Bartholomew et al.
4,802,344 A 2/1989 Livingston et al.
4,846,493 A 7/1989 Mason
4,858,444 A 8/1989 Scott
4,873,841 A 10/1989 Bradshaw et al.
4,939,912 A 7/1990 Leonovich, Jr.
D311,476 S 10/1990 Kumakura
4,988,216 A 1/1991 Lyman
5,007,250 A 4/1991 Musielak
5,024,359 A 6/1991 Thomas
5,044,513 A 9/1991 Van Berne
5,050,767 A 9/1991 Peer
D322,198 S 12/1991 Dringenburg
D324,165 S 2/1992 Bressler et al.
5,095,718 A 3/1992 Ormond et al.
D328,221 S 7/1992 Piccarillo
D328,689 S 8/1992 Riskowski
5,169,018 A 12/1992 Fiore
5,176,215 A 1/1993 Ackerman
5,184,477 A 2/1993 Brown et al.
D333,775 S 3/1993 Krape
5,190,151 A 3/1993 Dietterich
5,213,381 A 5/1993 Anderson
5,249,438 A 10/1993 Rhaney et al.
5,251,460 A 10/1993 DeMarco et al.
5,251,542 A 10/1993 Itoh et al.
5,259,215 A 11/1993 Rocca
5,269,157 A 12/1993 Ciminelli et al.
5,284,294 A 2/1994 Floyd
5,285,656 A 2/1994 Peters
5,295,365 A 3/1994 Redford
5,313,817 A 5/1994 Meinders
5,319,937 A 6/1994 Fritsch et al.
5,329,787 A 7/1994 Friday
D349,215 S 8/1994 Mercado
5,350,081 A 9/1994 Graham
5,363,977 A 11/1994 Hoff
D353,304 S 12/1994 Friedrich
5,373,708 A 12/1994 Dumoulin, Jr.
5,400,610 A 3/1995 Macedo
5,403,095 A 4/1995 Melk
5,423,426 A 6/1995 Harper
5,447,041 A 9/1995 Piechota
5,447,252 A 9/1995 Ward
5,460,285 A 10/1995 Harding, Sr.
D369,695 S 5/1996 Imotani
D370,159 S 5/1996 Fenton et al.
5,562,228 A 10/1996 Ericson
5,626,373 A 5/1997 Chambers et al.
5,683,097 A 11/1997 Fenton et al.
5,738,238 A 4/1998 Yang
5,740,940 A 4/1998 Weiss
D395,792 S 7/1998 Cretcher
5,823,702 A * 10/1998 Bynum ..... F16L 19/005 285/82
5,845,515 A 12/1998 Nelson
5,860,281 A 1/1999 Coffee et al.
5,865,037 A 2/1999 Bostic
5,913,448 A 6/1999 Mann et al.
5,944,205 A 8/1999 LaJoie et al.
D415,658 S 10/1999 Frehse
5,971,218 A 10/1999 Le
6,047,976 A 4/2000 Wang
6,067,813 A 5/2000 Smith
D427,885 S 7/2000 Ayrest
6,092,661 A 7/2000 Mogil
6,158,745 A 12/2000 Deighton
6,176,499 B1 1/2001 Conrado et al.
6,192,703 B1 2/2001 Salyer et al.
6,193,097 B1 2/2001 Martin Perianes et al.
6,199,570 B1 3/2001 Patarra
6,216,488 B1 4/2001 Rucker
6,244,066 B1 6/2001 LaRose
6,244,458 B1 6/2001 Frysinger et al.
6,296,134 B1 10/2001 Cardinale
6,296,165 B1 10/2001 Mears
6,305,185 B1 10/2001 Sloan
6,305,547 B1 10/2001 Curran
D451,765 S 12/2001 Israel et al.
6,336,577 B1 1/2002 Harris et al.
6,398,272 B1 6/2002 Plummer et al.
6,409,066 B1 6/2002 Schneider et al.
6,427,886 B1 8/2002 Essex
6,446,988 B1 9/2002 Kho
D464,534 S 10/2002 McCully et al.
6,457,750 B1 10/2002 Sokurenko et al.
6,484,880 B1 11/2002 Shaeffer
6,622,881 B2 9/2003 Hardigg
D482,241 S 11/2003 Tyler
6,698,608 B2 3/2004 Parker et al.
D489,595 S 5/2004 Gleichauf et al.
6,736,309 B1 5/2004 Westerman et al.
6,739,150 B2 5/2004 Mompo Garcia
D491,440 S 6/2004 Pfeiffer et al.
D492,184 S 6/2004 Parker et al.
6,761,366 B1 7/2004 Klemmensen et al.
D494,021 S 8/2004 Huthmaker
6,789,692 B2 9/2004 Prezelin
6,789,693 B2 9/2004 Lassiter
6,955,381 B2 10/2005 Parker et al.
6,976,370 B2 12/2005 Fiene
6,993,931 B1 2/2006 Hamilton
7,004,481 B1 2/2006 Stanish
7,013,671 B1 3/2006 Bolda

(56) References Cited

U.S. PATENT DOCUMENTS 7,059,100 B2 6/2006 Babini et al.
7,066,347 B2 6/2006 Slovak et al.
D527,225 S 8/2006 Krieger et al.
D528,368 S 9/2006 Maldonado
7,128,369 B2 10/2006 Boggs et al.
7,140,507 B2 11/2006 Maldonado et al.
7,141,768 B2 11/2006 Malofsky et al.
7,147,125 B1 12/2006 Slovak et al.
D544,756 S 6/2007 Jones et al.
D544,757 S 6/2007 Jones et al.
D544,758 S 6/2007 Jones et al.
D544,759 S 6/2007 Jones et al.
D547,129 S 7/2007 Jones et al.
D547,617 S 7/2007 Jones et al.
7,243,676 B2 7/2007 Bailey
D548,565 S 8/2007 Vickers
D552,426 S 10/2007 Jones et al.
7,313,927 B2 1/2008 Barker
7,328,818 B2 2/2008 Prabucki
7,334,802 B2 2/2008 Kaplan
7,344,028 B2 3/2008 Hanson
D566,479 S 4/2008 Kabalin
7,357,709 B2 4/2008 Zukor et al.
7,360,784 B2 4/2008 Stewart et al.
7,387,305 B2 6/2008 Vanderberg et al.
7,389,608 B1 6/2008 MacKay
D573,844 S 7/2008 Hanson et al.
7,412,846 B2 8/2008 Sekiya et al.
7,427,181 B2 9/2008 Denton et al.
7,461,871 B2 12/2008 Vauchel
7,503,569 B2 3/2009 Duvigneau
7,538,302 B2 5/2009 Ferrari et al.
7,540,364 B2 6/2009 Sanderson
D598,194 S 8/2009 Turvey et al.
7,568,709 B2 8/2009 Feron
7,584,842 B2 9/2009 Neumeyer et al.
7,597,478 B2 10/2009 Pruchnicki et al.
7,603,875 B2 10/2009 Carr
D603,684 S 11/2009 Martis et al.
7,621,417 B2 11/2009 Peterson et al.
7,658,213 B1 2/2010 Anderson et al.
7,677,406 B2 3/2010 Maxson
7,677,580 B2 3/2010 Vanderberg et al.
D613,560 S 4/2010 Robichaud et al.
7,726,880 B2 6/2010 Zimmerman et al.
7,735,334 B2 6/2010 Johnson
7,806,271 B1 10/2010 Kraska
7,837,053 B2 11/2010 Arnett et al.
7,841,635 B2 11/2010 Fuchs
7,854,321 B2 12/2010 Twig et al.
7,874,743 B2 1/2011 Berkey et al.
D634,982 S 3/2011 Melchert et al.
7,905,243 B2 3/2011 Minard et al.
8,011,194 B2 9/2011 Dimmitt
8,016,153 B2 9/2011 Boenig et al.
D646,528 S 10/2011 Stallman et al.
8,052,004 B2 11/2011 Cheng et al.
8,066,139 B2 11/2011 Baughman
D651,860 S 1/2012 Nie
8,123,236 B1 2/2012 Helenihi
8,152,367 B2 4/2012 Roberts et al.
8,176,749 B2 5/2012 LaMere et al.
8,191,747 B2 6/2012 Pruchnicki
8,215,518 B2 7/2012 Hyde et al.
8,230,697 B2 7/2012 Lavallee
8,251,245 B2 8/2012 DiPietro et al.
8,256,156 B1 9/2012 Burgoyne, Jr.
8,297,464 B2 10/2012 Grenier et al.
8,308,008 B2 11/2012 Perry et al.
D674,245 S 1/2013 Williams, Jr. et al.
8,353,418 B2 1/2013 Bork
8,366,859 B2 2/2013 Wijk et al.
8,430,284 B2 4/2013 Broadbent et al.
8,511,846 B1 8/2013 Sandberg
8,524,342 B2 9/2013 Hager et al.
8,544,648 B2 10/2013 Cleveland et al.
8,544,670 B2 10/2013 Brilmyer
8,562,520 B2 10/2013 Rockrohr
8,573,002 B2 11/2013 Ledoux et al.
8,590,724 B2 11/2013 Kreidler et al.
8,596,485 B2 12/2013 Lindsay
8,622,235 B2 1/2014 Suchecki
8,622,279 B2 1/2014 Barnett
8,652,032 B2 2/2014 Yamane
8,668,223 B2 3/2014 Vanderberg et al.
8,668,802 B2 3/2014 Van Wijngaarden
8,678,024 B2 3/2014 Freiler
8,701,928 B2 4/2014 Samson
8,708,351 B2 4/2014 Kinskey et al.
D707,100 S 6/2014 Kinskey et al.
8,740,010 B1 * 6/2014 Page ..... F25D 23/02 220/592.2
8,746,498 B2 6/2014 Maldonado et al.
8,759,710 B2 6/2014 Brunnecker et al.
8,794,469 B2 8/2014 Bratsch
8,820,363 B2 9/2014 Polivka et al.
8,875,934 B2 11/2014 Deka
8,887,515 B2 11/2014 Patstone
D721,569 S 1/2015 Ziegler
8,939,315 B2 1/2015 Pillow et al.
8,944,476 B1 2/2015 Henderson
8,967,419 B2 3/2015 Gerber et al.
8,979,073 B2 3/2015 Lykins et al.
8,979,144 B2 3/2015 Paugh et al.
9,022,395 B1 5/2015 Vanderberg
9,027,722 B1 5/2015 Parker
D732,327 S 6/2015 Ciuksza, Jr. et al.
9,052,025 B2 6/2015 Zinn et al.
9,091,449 B2 7/2015 Donaldson et al.
9,091,477 B2 7/2015 Magnus
D739,302 S 9/2015 Nilsen et al.
9,126,747 B2 9/2015 Burgess et al.
9,132,598 B2 9/2015 Ernst
9,139,352 B2 9/2015 Seiders et al.
9,140,476 B2 9/2015 Eckhoff et al.
9,163,871 B1 10/2015 Costello
D744,810 S 12/2015 Pittman
9,199,657 B2 12/2015 Martin
9,199,782 B1 * 12/2015 Cliatt ..... B65D 81/3813
9,211,674 B2 12/2015 Van Tooren
9,222,809 B1 * 12/2015 Olsson ..... G01D 11/30
D747,950 S 1/2016 Jacobsen et al.
D747,951 S 1/2016 Jacobsen et al.
9,227,643 B1 1/2016 Bonilla et al.
D748,452 S 2/2016 Jacobsen et al.
9,260,129 B2 2/2016 Thompson
9,265,318 B1 2/2016 Williams et al.
D750,953 S 3/2016 Jacobsen et al.
9,271,553 B2 3/2016 Ponx
9,271,595 B2 3/2016 Lee
9,278,704 B2 3/2016 Cates
9,282,797 B1 3/2016 Soto
9,296,543 B2 3/2016 Wooldridge et al.
9,310,118 B2 4/2016 Zavitsanos
9,320,938 B1 4/2016 Belmore
9,341,003 B2 5/2016 Ely et al.
9,341,275 B2 5/2016 Peck et al.
D759,590 S 6/2016 Wang
9,389,010 B1 7/2016 Booker, Sr.
9,414,893 B2 8/2016 Jacobson
9,415,787 B2 8/2016 Mericle
D765,974 S 9/2016 Tonelli et al.
9,462,796 B1 10/2016 Ellis et al.
D773,254 S 12/2016 Jarvis et al.
D773,899 S 12/2016 Jarvis et al.
9,528,638 B2 12/2016 Hooberman
9,550,508 B1 1/2017 Parra
9,572,410 B2 2/2017 Fiedler
9,578,938 B1 2/2017 Verneuille
9,616,562 B2 4/2017 Hoppe et al.
9,616,910 B2 4/2017 Chaloux et al.
D786,627 S 5/2017 Thuma et al.
9,648,990 B1 5/2017 Corney
9,668,510 B2 6/2017 Doman

(56) References Cited

U.S. PATENT DOCUMENTS

| | | | |
|---|---|---|---|
| 9,669,986 | B1 | 6/2017 | Evans |
| 9,676,522 | B1 | 6/2017 | Stovall |
| 9,718,070 | B2 | 8/2017 | Arminak et al. |
| 9,726,415 | B1 | 8/2017 | Spalti |
| 9,738,296 | B2 | 8/2017 | McBeth |
| 9,791,200 | B2 | 10/2017 | Grepper |
| 9,809,357 | B2 | 11/2017 | Arnold et al. |
| 9,821,945 | B2 | 11/2017 | Kuhn et al. |
| 9,849,901 | B2 | 12/2017 | Jackman |
| D806,483 | S | 1/2018 | Stanford et al. |
| D807,707 | S | 1/2018 | Grepper et al. |
| D807,708 | S | 1/2018 | Grepper et al. |
| 9,857,119 | B2 | 1/2018 | Keenan |
| 9,872,547 | B2 | 1/2018 | Naiva |
| 9,878,841 | B2 | 1/2018 | Holderness et al. |
| 9,888,977 | B2 | 2/2018 | Thomas et al. |
| D815,919 | S | 4/2018 | DeFrancia |
| D816,425 | S | 5/2018 | Stanford et al. |
| D817,112 | S | 5/2018 | Jarvis et al. |
| D818,778 | S | 5/2018 | Beernaert et al. |
| 9,956,978 | B1 | 5/2018 | Worley |
| 9,970,610 | B1 | 5/2018 | Sandberg |
| 9,976,789 | B2 | 5/2018 | Grepper |
| D820,049 | S | 6/2018 | Ahlstrom et al. |
| 9,989,299 | B1 | 6/2018 | Ballard |
| 10,005,599 | B2 | 6/2018 | Friesen et al. |
| D823,064 | S | 7/2018 | Eichinger et al. |
| D823,065 | S | 7/2018 | Eichinger et al. |
| D823,066 | S | 7/2018 | Eichinger et al. |
| D826,027 | S | 8/2018 | Carey et al. |
| D827,386 | S | 9/2018 | Ichikawa |
| 10,065,848 | B2 | 9/2018 | Volin |
| 10,082,329 | B1 | 9/2018 | Sandberg et al. |
| D830,122 | S | 10/2018 | Seiders et al. |
| D830,123 | S | 10/2018 | Seiders et al. |
| 10,086,508 | B2 | 10/2018 | Hoppe et al. |
| D835,470 | S | 12/2018 | Seiders et al. |
| D835,471 | S | 12/2018 | Seiders et al. |
| D835,472 | S | 12/2018 | Seiders et al. |
| D835,946 | S | 12/2018 | Seiders et al. |
| D835,948 | S | 12/2018 | Jacobsen |
| D836,402 | S | 12/2018 | Jacobsen |
| D836,682 | S | 12/2018 | McCurry et al. |
| 10,151,520 | B2 | 12/2018 | Christensen |
| D842,656 | S | 3/2019 | Exley |
| D843,181 | S | 3/2019 | Yuan |
| D844,324 | S | 4/2019 | Hoppe et al. |
| D844,386 | S | 4/2019 | Ahlstrom et al. |
| D845,080 | S | 4/2019 | Jacobsen |
| D845,081 | S | 4/2019 | Jacobsen |
| D845,082 | S | 4/2019 | Jacobsen |
| 10,272,934 | B2 | 4/2019 | DeFrancia |
| D850,217 | S | 6/2019 | Kittel, III |
| 10,316,550 | B2 | 6/2019 | Reinhart |
| 10,322,867 | B2 | 6/2019 | Furneaux et al. |
| D856,675 | S | 8/2019 | Shalgi |
| 10,415,868 | B2 | 9/2019 | Grepper |
| D863,892 | S | 10/2019 | Ellison et al. |
| 10,427,356 | B1 | 10/2019 | Holbrook et al. |
| 10,486,726 | B1 | 11/2019 | Logan |
| D869,244 | S | 12/2019 | Ellison et al. |
| D870,520 | S | 12/2019 | Carey et al. |
| 10,538,365 | B2 | 1/2020 | Wood |
| 10,583,850 | B1 | 3/2020 | Pospicil |
| 10,588,388 | B2 | 3/2020 | Kabalin |
| 10,605,515 | B2 | 3/2020 | Stanford et al. |
| D880,951 | S | 4/2020 | Jacobsen |
| D887,789 | S | 6/2020 | Seiders et al. |
| 10,690,392 | B2 | 6/2020 | Huish |
| D891,194 | S | 7/2020 | Stanford et al. |
| D892,565 | S | 8/2020 | Astle et al. |
| D897,160 | S | 9/2020 | Hamilton |
| 10,773,374 | B2 | 9/2020 | Hoppe et al. |
| D899,869 | S | 10/2020 | Bullock et al. |
| D900,588 | S | 11/2020 | Rolfs et al. |
| 10,827,808 | B2 | 11/2020 | Seiders et al. |
| D904,128 | S | 12/2020 | Ellison et al. |
| D904,129 | S | 12/2020 | Astle |
| D905,129 | S | 12/2020 | Deng |
| D906,377 | S | 12/2020 | Tang |
| D917,977 | S | 5/2021 | Brunner et al. |
| D919,373 | S | 5/2021 | Xiong |
| 10,994,918 | B1 | 5/2021 | Seiders et al. |
| D922,148 | S | 6/2021 | Yang et al. |
| 11,027,885 | B2 | 6/2021 | Duong et al. |
| 11,027,907 | B2 | 6/2021 | Hoyt |
| D923,935 | S | 7/2021 | Brunner et al. |
| 11,072,484 | B1 | 7/2021 | Silva |
| D927,939 | S | 8/2021 | Ellison et al. |
| D929,188 | S | 8/2021 | Pennington et al. |
| D929,189 | S | 8/2021 | Pennington et al. |
| 11,104,484 | B2 | 8/2021 | Slattery |
| D929,813 | S | 9/2021 | Stanford et al. |
| D930,440 | S | 9/2021 | Astle et al. |
| D930,441 | S | 9/2021 | Seiders et al. |
| 11,111,068 | B1 | 9/2021 | O'Hara |
| 11,140,958 | B1 | 10/2021 | Baldwin |
| 11,141,931 | B2 | 10/2021 | Penumadu |
| 11,180,291 | B2 | 11/2021 | Bullock et al. |
| 11,185,141 | B2 | 11/2021 | Newson |
| 11,198,324 | B2 | 12/2021 | Alley |
| 11,224,273 | B2 | 1/2022 | Korey et al. |
| D942,218 | S | 2/2022 | Astle |
| D942,219 | S | 2/2022 | Bullock et al. |
| D942,220 | S | 2/2022 | Bullock et al. |
| D942,812 | S | 2/2022 | Luo et al. |
| D943,355 | S | 2/2022 | Shah |
| D944,299 | S | 2/2022 | Astle et al. |
| 11,242,175 | B2 | 2/2022 | Barfoot et al. |
| 11,266,215 | B2 | 3/2022 | Larson et al. |
| 11,267,637 | B2 | 3/2022 | Barfoot et al. |
| 11,267,639 | B2 | 3/2022 | Guerdrum et al. |
| 11,279,546 | B2 | 3/2022 | Seiders et al. |
| D948,292 | S | 4/2022 | Deng |
| D948,954 | S | 4/2022 | Seiders et al. |
| 11,297,916 | B2 | 4/2022 | Shalgi |
| 11,298,890 | B2 | 4/2022 | Labordus et al. |
| D953,154 | S | 5/2022 | Pearson |
| 11,331,863 | B2 | 5/2022 | Gilbert et al. |
| 11,351,749 | B2 | 6/2022 | Denis et al. |
| 11,363,865 | B2 | 6/2022 | Seiders et al. |
| 2003/0111476 | A1 | 6/2003 | Serio |
| 2003/0136702 | A1 | 7/2003 | Redzisz et al. |
| 2004/0025531 | A1 | 2/2004 | Holloman-Hughes et al. |
| 2004/0144783 | A1 | 7/2004 | Anderson et al. |
| 2004/0178208 | A1 | 9/2004 | Leba et al. |
| 2004/0182870 | A1 | 9/2004 | Rodgers |
| 2004/0262319 | A1 | 12/2004 | Fisher |
| 2005/0082305 | A1 | 4/2005 | Dais et al. |
| 2005/0109776 | A1 | 5/2005 | Camp |
| 2005/0127081 | A1 | 6/2005 | Leba et al. |
| 2005/0263527 | A1 | 12/2005 | Maldonado et al. |
| 2005/0269541 | A1 | 12/2005 | Bodum |
| 2005/0279123 | A1 | 12/2005 | Maldonado et al. |
| 2005/0279124 | A1 | 12/2005 | Maldonado |
| 2006/0017293 | A1 | 1/2006 | Tonelli |
| 2006/0037875 | A1 | 2/2006 | Stroud et al. |
| 2006/0042897 | A1 | 3/2006 | Sanderson |
| 2006/0065655 | A1 | 3/2006 | Taylor |
| 2006/0276768 | A1 | 12/2006 | Miller et al. |
| 2007/0075508 | A1 | 4/2007 | Miller et al. |
| 2007/0175898 | A1 | 8/2007 | Craft et al. |
| 2007/0193297 | A1 | 8/2007 | Wilson |
| 2007/0240383 | A1 | 10/2007 | Keller et al. |
| 2007/0284377 | A1 | 12/2007 | Chandler |
| 2007/0290466 | A1 | 12/2007 | Lenz |
| 2008/0025544 | A1 | 1/2008 | Maldonado |
| 2008/0031483 | A1 | 2/2008 | Hill |
| 2008/0134714 | A1 | 6/2008 | Villanueva |
| 2008/0145919 | A1 | 6/2008 | Franklin et al. |
| 2008/0164265 | A1 | 7/2008 | Conforti |
| 2008/0178629 | A1 | 7/2008 | Meether |
| 2008/0190940 | A1 | 8/2008 | Scott |
| 2008/0302711 | A1 | 12/2008 | Windmiller |

(56) References Cited

U.S. PATENT DOCUMENTS

2009/0114646 A1 5/2009 Whalen
2009/0158770 A1 6/2009 Cohrs et al.
2009/0188736 A1 7/2009 Niddam et al.
2009/0217699 A1 9/2009 Ball
2009/0266833 A1 10/2009 Savage et al.
2009/0274398 A1 11/2009 Men
2010/0126196 A1 5/2010 McCance
2010/0200588 A1 8/2010 Bergman et al.
2010/0212351 A1 8/2010 Chapin et al.
2010/0288776 A1 11/2010 Bodum
2011/0062157 A1 3/2011 Grimm
2011/0062287 A1 3/2011 Metzech et al.
2011/0127264 A1 6/2011 Whalen
2011/0197625 A1 8/2011 Urban et al.
2011/0215125 A1 9/2011 Lopez
2011/0226785 A1 9/2011 Sakell
2011/0251713 A1 10/2011 Teshima et al.
2012/0117921 A1 5/2012 Toft et al.
2012/0132657 A1 5/2012 Seiders
2012/0318808 A1 12/2012 McCormick
2013/0043250 A1 2/2013 Kreidler et al.
2013/0062356 A1 3/2013 Deka
2013/0168882 A1 7/2013 Lykins et al.
2014/0042797 A1 2/2014 Pillow et al.
2014/0169926 A1 6/2014 Henderson et al.
2014/0226920 A1 8/2014 Passavia
2014/0252010 A1 9/2014 Miller
2015/0008242 A1 1/2015 Kpabar, Jr.
2015/0047635 A1 2/2015 Poree
2015/0136796 A1 5/2015 Muehlhauser
2015/0175338 A1 6/2015 Culp et al.
2015/0300721 A1 10/2015 Rigoli
2015/0345853 A1 12/2015 Deyen
2015/0375918 A1* 12/2015 Holderness ..... B67D 3/0067 220/592.2
2015/0377549 A1 12/2015 Cai et al.
2016/0023349 A1 1/2016 Hoppe et al.
2016/0031617 A1 2/2016 Faucheaux, Jr. et al.
2016/0073751 A1 3/2016 Charlebois et al.
2016/0113131 A1 4/2016 Ernesti et al.
2016/0135559 A1 5/2016 Scally
2016/0244239 A1 8/2016 Nash
2017/0020256 A1 1/2017 Jankura et al.
2017/0043800 A1 2/2017 Chaloux et al.
2017/0055665 A1 3/2017 Lanzisera
2017/0101301 A1 4/2017 Volin
2017/0119212 A1 5/2017 Petrillo et al.
2017/0143090 A1* 5/2017 Naiva ..... B25H 3/02
2017/0156525 A1 6/2017 Guy et al.
2017/0159989 A1 6/2017 Bodnar
2017/0197765 A1 7/2017 Hu et al.
2017/0254578 A1 9/2017 Kriesel
2017/0259956 A1 9/2017 Hori et al.
2017/0292756 A1 10/2017 Fenko et al.
2017/0305605 A1 10/2017 Sonntag et al.
2017/0305638 A1 10/2017 Sonntag et al.
2017/0313492 A1 11/2017 Seiders et al.
2017/0320653 A1 11/2017 Mogil et al.
2017/0343247 A1 11/2017 Ahmad et al.
2017/0368440 A1 12/2017 Graham et al.
2018/0003425 A1 1/2018 Goodloe
2018/0015938 A1 1/2018 DeFrancia
2018/0016068 A1 1/2018 Valencia
2018/0037394 A1* 2/2018 Seiders ..... B65D 43/02
2018/0087819 A1 3/2018 Triska et al.
2018/0127007 A1 5/2018 Kravchenko
2018/0132586 A1 5/2018 Flaherty
2018/0141718 A1 5/2018 Ahlstrom et al.
2018/0141739 A1 5/2018 Hengen
2018/0186547 A1 7/2018 Morine et al.
2018/0265267 A1 9/2018 Arenas et al.
2018/0274837 A1 9/2018 Christensen
2018/0354687 A1 12/2018 Seiders et al.
2019/0048631 A1 2/2019 Li
2019/0092530 A1* 3/2019 Seiders ..... B65D 47/06
2019/0152677 A1 5/2019 Hoyt
2019/0161240 A1 5/2019 Ahlstrom et al.
2019/0183219 A1* 6/2019 Yu ..... A45C 7/0068
2019/0193338 A1 6/2019 Penumadu
2019/0216193 A1 7/2019 Kabalin
2019/0217999 A1 7/2019 Wood
2019/0315538 A1 10/2019 Cheng
2020/0406446 A1* 12/2020 Hoppe ..... A45C 7/0045
2021/0123656 A1 4/2021 Li et al.
2021/0139225 A1 5/2021 Morine et al.
2021/0188494 A1 6/2021 Stephens et al.
2021/0197497 A1 7/2021 Labordus et al.
2021/0221563 A1 7/2021 Chungu
2021/0278121 A1 9/2021 Sonntag et al.
2021/0285710 A1 9/2021 Barros et al.
2021/0316934 A1 10/2021 Fabela
2021/0337946 A1 11/2021 Shalgi
2021/0345740 A1 11/2021 Seiders et al.
2021/0374200 A1 12/2021 Shalgi et al.
2022/0001694 A1 1/2022 Morris et al.
2022/0015516 A1 1/2022 Larson et al.
2022/0063210 A1 3/2022 Labordus et al.
2022/0071360 A1 3/2022 Seiders et al.
2022/0073260 A1 3/2022 Seiders et al.
2022/0079309 A1 3/2022 Seiders et al.
2022/0079317 A1 3/2022 Cole et al.
2022/0081173 A1 3/2022 Bullock et al.
2022/0081185 A1 3/2022 Seiders et al.
2022/0082317 A1 3/2022 Bollinger et al.
2022/0114847 A1 4/2022 Emde et al.
2022/0114853 A1 4/2022 Emde et al.
2022/0153504 A1 5/2022 Seiders et al.
2022/0161986 A1 5/2022 Seiders et al.

FOREIGN PATENT DOCUMENTS

CN 3403648 11/2004
CN 3590176 12/2006
CN 301802547 S 1/2012
CN 301888389 4/2012
CN 301888390 4/2012
CN 302287417 1/2013
CN 302428185 5/2013
CN 302502521 7/2013
CN 302627302 11/2013
CN 103767285 A 5/2014
CN 203811219 U 9/2014
CN 303093970 2/2015
CN 303124294 3/2015
CN 204291293 U 4/2015
CN 303228513 6/2015
CN 303230185 6/2015
CN 303435939 S 11/2015
CN 105387670 A 3/2016
CN 303787513 8/2016
CN 106246966 A 12/2016
CN 303993733 1/2017
CN 304011514 1/2017
CN 205952653 U 2/2017
CN 304286831 9/2017
CN 304331255 10/2017
CN 304418948 12/2017
CN 107554941 A 1/2018
CN 304497325 2/2018
CN 207275259 U 4/2018
CN 304778102 5/2018
CN 207550843 U 6/2018
CN 207550844 U 6/2018
CN 304687848 6/2018
CN 304697951 6/2018
CN 304709370 7/2018
CN 108430255 A 8/2018
CN 304873399 S 11/2018
CN 304950262 12/2018
CN 304984458 1/2019
CN 305013495 1/2019
CN 109431028 A 3/2019
CN 208802354 U 4/2019
CN 109717162 A 5/2019

(56) References Cited

FOREIGN PATENT DOCUMENTS

| | | | |
|---|---|---|---|
| CN | 208932074 | U | 6/2019 |
| CN | 209023491 | U | 6/2019 |
| CN | 209112788 | U | 7/2019 |
| CN | 209177140 | U | 7/2019 |
| CN | 305300479 | | 8/2019 |
| CN | 209834494 | U | 12/2019 |
| CN | 209921858 | U | 1/2020 |
| CN | 109415154 | B | 4/2020 |
| CN | 211816842 | U | 10/2020 |
| CN | 112165890 | A | 1/2021 |
| CN | 306312609 | | 2/2021 |
| CN | 112707011 | A | 4/2021 |
| CN | 113165789 | A | 7/2021 |
| CN | 213983842 | U | 8/2021 |
| CN | 113790554 | A | 12/2021 |
| CN | 215063711 | U | 12/2021 |
| CN | 215413215 | U | 1/2022 |
| CN | 114224052 | A | 3/2022 |
| CN | 114536274 | A | 5/2022 |
| DE | 8229359 | U1 | 12/1982 |
| DE | 9402365 | U1 | 7/1994 |
| DE | 29803436 | U1 | 6/1998 |
| DE | 102005024853 | B3 | 10/2006 |
| DE | 102010054187 | A1 | 6/2012 |
| DE | 202016000950 | U1 | 2/2017 |
| DE | 202017006895 | U1 | 9/2018 |
| EM | 000946272-0001 | | 7/2008 |
| EM | 002929430-0001 | | 1/2016 |
| EM | 002929646-0001 | | 1/2016 |
| EM | 004508893-0002 | | 1/2018 |
| EM | 004508893-0005 | | 1/2018 |
| EM | 004508893-0006 | | 1/2018 |
| EM | 004662898-0001 | | 3/2018 |
| EM | 005272119-0001 | | 5/2018 |
| EM | 005272119-0002 | | 5/2018 |
| EM | 005272119-0003 | | 5/2018 |
| EM | 005272119-0004 | | 5/2018 |
| EM | 005272119-0005 | | 5/2018 |
| EM | 005822582-0001 | | 11/2018 |
| EM | 007954169-0001 | | 7/2020 |
| EM | 007954169-0002 | | 7/2020 |
| EP | 1399347 | A2 | 3/2004 |
| EP | 1152199 | B1 | 7/2005 |
| EP | 1700551 | A2 | 9/2006 |
| EP | 2135816 | A1 | 12/2009 |
| EP | 2505514 | A1 | 10/2012 |
| EP | 2852505 | A1 | 4/2015 |
| EP | 2860128 | A1 | 4/2015 |
| EP | 2861899 | A1 | 4/2015 |
| EP | 3625145 | A2 | 3/2020 |
| EP | 3643996 | B1 | 4/2020 |
| EP | 3847923 | A1 | 7/2021 |
| EP | 3877291 | A2 | 9/2021 |
| EP | 3898199 | A1 | 10/2021 |
| EP | 3802072 | B1 | 4/2022 |
| EP | 3945926 | B1 | 7/2023 |
| GB | 1818 | | 4/1909 |
| GB | 2045135 | A | 2/1996 |
| GB | 2095684 | | 11/2000 |
| GB | 2096851 | | 1/2001 |
| GB | 3005022 | | 1/2003 |
| GB | 3025672 | | 12/2006 |
| IN | 368890 | | 12/2014 |
| JP | 6043535 | U | 3/1985 |
| JP | 3058061 | U | 6/1999 |
| JP | 3221178 | B2 | 10/2001 |
| JP | 2002302142 | A | 10/2002 |
| JP | 2005206210 | A | 8/2005 |
| JP | 2005225533 | A | 8/2005 |
| JP | 2006168744 | A | 6/2006 |
| JP | 4108834 | B2 | 6/2008 |
| JP | 2011251713 | A | 12/2011 |
| JP | D1433757 | | 2/2012 |
| JP | 2012062076 | A | 3/2012 |
| JP | 2017105487 | A | 6/2017 |
| JP | 2017119523 | A | 7/2017 |
| JP | 6769119 | B2 | 10/2020 |
| KR | 20180013600 | A | 2/2018 |
| WO | 9821534 | A1 | 5/1998 |
| WO | 02092412 | A2 | 11/2002 |
| WO | 2006007266 | A2 | 1/2006 |
| WO | 2007144176 | A2 | 12/2007 |
| WO | 09055877 | A1 | 5/2009 |
| WO | 14074098 | A1 | 5/2014 |
| WO | 14074113 | A1 | 5/2014 |
| WO | 2016066817 | A1 | 5/2016 |
| WO | 2017019038 | A1 | 2/2017 |
| WO | 17072531 | A1 | 5/2017 |
| WO | 17182290 | A1 | 10/2017 |
| WO | 18005859 | A2 | 1/2018 |
| WO | WO-2019173897 | A1 * | 9/2019 ..... A45C 13/04 |
| WO | 2019223893 | A1 | 11/2019 |
| WO | 2019231327 | A1 | 12/2019 |
| WO | 2020130806 | A1 | 6/2020 |

OTHER PUBLICATIONS

United States District Court Western District of Texas, Austin Division, "Complaint for Damages and Injunctive Relief", *YETI Coolers, LLC* v. *Hooked Coolers, Inc*., Case 1:21-cv-00633, Document 1, filed Jul. 16, 2021, 28 pages.

Sep. 20, 2022—(CA) Examiner's Report—App. No. 3,122,695.

Dometic Patrol 35 https://shop.dometic.com/store/dometic/en_US/pd/productID.5178771400 (12 pp) Oct. 23, 2019.

gore.com/protectivevents—screw-in series—"Increase outdoor enclosure durability in harsh environments" p. 1-4.

May 27, 2020—(WO) Partial International Search—PCT/US2019/065859.

Jul. 28, 2020—(WO) International Search Report & Written Opinion—PCT/US19/065859.

Nov. 4, 2020—(CN) Office Action—App. No. 202030157746.X.

45QW Elite Wheeled Cooler (http://www.facebook.com/sharer/sharer.php?u=www.pelican.com/product/coolers/wheeled-cooler/elite/45qw), visited Dec. 4, 2019.

Coleman® 45-Quart Wheeled Cooler, https://www.promodirect.com/Personalized-coleman-45-quart-wheeled-cooler-31930-ccp53432.htm, visited Dec. 4, 2019.

Coleman Rugged A/T Wheeled Cooler, 55 Quart, https://www.amazon.com/Coleman-Rugged-Wheeled-Cooler-Quart, visited Dec. 4, 2019.

Igloo Max Cold Quantum 52 Quart Roller Cooler, https://www.amazon.com/Igloo-Quantum-Roller-Cooler-Carbon/dp/B01B4PAX9M, visited Dec. 4, 2019.

Marine Ultra Quantum™ 52 Roller, https://www.coolersonsale.com/wp-content/uploads/2014/10/HandleHeight-300x300.jpg, visited Dec. 4, 2019.

Rubbermaidn 50 qt. Durachill Cooler, https://www.amazon.com/Rubbermaid-DuraChill-Wheeled-Seashell-FG2A92000PMTL, visisted Dec. 4, 2019.

Summit Wheeled 30, Summit Series Coolers, https://www.k2-coolers.com/index.php/summit-series.html, visited Dec. 4, 2019.

Tundra Haul Wheeled Cooler, https://www.yeti.com/en_US/coolers/hard-coolers/tundra/wheeled-coolers/YTHAUL.html, visited Dec. 4, 2019.

Igloo Latitue 90 Quart Rolling Cooler, https://www.fieldandstreamshop.com/p/igloo-latitude-90-quart-rolling-cooler-19igla90qtlttdrllodr/19igla90qtlttdrllodr, visited Dec. 4, 2019.

Jun. 6, 2022—(CN) First Office Action—App. No. 201980083120.3.

Jul. 5, 2022—(JP) Office Action—App. No. 2021531973.

Jun. 29, 2022—(AU) Examination Report No. 1—App. No. 2019396514.

Jan. 17, 2023—(JP) Office Action—App. No. 2021531973.

Nov. 4, 2022—(CN) Office Actioon No. 2—App. No. 201980083120.3.

Apr. 19, 2023—(CN) Office Action—App. No. 201980083120.3.

Feb. 23, 2023—(CA) Office Action—App. No. 3122695.

(56) References Cited

OTHER PUBLICATIONS

Mar. 21, 2023—(NZ) Patent Examination Report 1—App. No. 776896.
Sep. 23, 2023—(WO) International Search Report & Written Opinion—PCT/US2023/021672.
Oct. 6, 2023—(NZ) Examination Report 2—App. No. 776896.
Pelican Products, Inc. | 45QW Cooler—Elite Cooler | Wheeled Cooler visited Nov. 9, 2023 at http://web.archive.org/web/20160301214602/http://www.pelican.com/us/en/product/outdoor-heavy-duty-coolers/elite-cooler/wheeled-cooler/45QW.
Coleman Coolers | 82 Quart Xtreme 6 Wheeled Cooler, visited Nov. 9, 2023 at <http://web.archive.org/web/20160521053132/http:/www.coleman.com:80/82-quart-xtreme-6-wheeled-cooler/3000001146.html>.
Outdoors.com, "The RovR Campr Cooler: Review—Outdoors with Bear Grylls," visited Nov. 10, 2023 at https://outdoors.com/the-rovr-campr-cooler-review.
Contour Coolers | Igloo Picnic, Basket & Carry Coolers | The Igloo Online Store, visited Nov. 9, 2023 at<http://web.archive.org/web/20160319023253/http:/www.igloo-store.com/products/fullsize/contour>.
MaxCold Igloo Coolers 40-100 Quart | The Igloo Online Store, visited Nov. 9, 2023 at http://web.archive.org/web/20151211172327/http://www.igloo-store.com/products/fullsize/maxcoldseries.
Sportsman Coolers | Igloo Camping & Hunting Coolers | The Igloo Online Store, visited Jan. 16, 2023 at http://web.archive.org/web/20151215143618/http://www.igloo-store.com/category/fullsize.
Pro-Tech Case Inc., Pelican 45 Quart Elite Cooler with Wheels, visited Nov. 23, 2022 at http://www.protechcase.com/coolers.html.
Nov. 6, 2023—(EP) Article 94(3) Communication—App.No. 19832529.2.

* cited by examiner

INSULATING CONTAINER

CROSS-REFERENCE TO RELATED APPLICATIONS

This application is a continuation-in-part of U.S. application Ser. No. 17/533,238, filed Nov. 23, 2021, entitled Insulating Container, which is a continuation of U.S. application Ser. No. 16/928,693, filed Jul. 14, 2020, entitled Insulating Container, now U.S. Pat. No. 11,180,291, issued Nov. 23, 2021, which is a continuation of U.S. application Ser. No. 16/218,089, filed Dec. 12, 2018, entitled Insulating Container, now U.S. Pat. No. 10,766,672, issued Sep. 8, 2020, which is incorporated by reference herein in their entirety.

BACKGROUND

Various types of containers are often used to store food or other items. In some examples, it may be advantageous to maintain a temperature of the contents being stored in the container. Accordingly, an insulating container may be used. However, certain conventional insulating containers are often not very durable and lack an adequate means to secure the lid in a closed position. For instance, they have lids that may be lost or broken, handles that may protrude from a base portion of the container, and/or ineffective latches used to secure the lid. In these examples, the lid, handle, and/or the latches may be susceptible to breakage, which, in some cases, may render the insulating container virtually useless.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Insulating containers have various features are described herein. In some examples, the insulating containers may include: a base; a lid hingedly attached to the base; and a pull handle assembly attached to the base. The base may include a sidewall structure, a bottom portion connected to the sidewall structure, an opening formed at end of the sidewall structure, and at least one latch device configured to secure the lid when the lid is in a closed position. The sidewall structure may have a front sidewall, a rear sidewall opposite the front sidewall, and two lateral sidewalls between the front sidewall and the rear sidewall. The bottom portion may be connected to a first end of each sidewall of the sidewall structure, the bottom portion being configured to support the insulating container on a surface. The opening may be formed at a second end of each sidewall of the sidewall structure, opposite the first end of each sidewall of the sidewall structure. The opening may be configured to allow access to an interior void of the insulating container formed by the sidewall structure and the bottom portion. A gasket may be configured to provide a watertight seal when the lid is in a closed and secured position. The pull handle assembly may be attached to the rear sidewall. The pull handle assembly may include a telescopic three-stage arm configuration defined by a first stage with the pull handle assembly in a stowed configuration, a second stage with the pull handle assembly in a partially extended configuration, and a third stage with the pull handle assembly in a fully extended configuration. The pull handle assembly may include an upper arm, a middle arm, and a lower arm. The upper arm may be nested and slidable inside the middle arm and the middle arm may be nested and slidable inside the lower arm, thereby creating the telescopic three-stage arm configuration.

In other examples, the pull handle assembly may be attached to the rear sidewall with one or more brackets. The one or more brackets may be U-shaped brackets that fit around an exterior of the lower arm against the rear sidewall. The pull handle assembly may further include one or more locking mechanisms for locking the pull handle assembly in the stowed configuration and the fully extended configuration with an upper locking mechanism between the upper arm and the middle arm and a lower locking mechanism between the middle arm and the lower arm. The pull handle assembly may further include a release button located on a pull handle. The release button may be connected to and actuating the one or more locking mechanisms to lock and release the pull handle assembly between the stowed configuration and the fully extended configuration. The pull handle assembly may include an extended arm overlap distance defined as an overlap distance between the nested arms when the upper arm, the middle arm, and the lower arm are in the fully extended configuration. The extended arm overlap distance may be approximately 70 mm. The pull handle assembly may include a pull handle with one or more pull handle bumpers that include a raised portion that extends circumferentially around the pull handle. The insulating container may further comprise a corner locking bracket that includes a container bracket attached to the base, a lid bracket attached to the lid, and a lock. The container bracket may include a first lock hole and the lid bracket may include a second lock hole. When the lid is in the closed and secured position, the first and second lock holes may match together, thereby allowing the lock to be inserted into to the first and second lock holes. Further, the at least one latch device may further include: a latch upper wherein the latch upper is pivotally attached to the lid; and a latch lower wherein the latch lower is pivotally attached to the latch upper. The latch lower further includes an engaging tab that is configured to engage a keeper. The latch lower may be formed of a first material and the latch upper may be formed of a second material. The first material may be more rigid than the second material. The keeper may be positioned on a front side of the bottom portion of the insulating container.

These and various other features will be described more fully herein.

BRIEF DESCRIPTION OF THE DRAWINGS

The present invention is illustrated by way of example and not limited in the accompanying figures in which like reference numerals indicate similar elements and in which.

Further, it is to be understood that the drawings may represent the scale of different components of one single embodiment; however, the disclosed embodiments are not limited to that particular scale.

DETAILED DESCRIPTION

Aspects of this disclosure relate to an insulating container configured to store contents or a volume of liquid. In some examples, the insulating container may include a lid lockable or securable with at least one latch or at least one latching device, and the lid may be hinged to allow the lid to rotate from a closed position to an open position that is approximately 115° from the closed position, and/or be non-destructively removable (e.g., able to be removed and replaced) from a base portion of the insulating container. Additionally or alternatively, the insulating container may include a pressure regulation device that aids in venting the insulating container to prevent lid lock due to pressure or temperature changes. Additionally or alternatively, the insulating container may have handles that are integrally formed in the base portion of the insulating container. These and various other features and aspects of the insulating container will be described more fully herein.

In the following description of the various embodiments, reference is made to the accompanying drawings, which form a part hereof, and in which is shown by way of illustration various embodiments in which aspects of the disclosure may be practiced. It is to be understood that other embodiments may be utilized and structural and functional modifications may be made without departing from the scope and spirit of the present disclosure.

Figure 1B:
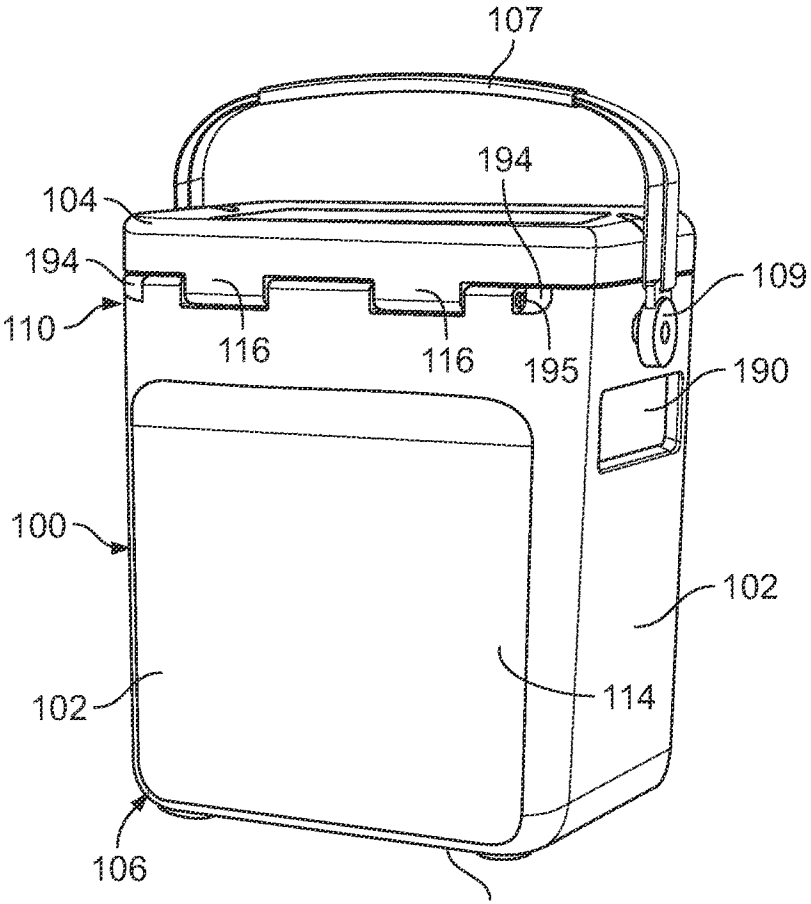
FIGS. 1A and 1B are front and rear perspective views, respectively, of an insulating container according to one or more aspects described herein.
Figure 1A:
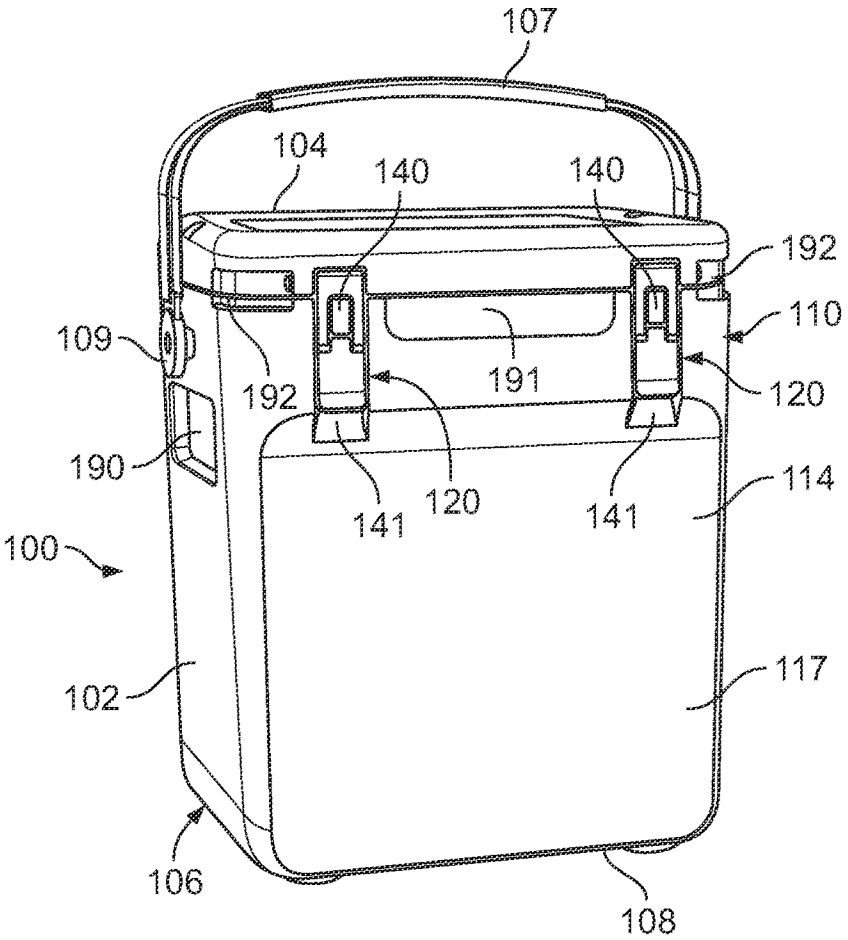

FIGS. 1A and 1B depict perspective views of an insulating container 100. In one example, the insulating container 100 may comprise a base portion 102 and a lid 104 that, in some examples, may be non-destructively, removably coupled thereto. The base portion 102 may be an insulated structure forming an interior void for containing contents or a liquid, as will be discussed more fully herein. In some examples, the base portion 102 may be cuboidal or substantially cuboidal in shape. In still other examples, the base portion 102 may be substantially cylindrical in shape or may have a substantially rectangular cross section. Various other shapes may be used without departing from the invention.

Figure 2A:
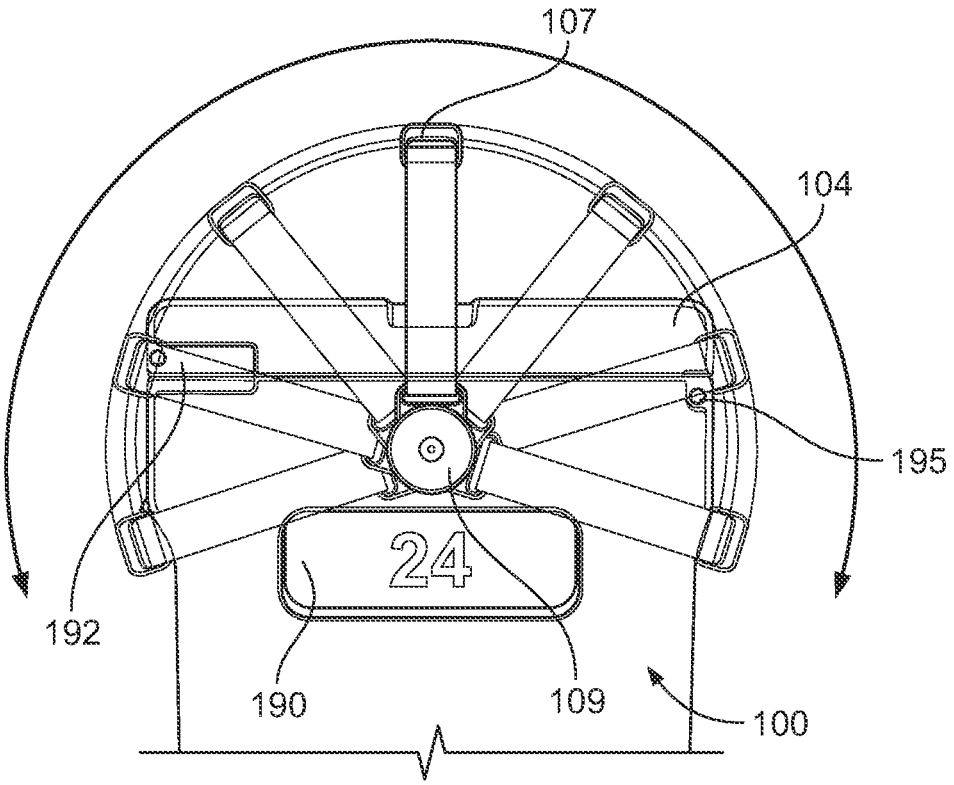
FIG. 2A illustrates a side view of the insulating container of FIGS. 1A and 1B highlighting the carry strap or carry handle arrangement in which a strap or handle may be rotated from one side of the insulating container to the other via handle pivots according to one or more aspects described herein.
Figure 2B:
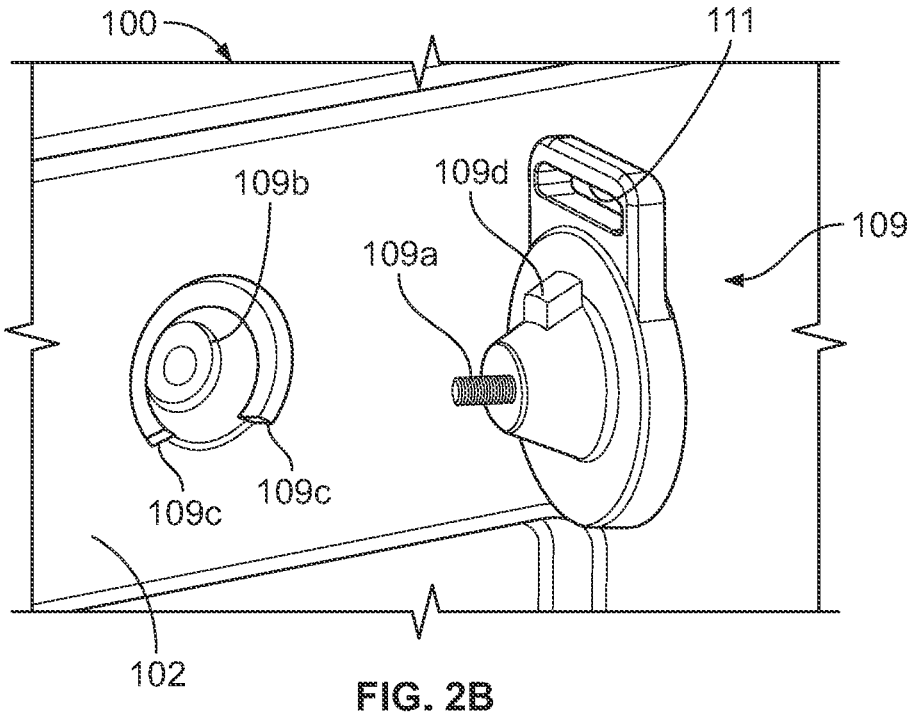
FIG. 2B is a deconstructed view of the handle pivot of FIG. 2A according to one or more aspects described herein.

The base portion 102 may include a first end 106, having a bottom surface 108. The bottom surface 108 may be configured to support the insulating container on a surface, such as a table, the ground, a vehicle bed, boat deck, or the like. The base portion 102 may also include carry handle or carry strap 107. Carry handle or strap 107 may be connected to handle pivot 109. In certain examples, the insulating container is configured with a plurality of handle pivots 109. Each end of the handle or carry strap 107 may be attached to a handle pivot 109 allowing the handle or carry strap 107 to freely rotate from the front of the insulating container to the rear of the insulating container. As shown in FIG. 2A, handle 107 engages handle pivot 109. Handle pivot 109 is configured to rotate approximately 240° and allows the handle 107 to be rotated from the front of insulating container 100 to the rear of the insulating container 100. In another example, the handle 107 engages handle pivot 109 and is configured to travel in an arc over the lid 104. In other examples, the handle pivot 109 is configured to travel at least 220°, 225°, 230°, 235°, 240°, 245°, or 250°. In other examples, the handle pivot 109 is configured to travel from about 220° to 240° of travel. In certain examples, as shown in FIG. 2B, an insert 109*b* is integrally molded in the base portion 102. The handle pivot 109 is configured to engage the insert 109*b*. Insert 109*b* further includes stops 109*c* that are configured to engage a protrusion 109*d* on the handle pivot 109. The movement of the handle 107 is limited by the engagement of the protrusion 109*d* with the stops 109*c*. In some examples, handle pivot 109 is secured to the base portion 102 and insert 109*b* by pivot hardware 109*a*. In certain examples, pivot hardware 109*a* may be a screw, bolt, rivet, etc. In other examples, handle pivot 109 further includes a strap loop 111 configured to allow attachment of a carry strap or handle 107 to the handle pivot 109. In some examples, the handle or carry strap 107 may be formed of various suitable materials, such as one or more plastics. For instance, the handle 107 may have a core formed of polyvinyl chloride and an outer portion formed of ethylene vinyl acetate. In other examples, the handle or carry strap 107 may be formed of rope (such as polyester rope), or a nylon webbing. In yet other examples, the handle or carry strap 107 may be constructed of various materials, such as one or more metals, alloys, polymers, ceramics, or fiber-reinforced materials. In still other examples, the handle or carry strap 107 may include padding to facilitate easier carrying via the shoulder or by hand.

Figure 2C:
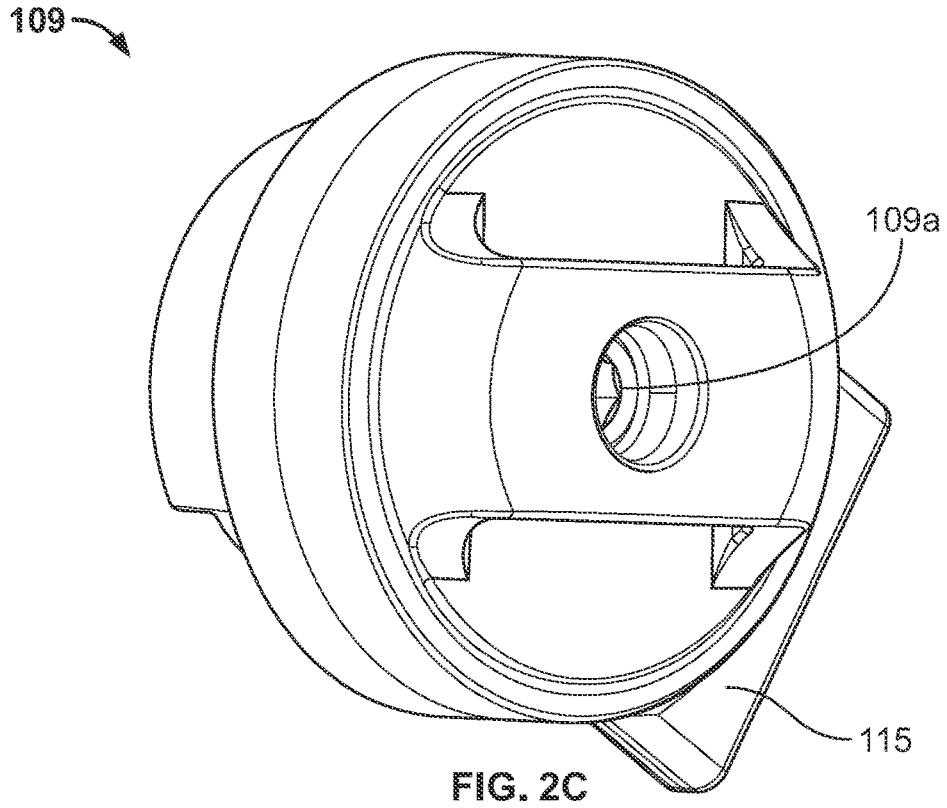
FIG. 2C is an expanded front perspective view of another example handle pivot according to one or more aspects described herein.
Figure 2D:
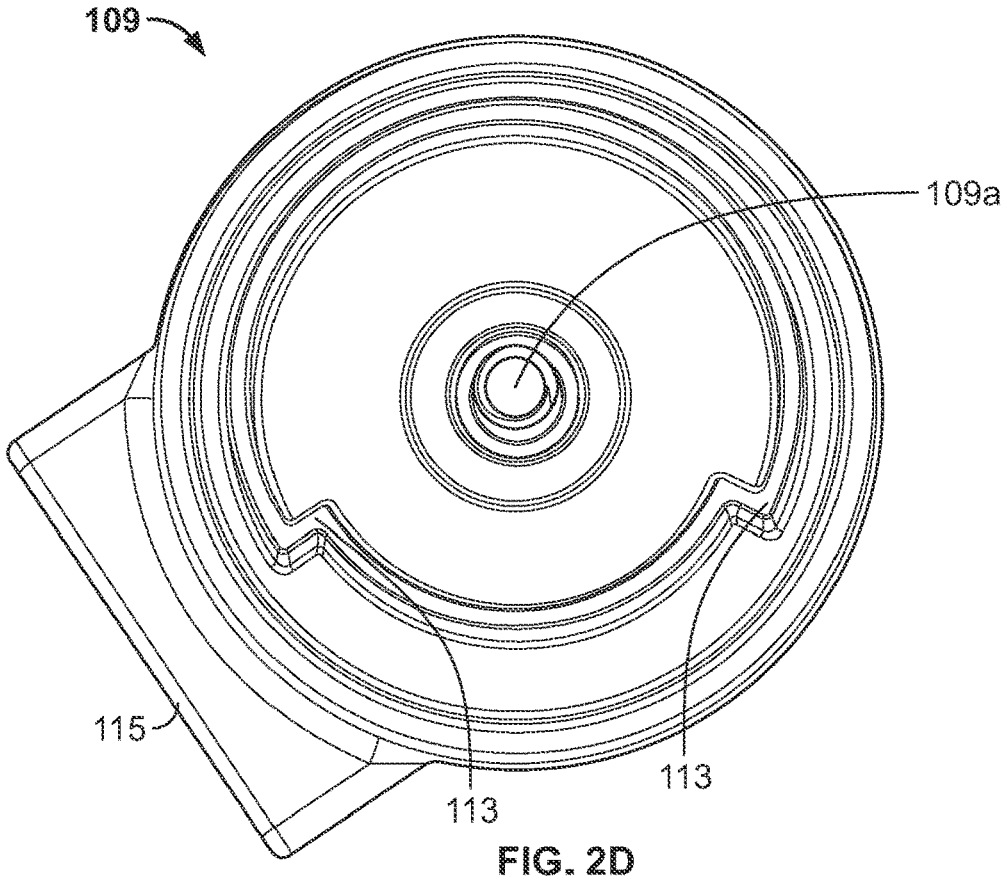
FIG. 2D is a rear perspective view the handle pivot shown in FIG. 2C according to one or more aspects described herein.

FIGS. 2C and 2D illustrate another example handle pivot 109. Handle pivot 109 may include a handle or carry strap 107 attachment point 115. In other examples, as shown in FIG. 2D, the handle pivot 109 may include a first and second stop 113. Stops 113 are configured to engage at least one or a plurality of stops 109*c* or a protrusion (not shown) when the handle pivot 109 engages the insert 109*b*. The configuration and geometry of the insert 109*b* and the handle pivot 109 may prevent the carry strap or handle 107 from rotating under the insulating container 100.

The base portion 102 further includes a second end 110 defining an opening 112 (shown in FIG. 5A) that may be used to access the interior void of the insulating container. The opening 112 may be covered by lid 104, when the insulating container is in use (e.g., when the insulating container is in a closed configuration). The base portion 102 may further include a plurality of side portions 114 connected to the bottom surface that define a void for receiving contents in the insulating container 100. The side portions 114 may be arranged such that they extend generally perpendicularly from the bottom surface 108.

In some examples, one or more side pocket handles 190 may be arranged in one or more side portions 114 (or other region of the base portion 102). The side pocket handles may be integrally molded with the base portion 102 and may generally be an undercut or cutout formed in the side portion 114 of the base 102. In some examples, such as shown in FIGS. 1A and 1B, the undercut or cutout forming the side pocket handle may include a recess extending along substantially all or a majority of the side portion 114. This may provide ease of manufacturing the base 102 with the integrally molded handles 190. In some examples, the side pocket handles 190 may be flush with an exterior surface of the base 102 in order to reduce the risk of breakage.

As discussed above, the insulating container 100 may be configured to contain, store, carry, etc., a volume of contents or possibly a liquid. In some examples, the insulating container 100 may be configured to store between twenty-two (22) and twenty-eight (28) quarts of contents. In some examples, the insulating container may be configured to store approximately twenty-four (24) quarts of contents. In other examples, the insulating container may be configured to store at least twenty-two (22) quarts of contents, or the insulating container may be configured to store at least twenty-eight (28) quarts of contents, among others. In yet other examples, the insulating container may be configured to store approximately sixteen (16) quarts of contents, twenty-four (24) quarts of contents, thirty-six (36) to thirty-eight (38) quarts of contents, or forty-eight (48) to fifty-eight (58) quarts of contents. In still other examples, the insulating container 100 may be configured to store between about fourteen (14) and about forty-five twenty-eight (45) quarts of contents. Additionally or alternatively, the insulating container 100 may be configured to store materials in a solid, liquid, or a gaseous state, or combinations thereof, without departing from the scope of the disclosure described herein.

In at least some examples, the insulating container 100 (and various other containers described herein) may be sized to accommodate the volume of contents described above. For example, the insulating container 100 may be at least seventeen (17) inches tall, at least sixteen (16) inches wide, and at least fourteen (14) inches deep. Additionally or alternatively, the insulating container 100 may be configured in different sizes (i.e., height, width, and depth) without departing from the scope of the disclosure described herein.

As previously discussed, the insulating container 100 includes a lid 104. In some examples, the lid 104 may connect to the base 102 in a closed configuration using a press fit. Additionally or alternatively, other securing systems or devices may be used to secure the lid 104 to the base. Insulating container 100 may include latching devices 120 and keepers 140 of the base 102 on the front of the container, as shown in FIG. 1A, to secure the lid 104 in the closed position. In some examples, the insulating container 100 includes at least one or a plurality of latch slots 141 integrally molded at the top of base 102. The latch slots 141 may be configured to provide a recess sized appropriately to accommodate the latch 120 in such a manner that the latch 120 is flush with the latch slot 141 when the lid 104 is in a closed and secured configuration. In other examples, the latch 120 is flush with the latch slot 141 and the keeper 140 when the lid 104 is in a closed and secured configuration. In other configurations, insulating container 100 may include a lid 104 and base 102 that form at least one corner lift ledge 192 to facilitate easy gripping of the lid for opening. In other examples, the insulating container may include a plurality of corner lift ledges 192. In certain examples, the lift ledge 192 may be formed by an integrally molded portion of the corner of the lid 104, and an integrally molded portion of the front corner at the top of the base 102. In still other configurations, insulating container 100 may include front lift ledge 191 integrally molded in the base 102. The front lift ledge 191 may integrally molded at the top of the base 102. The lift ledge is configured to provide the insulating container an easily accessible region to allow an individual to grasp the lid 104 for ease of opening (i.e., one handed operation).

In some examples, the lid 104 may be hinged such that it is connected to (either removably or permanently) the base 102 at a hinge 116 and may be rotated about the hinge 116. The hinge may be one of various types of hinges, including a continuous piano hinge, double hinge, ball joint hinge, living hinge, and the like. The hinge 116 may permit the lid 104 to be opened and rotated away from the base portion 102, to allow access to the internal void defined by the base portion 102 (e.g., via opening 112). That is, the hinge may facilitate rotation of the lid 104 from a closed configuration of the insulating container (e.g., when the lid is in place covering the internal void formed by the base) to an open configuration (e.g., when the lid is not covering the internal void formed by the base), and vice versa. In some examples, the insulating container 100 is configured with at least one hinge 116. In another example, the insulating container is configured with a plurality of hinges. In still other configurations, hinge 116 comprises a first portion integrally molded in the lid 104 and a second portion integrally molded in the base 102. In yet other examples, the hinge 116 may further include at least one pin pocket 194 or a plurality of pin pockets 194 to secure the lid 104 to the base 102 via at least one hinge pin 195 thus allowing the lid to rotate from a closed position to an open position. In other examples, a plurality of hinge pins 195 secure the lid 104 to the base 102.

Figure 1C:
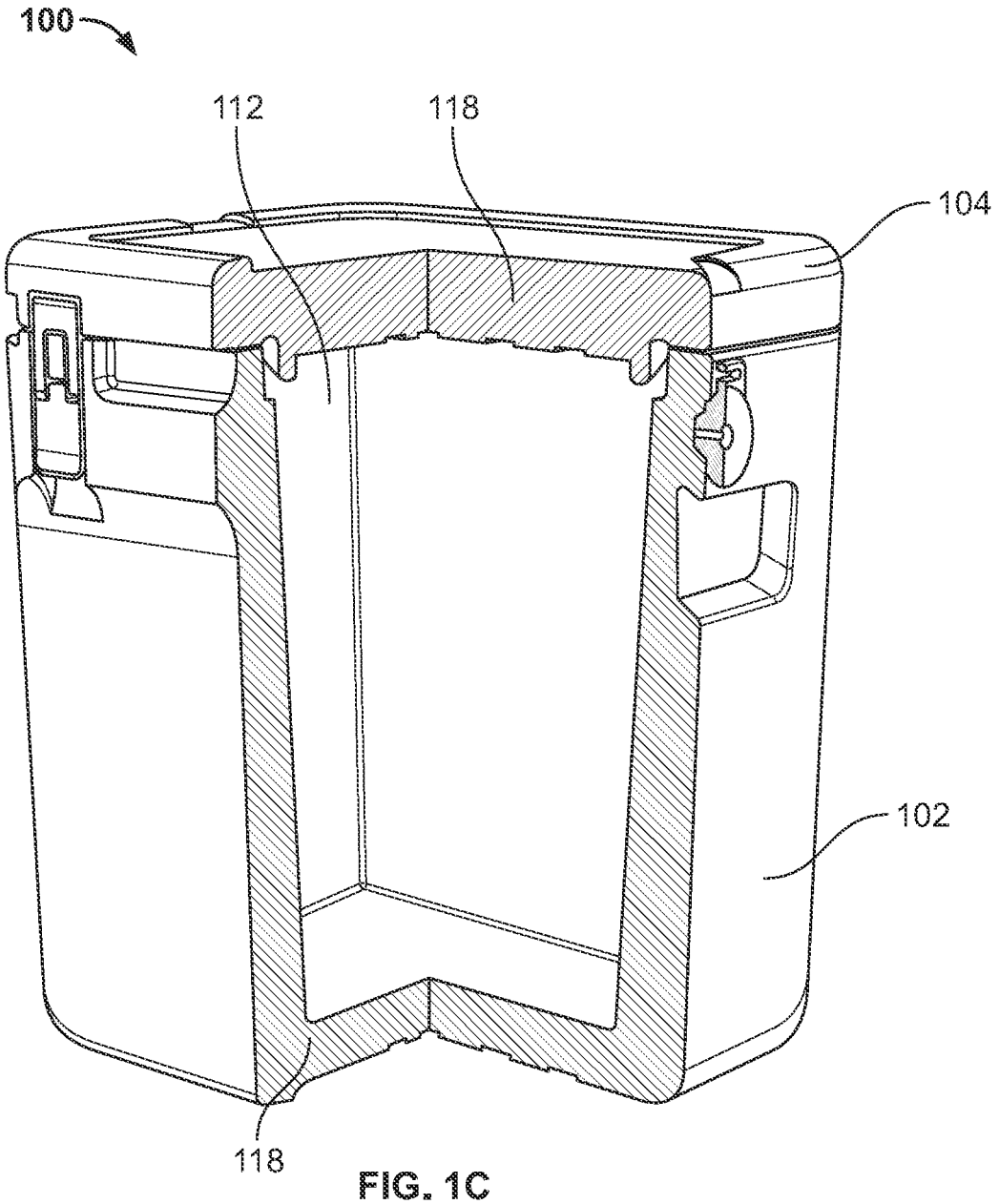
FIG. 1C is a front perspective, internal cross-sectional view of the insulating container depicted in FIGS. 1A and 1B.
Figure 5A:
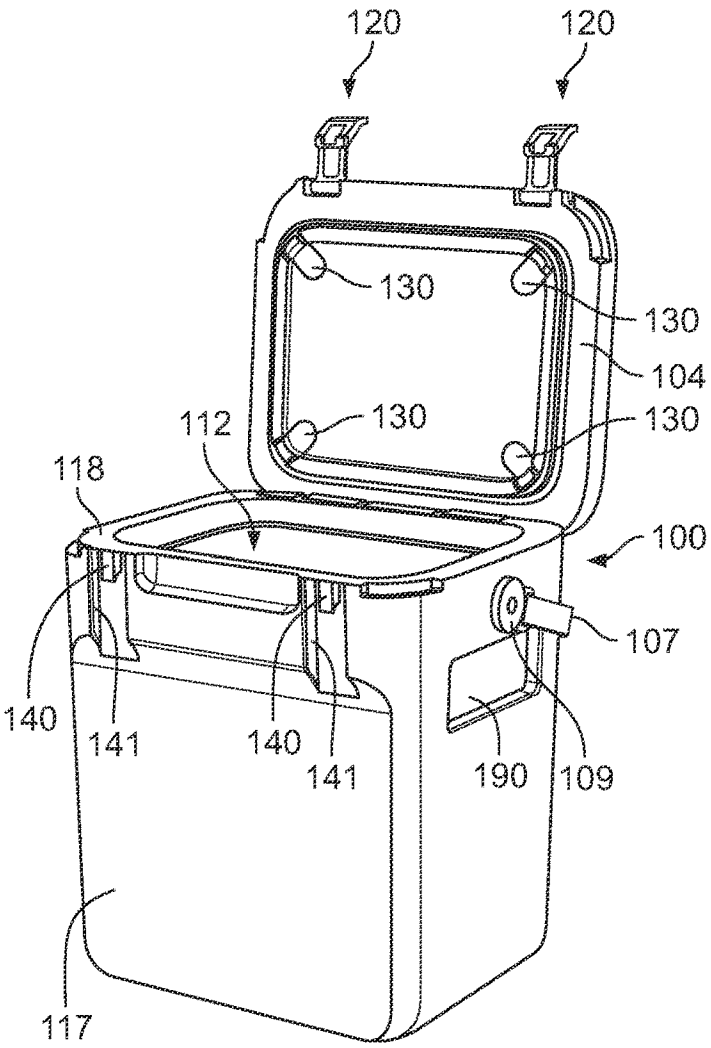
FIG. 5A illustrates one hinge arrangement in which a lid may be rotated from a closed configuration to an open configuration according to one or more aspects described herein.

In the examples described herein, base 102 and lid 104 may include an exterior surface or outer shell 117 surrounding and enclosing an insulating portion 118, as shown in FIGS. 1C and 5A. The shell 117 is typically formed from various materials, such as one or more metals, alloys, polymers, ceramics, or fiber-reinforced materials. In some examples, the shell 117 may be formed of a plastic material, such as polyethylene, that is molded to form both the base 102 and lid 104 portions. In some examples, the insulating portion 118 is formed of an insulating material that exhibits low thermal conductivity. For instance, the insulating portion 118 may be formed of (or filled with) a polymer foam, such as polyurethane foam. Additional or other insulating materials may be used without departing from the invention. In some examples, the base 102 and lid 104 portions are formed using a roto-molded process as would be understood by one of ordinary skill in the art (not shown). However, various other types of molding or other manufacturing processes (e.g., stamping, casting, forging, and the like) may be used to form the insulating container without departing from the invention.

Figure 3A:
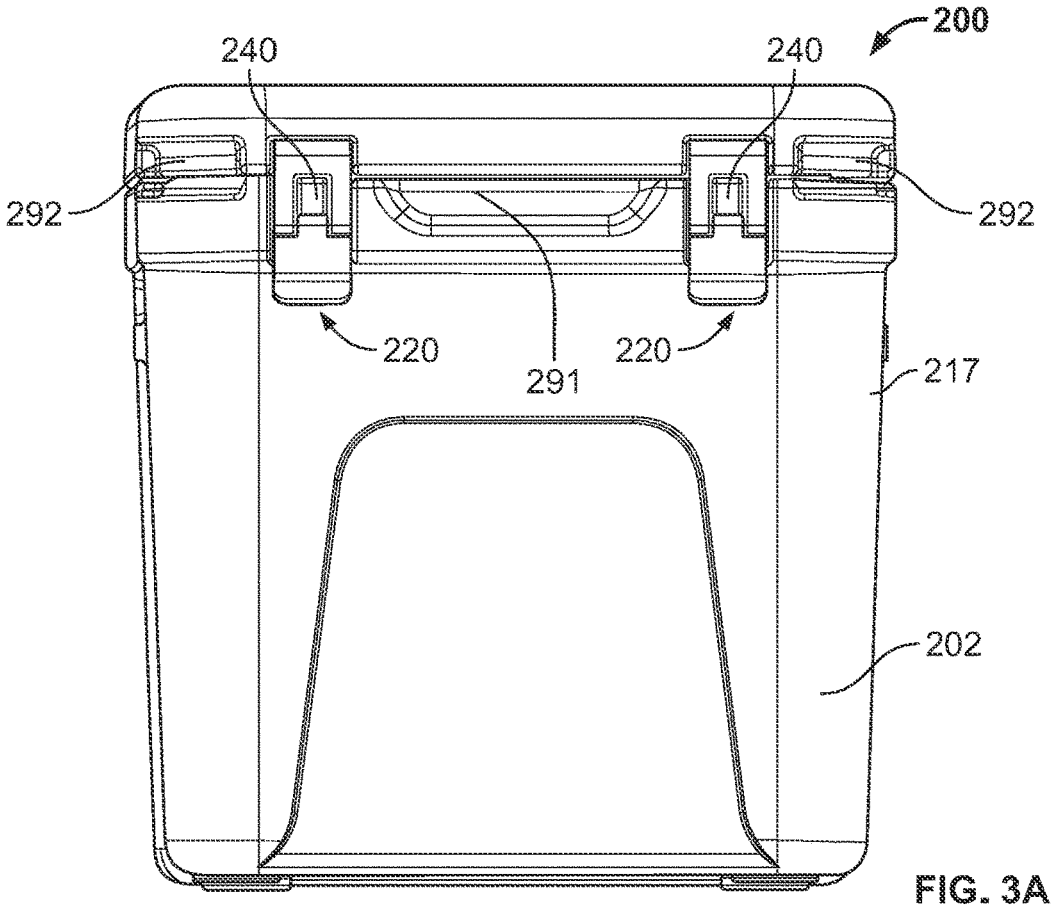
FIG. 3A is a front view of another example insulating container according to one or more aspects described herein.
Figure 3B:
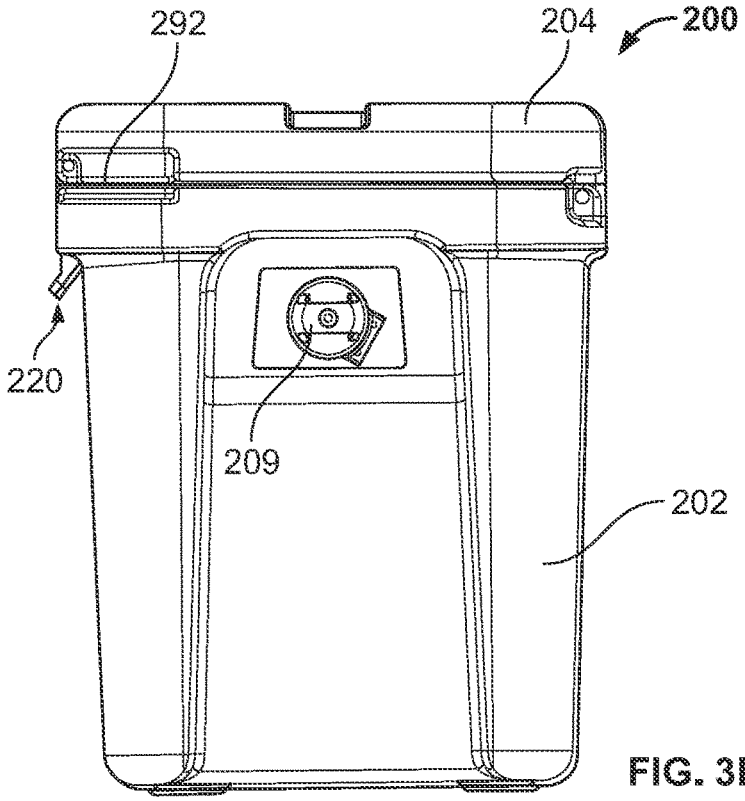
FIG. 3B is a side view of another example insulating container according to one or more aspects described herein.
Figure 3C:
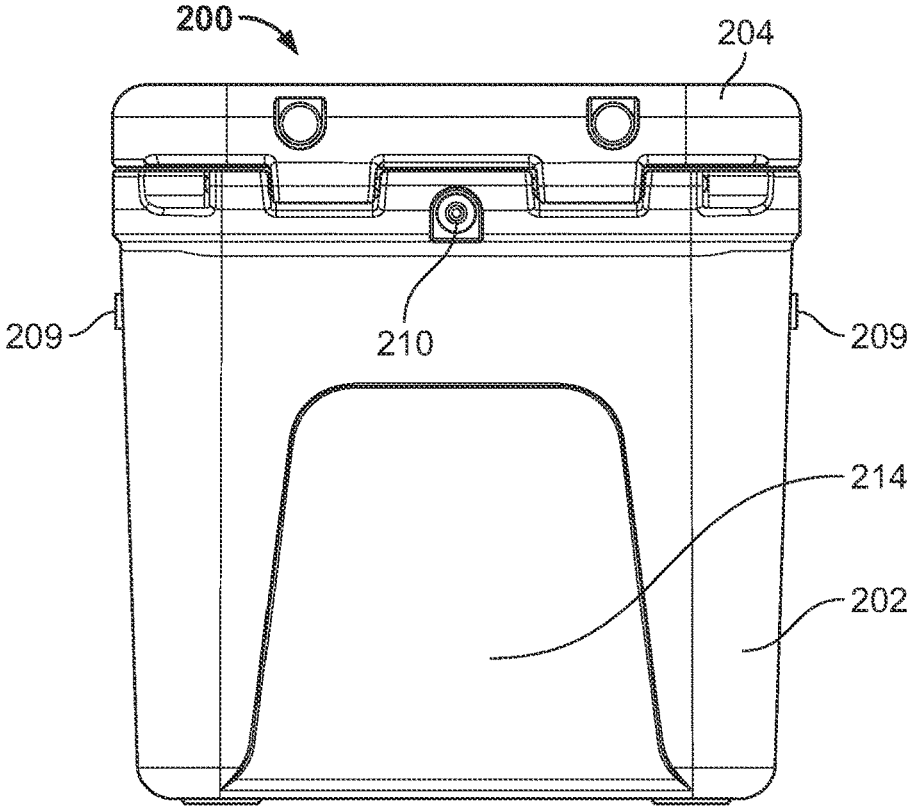
FIG. 3C is a rear view of another example insulating container according to one or more aspects described herein.

In other embodiments, as illustrated in FIGS. 3A-3C, the insulating container 200 includes latching devices 220 similar to those discussed with respect to FIGS. 1A and 1B. That is, the latching devices include keepers 240 of the base 202 on the front of the container 200 (e.g., similar to keepers 140 on container 100, as shown in FIG. 1A, including latching devices 120 to secure the lid 104 in the closed position). Accordingly, when the lid 204 is in the fully closed position, the engaging portion of a latch (not shown) will be received in and engaged with keepers 240 formed on the front of the insulating container 200 (as shown in FIG. 3A). In other configurations, insulating container 200 may include a lid 204 and base 202 that form at least one integrally molded corner lift ledge 292 to facilitate easy gripping of the lid for opening. In still other configurations, insulating container 200 may include front lift ledge 291 integrally molded in the base 202.

Similar to the examples discussed above, the keepers 140 and 240 may be molded into the base 102 and 202 as shown in FIGS. 1A and 3A, respectively. A similar process to that described below may be used to engage/disengage the latch 220 with the keepers 240. In still other embodiments, the base portion 202 may also include carry handle or carry strap 207 (not shown). Carry handle or strap 207 may be connected to pivot 209. In still other embodiments, the insulating container may lack a carry handle or strap and pivots. In other embodiments, insulating container 200 may include pressure regulation device 210 arranged in a rear or back side 214 of the base 202, as shown in FIG. 3C. In yet other examples, the pressure regulation device 210 may be configured in the lid 204.

Figure 4A:
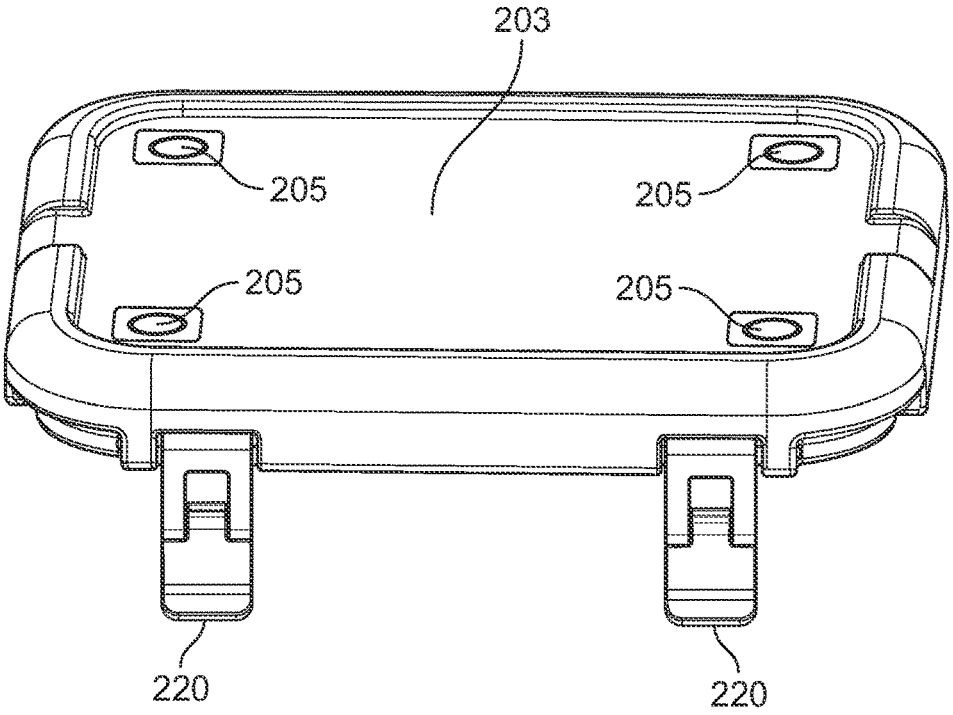
FIG. 4A is a top view front view of the insulating container lid of FIGS. 3A-3C according to one or more aspects described herein.
Figure 4B:
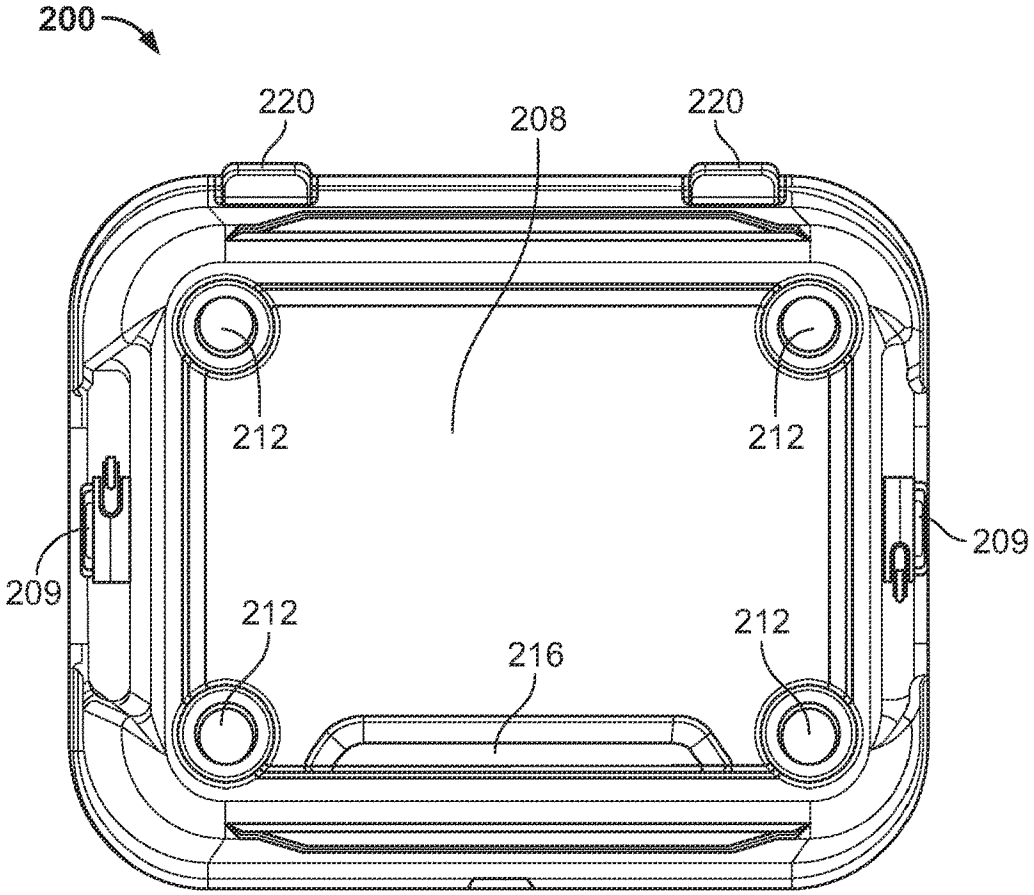
FIG. 4B is a bottom view front view of the insulating container of FIGS. 3A-3C according to one or more aspects described herein.

In other embodiments, the lid 204 of insulating container 200 may include a plurality of accessory magnets 205, as shown in FIG. 4A. The magnets 205 may be arranged on a top, exterior surface 203 of the lid 204. In some examples, the magnet may be substantially disc shaped or substantially ring shaped. In other examples, the magnets are configured to secure additional accessories to the top of the lid. In yet other examples, the magnet 205 is secured to the top of the lid via a press fit or adhesive. In another example, the magnet 205 is threaded and screwed into the lid 204. In still other examples, the magnet 205 is secured to the top of the lid by a fastener 205*a* (as shown in FIG. 10) such as a screw, bolt, rivet, or the like. Some example attachable and removable accessories may include a lid pack, a plastic or wooden cutting board, a seat cushion, or a lid net. The base portion 202 may include a first end 206, having a bottom surface 208. The bottom surface 208 may be configured to support the insulating container on a surface, such as a table, the ground, a vehicle bed, boat deck, or the like and may include a plurality of feet 212, as shown in FIG. 4B. Feet 212 may be configured to provide a non-skid or no-slip surface, and may be configured to keep the insulating container 200 elevated off the ground. In another example, feet 212 may be configured to reduce friction with the ground or surface so that the insulating container may be moved more easily while the container is on the ground (i.e., the insulating container may easily slide or be easily pushed across the ground). Feet 212 may be constructed of rubber, foam, plastic, or other suitable material. In still other embodiments, the bottom surface 208 may include a logo or name of a company or manufacturer of the insulating container embossed, integrally molded, or pressed into the exterior shell 217, as shown in FIG. 4B. In some embodiments, bottom pocket 216 may be integrally molded in the bottom surface 208 of the base portion 202. Bottom pocket 216 allows an individual to grasp the base portion 202 from the bottom surface 208 to facilitate easy emptying or dumping out the contents of the insulating container (e.g., ice, melted ice, water, etc.).

Figure 5C:
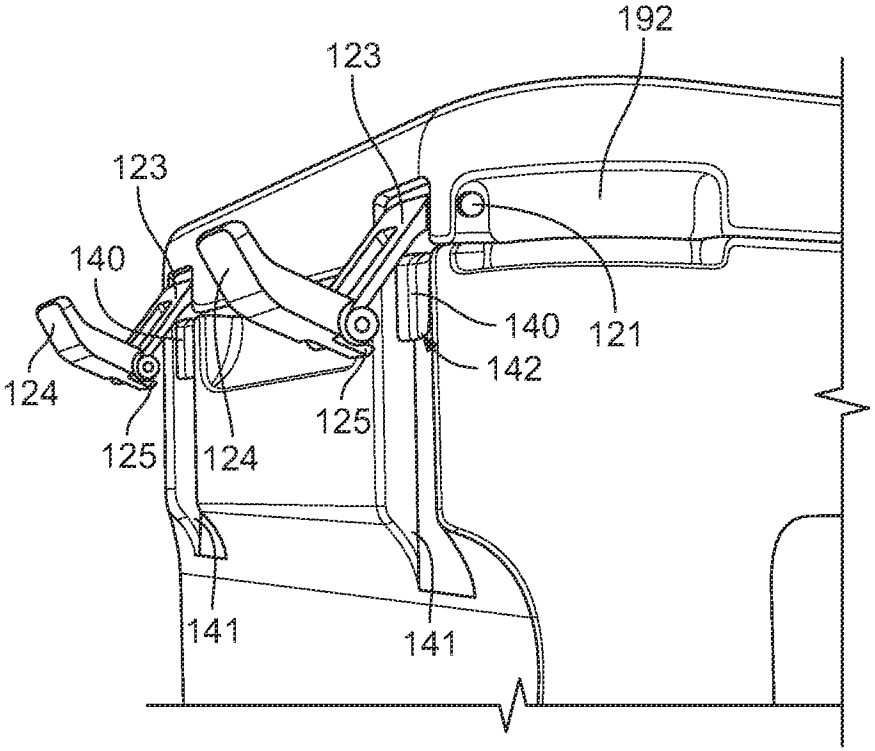
FIG. 5C is a perspective view of a low profile over center latching device or mechanism in the unsecured configuration according to one or more aspects described herein.

FIG. 5A illustrates the lid 104 of the insulating container 100 in a substantially open position. As shown in FIG. 5C, the lid 104 is in a substantially closed, but unsecured position. That is, the lid 104 is substantially perpendicular to the base 102 and is covering the opening. In order to open the lid 104, and thereby access the internal void defined by the base 102 of the insulating container 100, the lid 104 may be lifted upward, in the direction of the arrow shown in FIG. 5A. When the lid 104 is configured in the closed and secured position, the lid seals the opening 112. The lid is configured to travel approximately 115° from the fully closed to fully open position. In some examples, the lid is configured to travel at least 90°, 95°, 100°, 105°, 110°, 115°, or 120° from the fully closed to fully open position. In other examples, the lid 104 may be configured to travel from about 90° to 120° in the fully open position. In some examples, the lid remains upright when configured in the fully upright position. In still other examples, with further reference to FIGS. 1A, 1B, 3A-3C, and 5A, to open the lid 104 (e.g., to allow access to an interior void formed by the base 102), the hinged lid 104 may be rotated away from the base portion 102 and may rest along a rear side 114 of the base portion 102 (e.g., the lid) may rotate at least 90° from a closed configuration (e.g., the position shown in FIGS. 1A, 1B, 3A-3C, and 5C) to an open configuration (e.g., the position shown in FIG. 5A). In some examples the fully open position or configuration may include at least a portion of a top, exterior surface of the lid 104 being in contact with a rear (or other) side portion 114 of the base portion 102 of the insulating container 100.

As illustrated in FIG. 5A, some example insulating containers may include a plurality of foam plugs 130 in the underside of the lid 104. In other examples, the foam plug 130 may further include an accessory clip 132. The accessory clip may be configured to engage with and secure additional accessories or devices to the bottom (i.e., underside) of the lid 104 for convenient storage. For example, a net mesh accessory may be attached to a plurality of clips 132. In some examples, the net mesh (not shown) may be constructed of a flexible rubber and it may prevent certain items from getting exposed to water or ice residing in the interior void of the insulating container. Other accessories such as trays or baskets may be stored in the bottom of the interior void of the insulating container, and/or may be configured to rest at the top of the interior void. In some examples, a tray or basket may include a lip around the perimeter of the tray (not shown) that allows the tray to hang from the edge of the opening 112 while remaining within the interior void of the insulating container. Such a configuration allows the lid 104 to be configured in the closed and secured position thereby sealing the interior void while the tray or basket is secured in place inside/within the insulating container 100.

Figure 5B:
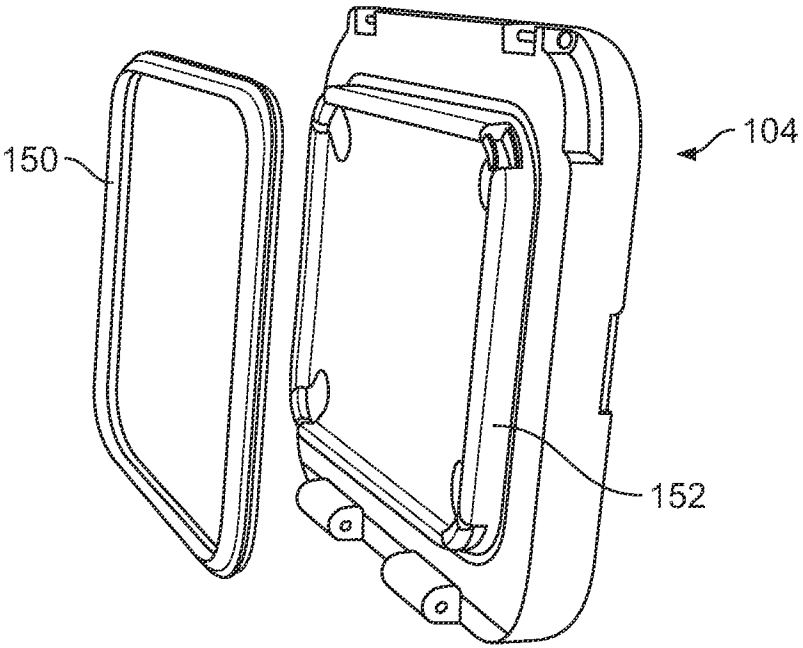
FIG. 5B is a perspective view of a detached lid with an exemplary gasket removed according to one or more aspects described herein.

As illustrated in FIGS. 5A and 5B, the underside of the lid 104 may include a logo or name of a company or manufacturer of the insulating container that is embossed, integrally molded, or pressed into the bottom of the lid 104.

In addition, in some examples, the insulating container may include a gasket or other sealing device. The gasket may be arranged in either the lid or the base and may aid in sealing the lid and the base when the lid is in a closed and secured configuration. In other examples, the gasket may be arranged in either the lid or the base and may provide a watertight seal when the lid is in a closed and secured configuration. In some examples, the gasket may be seated in a recess formed in at least one of the base and the lid and extending around a perimeter of the at least one of the base or the lid. In other examples, as shown in FIG. 5B, the gasket 150 may be seated in a gasket adapter 152 formed in at least one of the base 102 or the lid 104 and extending around a perimeter of the at least one of the base or the lid. In other examples, the gasket 150 may be constructed of rubber, silicone, or other suitable material. The gasket may aid in maintaining the temperature of the contents or liquid contained within the insulating container. Various other gasket examples may be used with any of the insulating containers described herein.

In some examples, the gasket may include strategically placed cut-outs that may reduce or eliminate a need for a vent (e.g., a vent to prevent lid lock), as will be discussed more fully below. In some examples, the gasket may be a traditional gasket having a substantially circular cross section. In other examples, the gasket may have a particular cross section configured to aid in venting the insulating container. In some examples, the cross section is a V-shaped or substantially V-shaped portion of the gasket. In yet other examples, the gasket may also include at least one weep hole to allow passive venting of air or fluids in and out of the interior void when the insulating container is in a closed and secured configuration to prevent lid lock. In other examples, the gasket may include a plurality of weep holes. In still other examples, the gasket is configured to provide a water-tight seal when the lid is in a closed and secured configuration.

In some examples, the lid 104 may be configured to remain secured or locked in a closed position using latching devices 120. The latching devices 120 may be various types of latches, including a latch having a latch portion and a keeper portion on the base 102, as well as various other types of latches.

Figure 6C:
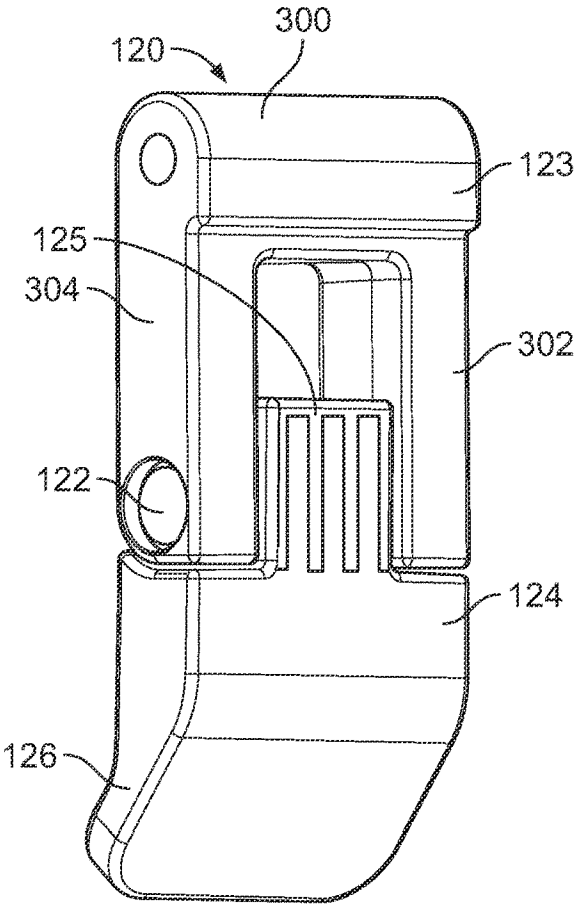
FIGS. 6A-6C illustrate front, perspective, and rear views of a latch or latching device arrangement to secure the lid in a closed configuration according to one or more aspects described herein.
Figure 6B:
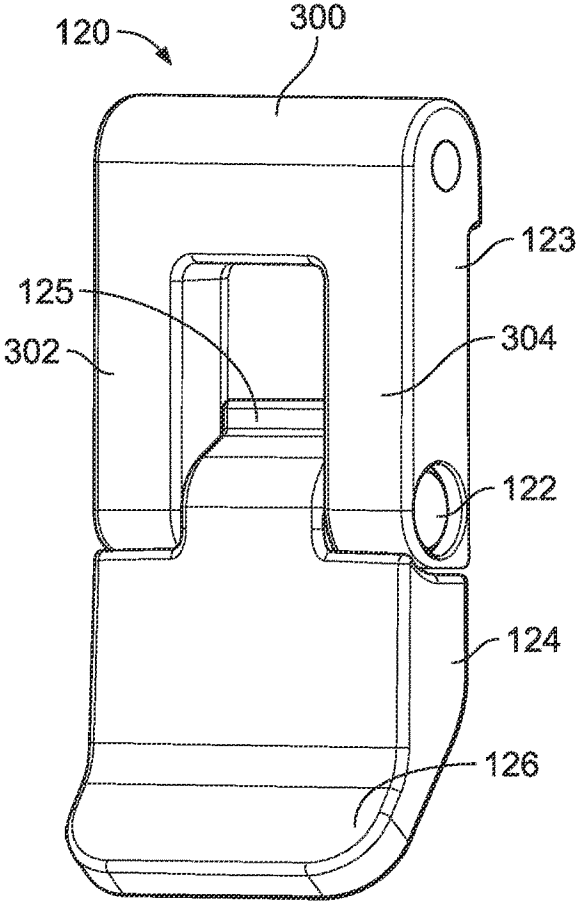
Figure 6A:
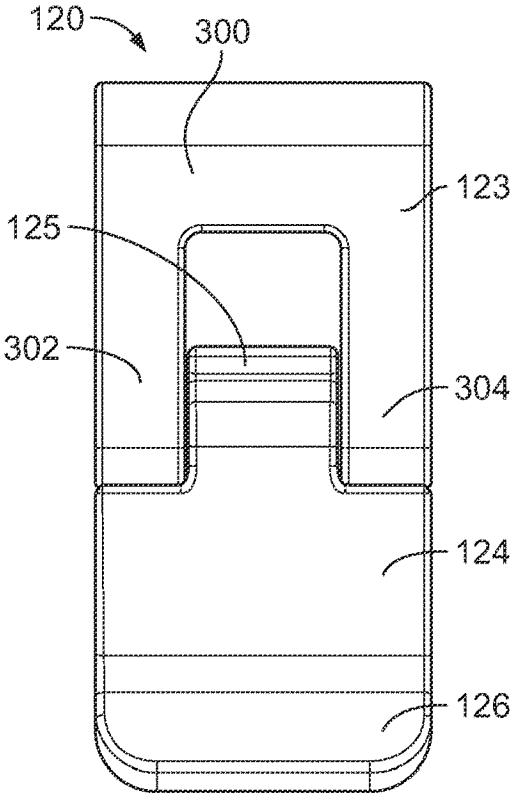

FIG. 1A illustrates the latching device 120 in a closed and secured position, while FIG. 5C illustrates the latching device 120 in an unsecured position while the lid 104 is in a closed, but unsecured configuration. When in a secured position, the latching device 120 is positioned such that the lid 104 abuts the base 102 of the insulating container 100, thus closing, securing, and/or sealing the container. To disengage the latching device 120, the grasping portion or latch lower 124, as shown in FIG. 6A, is pulled/flipped away from the base 102 of the container 100. In other words, the latch upper 123 stretches so that the latch lower engaging tab 125 disengages from the latch keeper 140. Once the engaging tab 125 clears the latch keeper 140, the latch 120 is swung upward, away from the container, and in an arc. As illustrated in FIGS. 6A-6C, the latch lower 124 may be pivotally attached and secured to the latch upper 123. The latch upper 123 may be pivotally attached and secured to the lid 104 of the insulating container 100.

Similarly, to close the container 100, the latch device 120 is moved in a downward arc, toward the container 100. When the movement of the latch upper 123 and the latch lower 124 reaches the latch keeper 140, the latch lower 124 is rotated so the engaging tab 125 is positioned downward, toward the base 102 and the engaging tab 125 is seated/positioned within the keeper groove 142 in the bottom of the keeper 140, as shown in FIG. 5C. The latch lower 124 is then rotated/pushed downward until the latch lower 124 and latch upper 123 are seated and secured. When in the seated and secured position, the latch upper 123 is stretched and tensioned thus maintaining a constant downward force on the lid 104 securing and sealing it in the closed configuration. In certain examples, the latch lower may be more rigid than the latch upper. In some examples, the latch upper may be more rigid than the latch lower. In still other examples, the engaging tab may be formed of a rigid material and the latch lower may be formed of an elastomeric material. The latch lower and the engaging tab may be formed by co-molding or injection molding (e.g., multi-material injection molding). In other examples, the engaging tab of the latch lower is a rigid material and the remainder of the latch lower is an elastomeric material. In some examples, the latch lower and the engaging tab may be formed of the same materials. In another example, the latch upper and the latch lower may be not be elastic and/or the latch upper and the latch lower may be semi-rigid. In this example, the gasket is further configured to compress allowing the latch lower to be rotated so that the engaging tab can be seated/positioned within the keeper groove in the bottom of the keeper thus securing the lid in the closed configuration. In certain examples, the gasket may be further configured as the elastic component (i.e., in place of the latch upper or lower) to provide the necessary clearance required to engage the latch lower engaging tab with the latch keeper. When in the seated and secured position, the latch upper and latch lower maintain the lid in a position that compresses the gasket. The gasket thus maintains a constant force on the lid securing and sealing the lid in the closed and configuration. Further, when in the seated position, the latch upper 123 and the latch lower 124 of the latch 120 may be mostly recessed within the latch slot 141, and, in some examples, the latch mechanism 120 does not extend or protrude beyond the surface thereof. In other examples, the latch device/mechanism 120 is substantially rectangular shaped when the lid 104 is secured in the closed position/configuration.

As will be understood by one of ordinary skill in the art, the latch upper 123 is made of materials and sized such that when in the closed/seated and secured position, enough force remains to maintain the closed position of the container lid 104. In other words, in the closed position, a certain amount of tension is maintained on the latch upper 123 as it is not completely returned to its unstretched position/state. In some examples, the latch upper 123 may be an elastomeric rubber and the latch lower 124 may be a rigid plastic or composite material. In other examples, the latch upper 123 may be a rigid plastic or composite material and the latch lower 124 may be an elastomeric rubber. In yet other examples, the latch upper 123 may be constructed of both an elastomeric rubber and/or a rigid plastic or composite material. In still other examples, the latch lower 124 may be constructed of both an elastomeric rubber and/or a rigid plastic or composite material. In certain examples, the latch upper 123 and/or latch lower may be wholly or partly constructed of a semi-rigid and/or semi-elastomeric material. In another example, both the latch upper 123 and the latch lower 124 are an elastomeric rubber. In still another example, both the latch upper 123 and the latch lower 124 are a rigid plastic or composite material. In the closed position, the engaging tab 125 of the latch lower 124 is received within the recessed groove 142 of the latch keeper 140. In some example examples, the engaging tab 125 is sized and shaped so as to provide maximum contact with the recessed groove 142, thus ensuring an easily maintainable closure.

One example latching device 120 that may be used with the insulating container 100 is described with reference to FIGS. 6A-6C. The latching device 120 shown and described is merely one example latch that may be used and various other types of latches may be used without departing from the invention.

FIGS. 6A-6C are front, perspective, and rear views of an example latching device 120 to secure the lid in a closed configuration. The latching device 120 includes a latch upper 123 and a latch lower 124. The latch lower further includes engaging tab 125 configured to engage a groove or slot 142 formed on the bottom of keeper portion 140. The latch lower may further include a finger lift 126 positioned opposite the engaging tab 125. In other examples, the finger lift 126 may extend out and away or distally from the insulating container lid 104.

According to one aspect of the invention, the latch upper 123 is made of a flexible, stretchable, resilient, elastomeric, one-piece molded material that is typically pivotally/hingedly attached to the lid portion 104 of the container 100 and received within a recessed, elongated latch slot 145 which is typically integrally molded to the container 100. In some examples, the latch slot may be integrally molded as part of both the lid 104 and the bottom portion 102. The latch upper 123 and latch lower 124 may be molded in a single-piece construction from rubbery materials as would be understood by those of ordinary skill in the art. The latch upper 123 and latch lower 124 may also be formed of a material that is formed or made from a plastics material or another suitable material which can be formed or molded into a shape and thus retain the shape to which it has been formed. The latch upper 123 and latch lower 124 may be made of sufficient size, thickness and materials of construction to withstand repeated cycles of stress as the latch 120 is engage/disengaged with the latch keeper 140 over time.

As further depicted in FIGS. 6A-6C, the latch upper 123 may include a base 300, a first arm 302, and a second arm 304. The first arm 302 and the second arm 304 may be substantially perpendicular to the base 300. The first arm 302 may be substantially parallel to the second arm 304. The latch upper 123 may be substantially shaped like an inverted U. In other examples, the latch lower 124 includes the engaging tab 125. Engaging tab 125 may be configured to pivotally rotate within/between the latch upper first arm 302 and the latch upper second arm 304. In another example, the keeper 140, as shown in FIG. 1A, may be located between the latch upper first arm 302, the latch upper second arm 304, and below the latch upper base 300. FIG. 1A further illustrates that the keeper 140 may be flush with the latch upper base 300, first arm 302, second arm 304, and latch lower 124 when the insulating container lid is in the closed and secured configuration.

FIGS. 6B and 6C illustrate that latch lower 124 may be pivotally attached to the latch upper 123 and secured to the latch upper 123 by latch lower pin 122. Latch upper 123 may be pivotally attached to lid 104 and secured to the lid 104 by latch upper pin 121, as shown in FIG. 5C.

In some examples, the latch 120 is configured such that the finger lift 126 extends from the latch lower 124 at an angle that departs from the plane of the latch 120. The angle between the finger lift 126 and the latch lower 124 and the latch upper 123 may aid in or facilitate grasping the finger lift 126 by a user. At this angle, the user is easily able to slip his or her fingers between the finger lift 126 and the side of the base portion 102 of the insulating container 100 for disengaging the latch 120 from the keeper 140. Further, because the latch upper 123 is made from a resilient material, even though the finger lift 126 may extend from the body of the container, it is not easily dislodged or broken.

The finger lift 126, as best shown in FIG. 6B, is typically formed into a shape that is easily grasped or accessed by a user. Without intending to be limited thereby, other shapes and geometries are contemplated for the finger lift 126 for manipulation of the latch 120.

Similar to the examples discussed above, another feature of the latching mechanism or device 120, the latch keeper 140 may be integrally molded within the base portion 102. The latch keeper 140 may be positioned within an elongated keeper slot 141. As previously discussed, the latch keeper may include a groove or slot 142 formed in the bottom of the keeper 140. The recessed groove 142 is typically configured for receiving the engaging tab 125 of the latch lower 124. In other examples, the latch keeper 140 may be substantially square or substantially rectangular shaped. Similarly, the elongated keeper slot 141 may be substantially rectangular shaped. This combination of features provides a strong and very secure lid latching system.

Figure 7A:
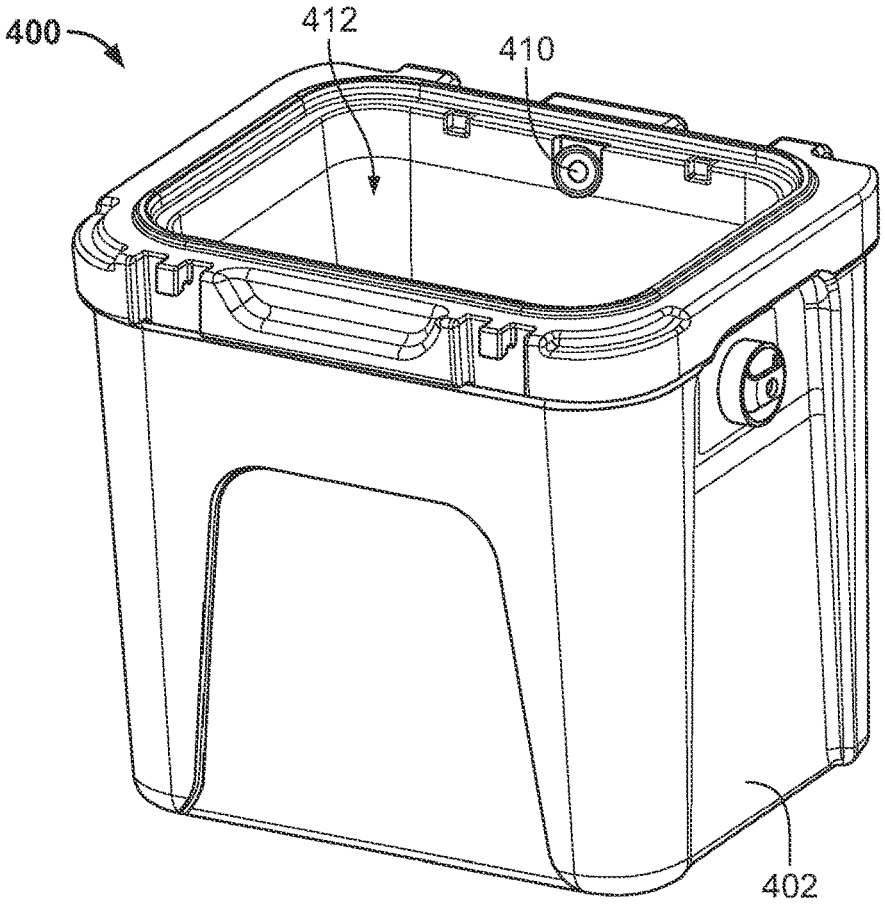
FIGS. 7A-7B illustrate a front top perspective view, and a rear perspective view of another example insulating container with the lid removed and including a pressure regulation device in the back or rear side of the insulating container according to one or more aspects described herein.
Figure 7B:
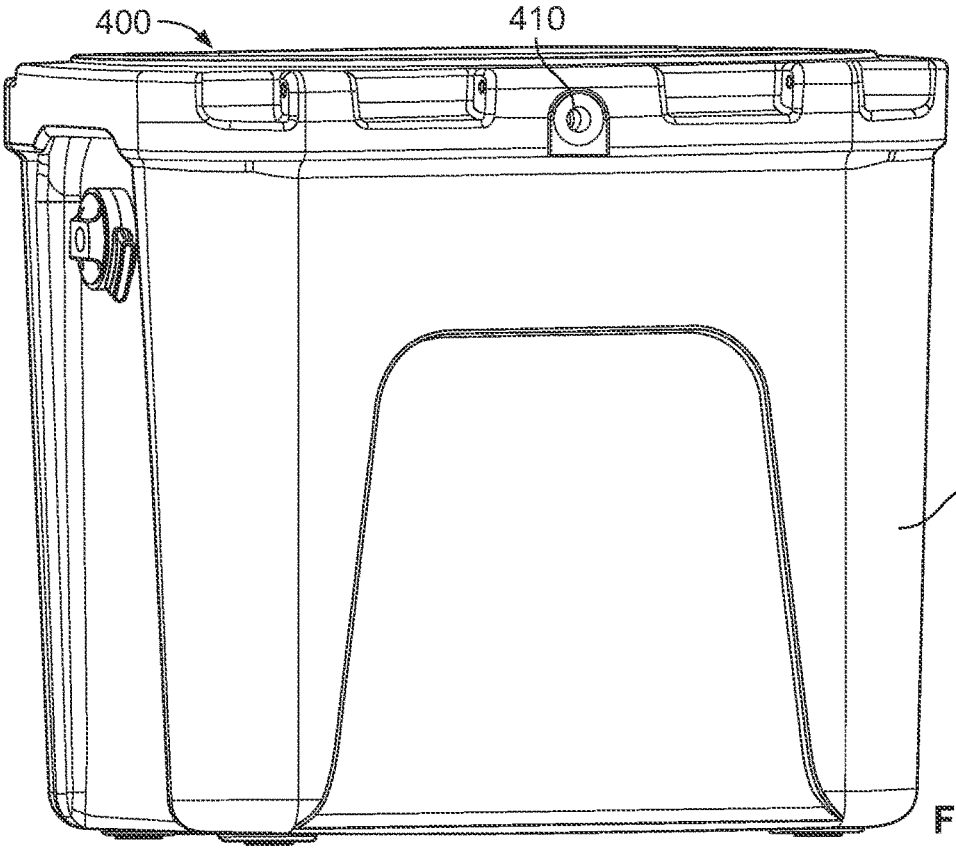
Figure 8A:
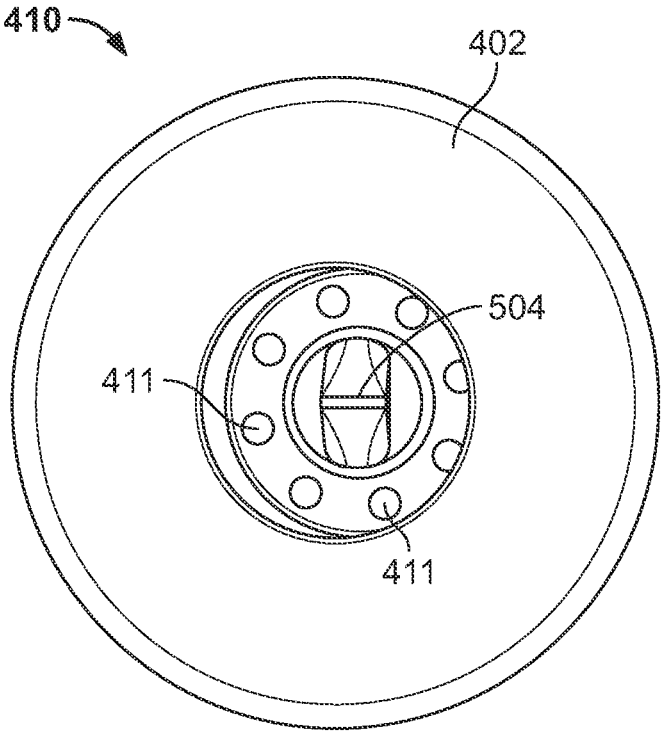
FIGS. 8A-8B illustrate various expanded views of a pressure regulation device of the insulating container shown in FIGS. 7A-7B according to one or more aspects described herein.
Figure 8B:
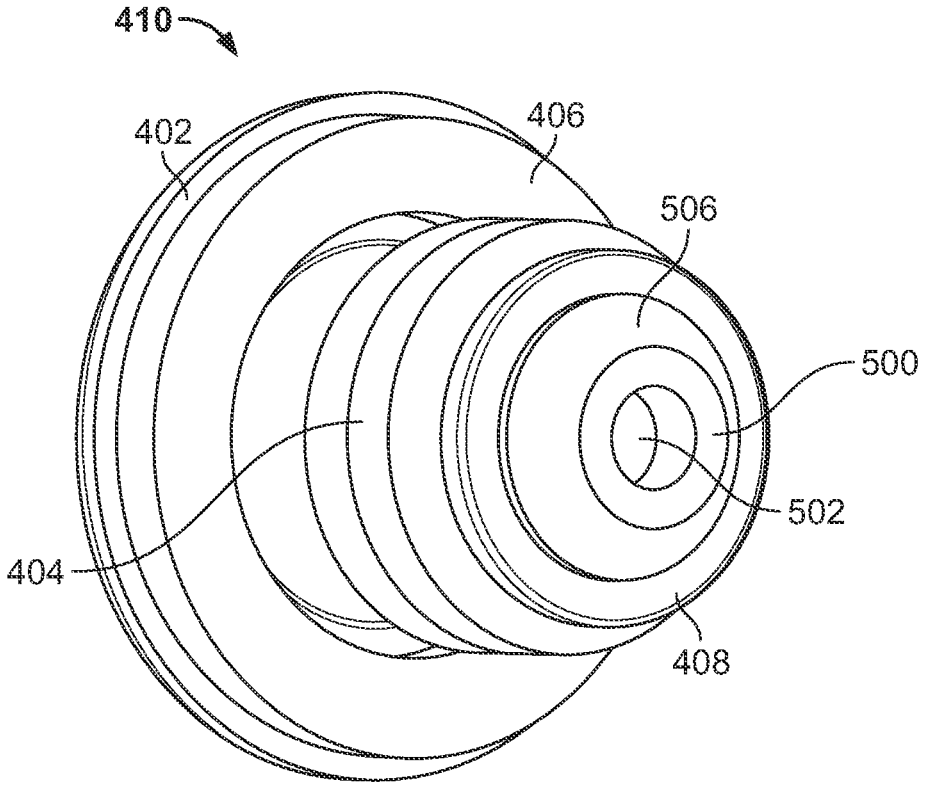

FIGS. 7A-7B illustrate another example insulating container 400 with the lid removed to better illustrate the interior void 412. In some examples, at least one pressure regulation device 410 may be configured in the rear side portion 414 of the base 402. The pressure regulation device 410 may be configured to regulate the internal pressure of the interior void 412 with the external atmospheric pressure. The pressure regulation device 410 may be permanently affixed or removably inserted into a bore (not shown) integrally molded in the rear side portion 414. In certain examples, the pressure regulation device may include vent 402 positioned on the interior rear side portion 414 and within the interior void 412. In some examples, vent 402 may include a plurality of umbrella valve vents 411 configured to allow the one way passage and release of air from the interior void 412 via an umbrella valve 500, as shown in FIGS. 8A and 8B. The pressure regulation valve may also include a vent gasket 406, umbrella valve gasket 408, and vent stem 404, as shown in FIG. 8B. In certain examples, the vent stem 404 may include a plurality of ribs configured to provide a friction or press fit in a substantially cylinder-shaped bore integrally molded in the rear side portion 414. In still other configurations, the pressure regulation device may be secured in the rear side portion 414 by an adhesive, RF welding, etc. In another example, the umbrella valve 500 may be configured within and over the stem 404 and umbrella gasket 408. In other examples, the pressure regulation device may also include a duckbill valve 504 within the stem 404.

Figure 9A:
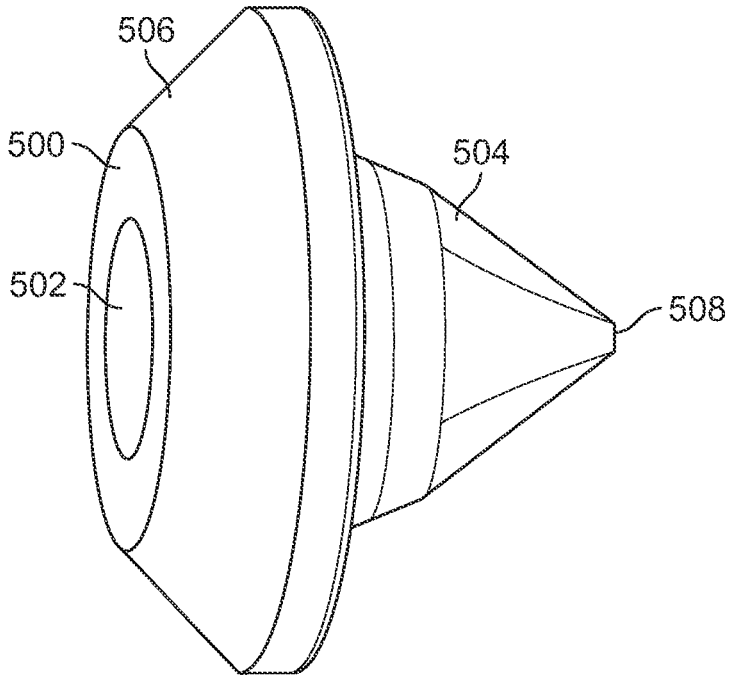
FIGS. 9A-9B illustrate various expanded views of a duckbill-umbrella valve comprising the pressure regulation device as shown in FIGS. 8A-8D according to one or more aspects described herein.
Figure 9B:
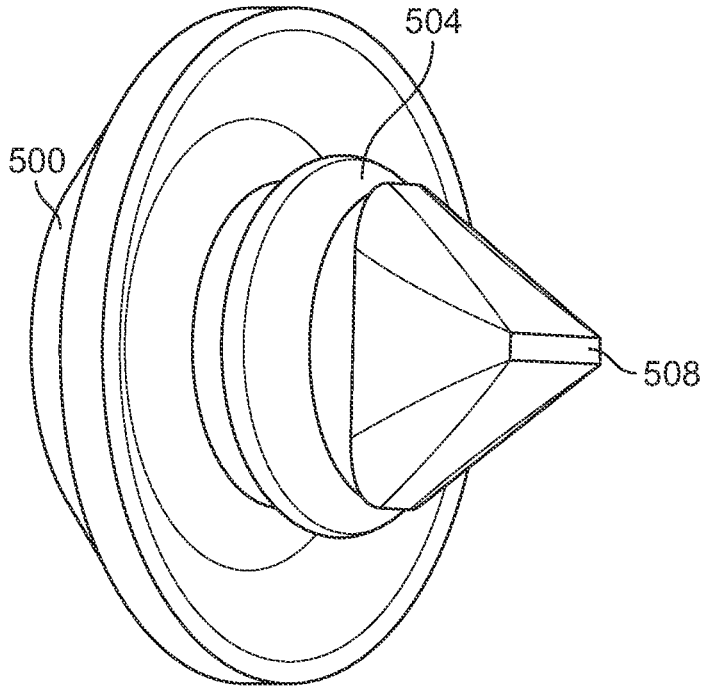

As shown in FIGS. 8A, 9A, and 9B, the pressure regulation device 410 may include umbrella valve 500 and duckbill valve 504. The duckbill valve 504 and umbrella valve 500 may be configured to allow the passive transmission of air into and out of the interior void 412 of the insulating container 400 to regulate and potentially equalize the internal pressure of the insulating container 400 with the atmospheric pressure. In one example, the umbrella valve 500 is an elastomeric valve with a diaphragm-shaped sealing disk 506 that creates a seal over the umbrella valve vents 411. When the pressure within the interior void 412 reaches a predetermined level, the proper force is reached to lift the convex diaphragm 506 from the umbrella valve vents 411 to allow flow of air in a one-way direction (i.e., out of the interior void 412). The diaphragm 506 is further configured to prevent the back flow immediately in the opposite direction of air. The pressure regulation device thus reduces the pressure within the insulating container, for example, when the atmospheric pressure is reduced (e.g., climbing a mountain or driving up a hill). In still other examples, the pressure regulation device 410 may also include a duckbill valve 504. The duckbill valve 504 includes a channel 502 configured to allow the passage of air from the exterior of the insulating container 400 into the interior void 412 when the internal pressure of the interior void 412 is less than the atmospheric pressure. In another example, the duckbill valve 504 may be a one-piece, elastomeric component that includes a channel 502. The valve 504 may include elastomeric lips 508 substantially shaped like a duckbill configured to prevent the backflow of fluid out of the interior void 412 and configured to allow the flow of air into the interior void 412 when the atmospheric pressure is greater than the internal pressure of the insulating container 400 (e.g., descending from a mountain or driving down a hill).

FIGS. 10A-23 illustrate another example insulating container 600 according to one or more aspects described herein. For the embodiment of FIGS. 10A-23, the features are referred to using similar reference numerals under the "6xx" series of reference numerals, rather than "1xx" as used in the embodiment of FIG. 1A/1B/1C, "2xx" as used in the embodiment of FIGS. 3A/3B/3C, or "4xx" as used in the embodiment of FIGS. 7A/7B. A "6xx" feature may be similar to a "1xx," "2xx," or "4xx" feature. Accordingly, certain features of the insulating container 600 that were already described above with respect to the insulating container 100, 200, or 400 of FIGS. 1A/1B/1C, 3A/3B/3C, and 7A/7B may be described in lesser detail, or may not be described at all. Additionally, any features described above with respect to the insulating container 100, 200, and 400 in FIGS. 1A through 9B may be utilized with the insulating container 600.

Figure 10B:
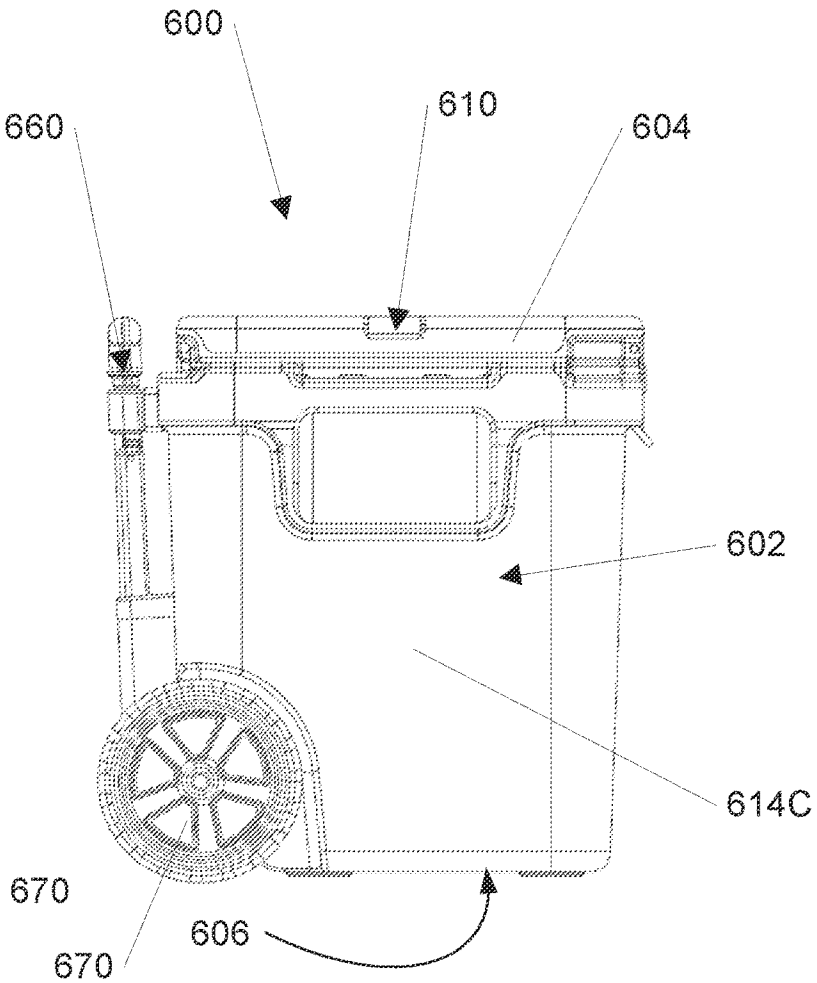
FIGS. 10A, 10B, 10C, and 10D illustrate a front view, side view, rear view, and side view of another insulating container according to one or more aspects described herein.
Figure 10A:
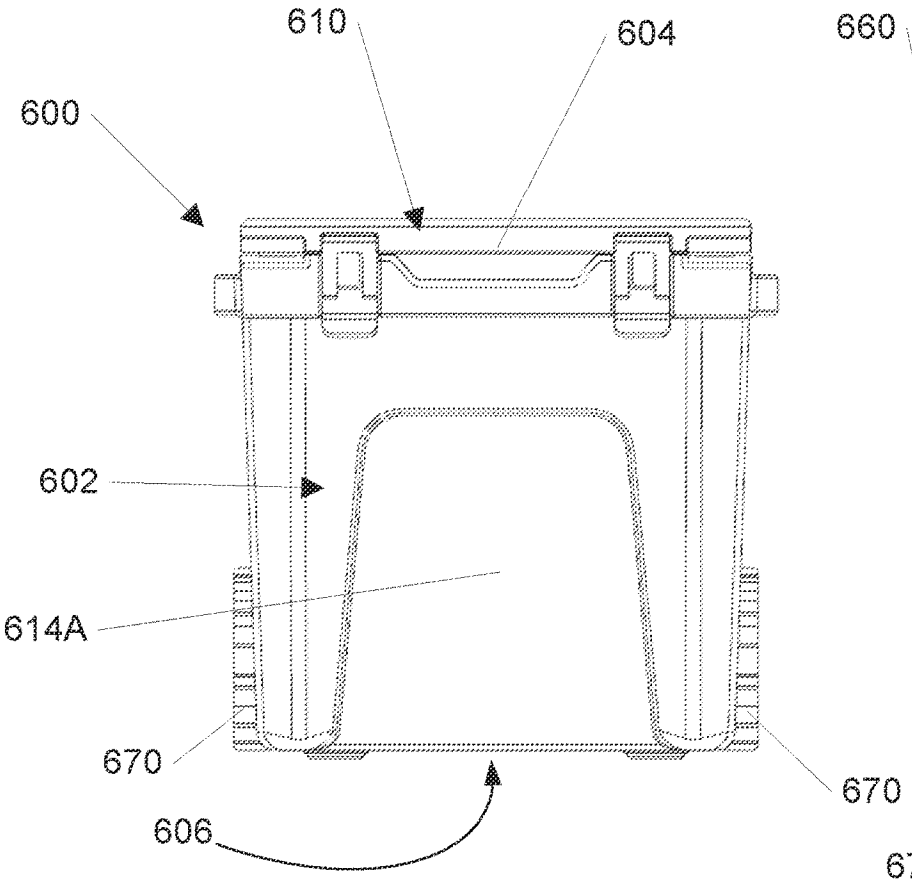
Figure 10D:
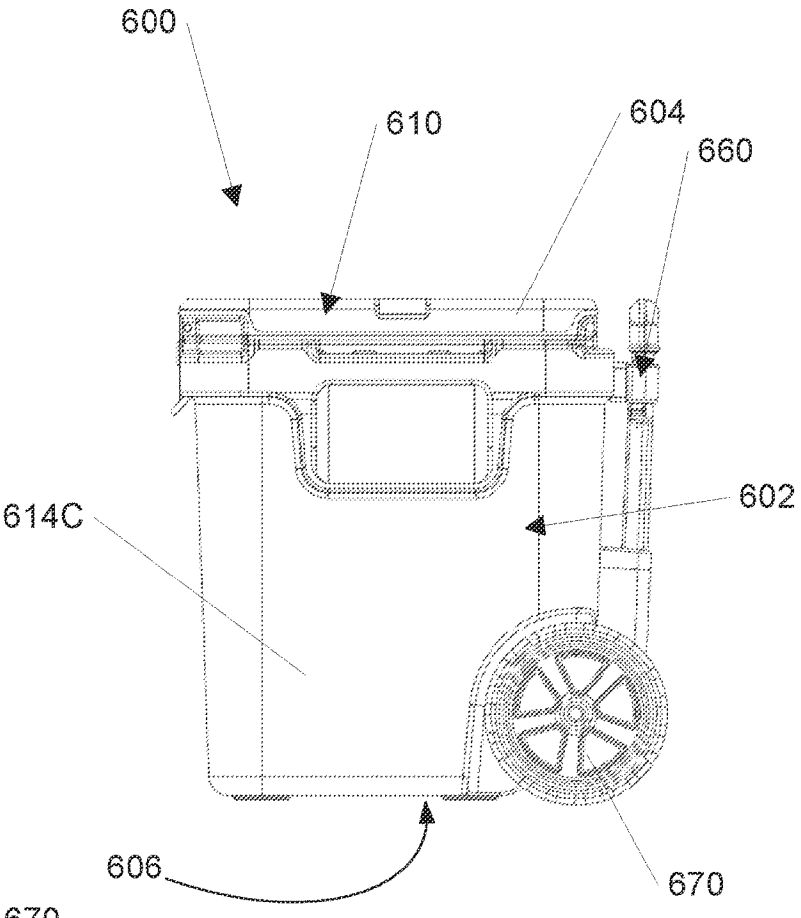
Figure 10C:
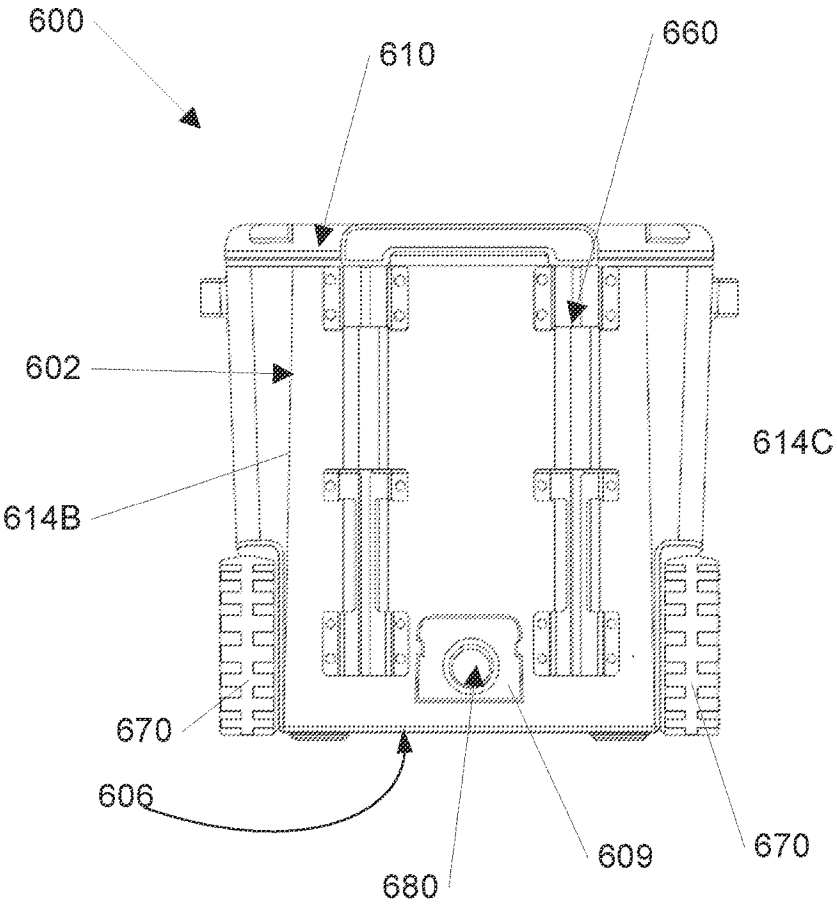
Figure 10E:
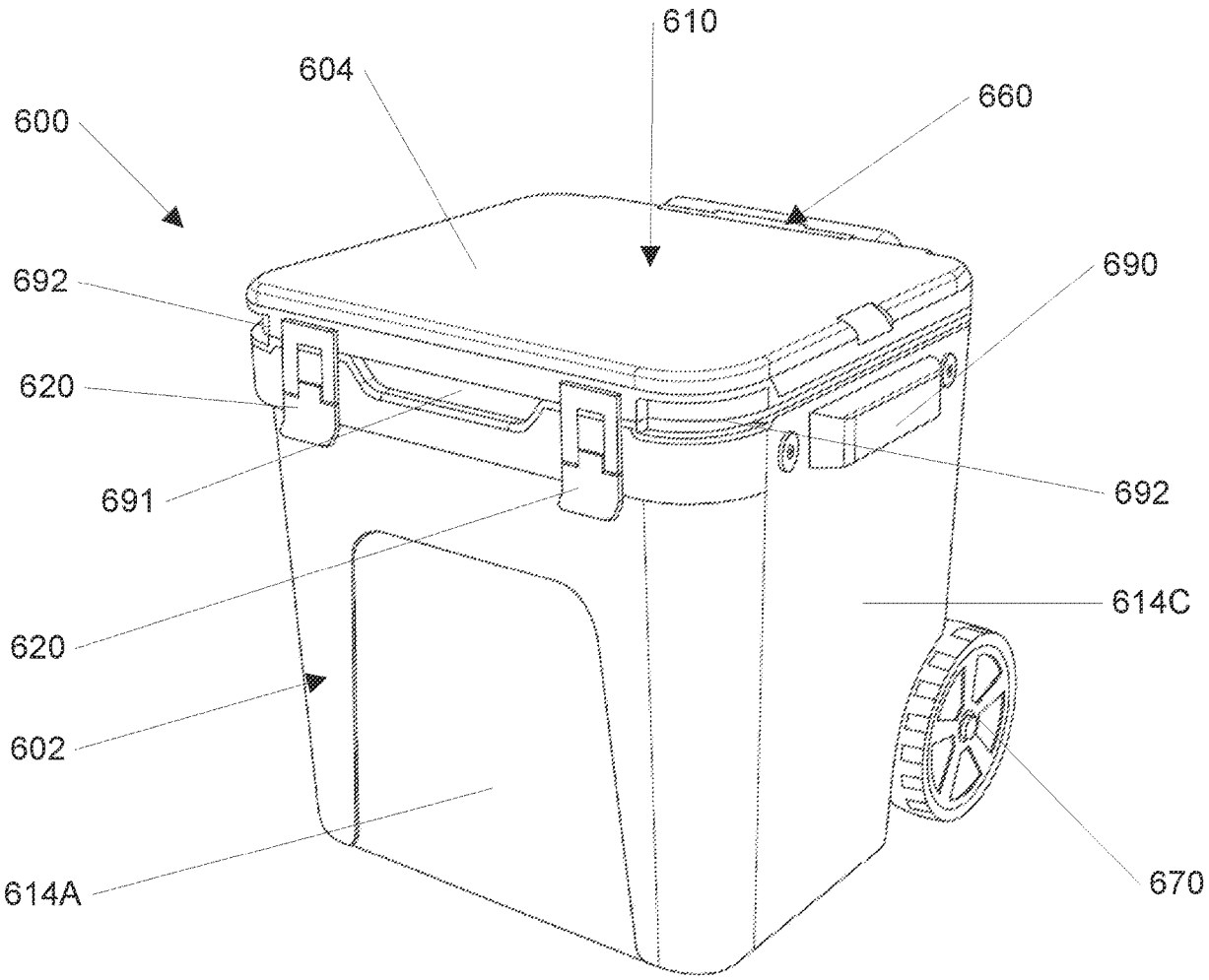
FIG. 10E illustrates a front perspective view of the insulating container shown in FIGS. 10A-10D according to one or more aspects described herein.

FIG. 10A depicts a front view of an insulating container 600. FIGS. 10B and 10D depict side views of the insulating container 600. FIG. 10C depicts a rear view of the insulating container 600. FIG. 10E illustrates a front perspective view of the insulating container 600.

In one example, the insulating container 600 may comprise a base portion 602 and a lid 604 that, in some examples, may be non-destructively, removably coupled thereto. The base portion 602 may be an insulated structure forming an interior void for containing contents or a liquid. In some examples, the base portion 602 may be cuboidal or substantially cuboidal in shape. In still other examples, the base portion 602 may be substantially cylindrical in shape or may have a substantially rectangular cross section. Various other shapes may be used without departing from the invention.

The base portion 602 may include a first end 606, having a bottom surface 608. The bottom surface 608 may be configured to support the insulating container on a surface, such as a table, the ground, a vehicle bed, boat deck, or the like.

Figure 11:
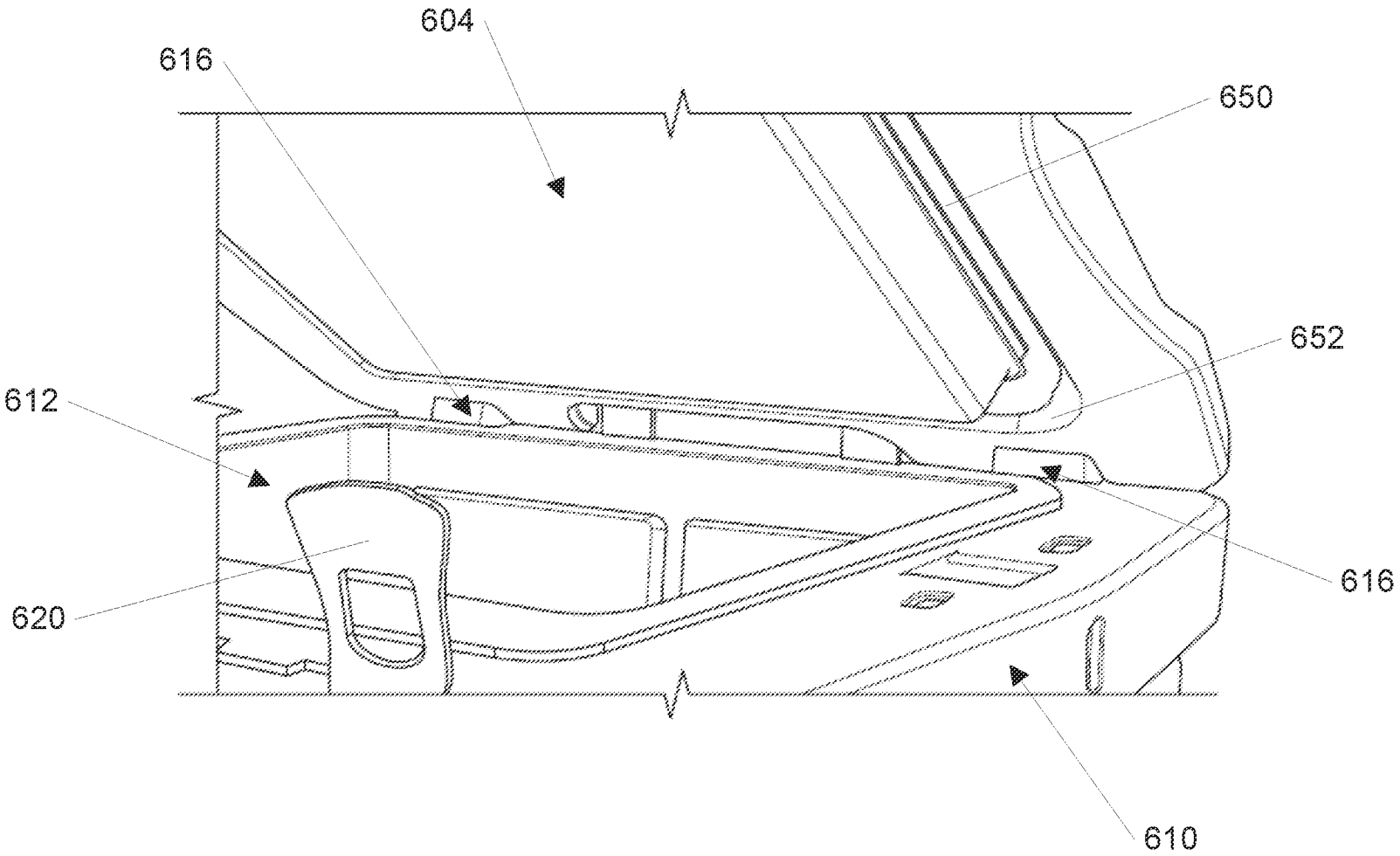
FIG. 11 illustrates a top perspective partial view of the insulating container shown in FIGS. 10A-10E with a lid open according to one or more aspects described herein.

The base portion 602 further includes a second end 610 defining an opening 612 (shown in FIG. 11) that may be used to access the interior void of the insulating container. FIG. 11 illustrates a top perspective partial view of the insulating container 600 with the lid 604 open. The opening 612 may be covered by the lid 604, when the insulating container 600 is in use (e.g., when the insulating container 600 is in a closed configuration). The base portion 602 may further include a plurality of side portions 614 connected to the bottom surface 608 that define a void for receiving contents in the insulating container 600. The side portions 614 may be arranged such that they extend generally perpendicularly from the bottom surface 608. The plurality of side portions 614 may include a front side portion 614A, a rear side portion 614B opposite the front side portion 614A, and two lateral side portions 614C between the front side portion 614A and the rear side portion 614B.

In some examples, one or more side pocket handles 690 may be arranged in one or more side portions 614 (or other region of the base portion 602). The side pocket handles 690 may be integrally molded with the base portion 602 and may generally be an undercut or cutout formed in the side portion 614 of the base 602. In some examples, such as shown in FIGS. 10B and 10D) the undercut or cutout forming the side pocket handle 690 may include a recess extending along substantially all or a majority of a length of the side portion 614. This may provide ease of manufacturing the base 602 with the integrally molded handles 690. In some examples, the side pocket handles 690 may be flush with an exterior surface of the base 602 in order to reduce the risk of breakage.

As discussed above, the insulating container 600 may be configured to contain, store, carry, etc., a volume of contents or possibly a liquid. In some examples, the insulating container 600 may be configured to store approximately 60 liters (approximately 63.4 quarts) or 48 liters (approximately 50.7 quarts). In some examples, the insulating container 600 may be configured to store between twenty-two (22) and twenty-eight (28) quarts of contents. In some examples, the insulating container 600 may be configured to store approximately twenty-four (24) quarts of contents. In other examples, the insulating container 600 may be configured to store at least twenty-two (22) quarts of contents, or the insulating container may be configured to store at least twenty-eight (28) quarts of contents, among others. In yet other examples, the insulating container 600 may be configured to store approximately sixteen (16) quarts of contents, twenty-four (24) quarts of contents, thirty-six (36) to thirty-eight (38) quarts of contents, or forty-eight (48) to fifty-eight (58) quarts of contents. In still other examples, the insulating container 600 may be configured to store between about fourteen (14) and about forty-five twenty-eight (45) quarts of contents. Additionally or alternatively, the insulating container 600 may be configured to store materials in a solid, liquid, or a gaseous state, or combinations thereof, without departing from the scope of the disclosure described herein.

In at least some examples, the insulating container 600 (and various other containers described herein) may be sized to accommodate the volume of contents described above. For example, the insulating container 600 may be at least seventeen (17) inches tall, at least sixteen (16) inches wide, and at least fourteen (14) inches deep. Additionally or alternatively, the insulating container 600 may be configured in different sizes (i.e., height, width, and depth) without departing from the scope of the disclosure described herein.

As previously discussed, the insulating container 600 includes a lid 604. In some examples, the lid 604 may connect to the base 602 in a closed configuration using a press fit. Additionally or alternatively, other securing systems or devices may be used to secure the lid 604 to the base. Insulating container 600 may include latching devices 620 and keepers of the base 602 on the front of the container, as shown in FIGS. 10A and 10E, to secure the lid 604 in the closed position. In some examples, the lid 604 may be configured to remain secured or locked in a closed position using latching devices 620. The latching devices 620 may be various types of latches, including a latch having a latch portion and a keeper portion on the base 602, as well as various other types of latches. The insulating container 600 may include any of the latching devices and keepers as described above and specifically illustrated in FIGS. 1A, 1B, 3A, 4A, 5A, 5C, 6A, 6B, and 6C.

In other configurations as illustrated in FIG. 10E, the insulating container 600 may include a lid 604 and base 602 that form at least one corner lift ledge 692 to facilitate easy gripping of the lid for opening. In other examples, the insulating container 600 may include a plurality of corner lift ledges 692. In certain examples, the lift ledge 692 may be formed by an integrally molded portion of the corner of the lid 604, and an integrally molded portion of the front corner at the top of the base 602. In still other configurations, the insulating container 600 may include front lift ledge 691 integrally molded in the base 602. The front lift ledge 691 may integrally molded at the top of the base 602. The lift ledge 691 may be configured to provide the insulating container 600 an easily accessible region to allow an individual to grasp the lid 604 for ease of opening (i.e., one handed operation).

In some examples, the lid 604 may be hinged such that it is connected to (either removably or permanently) the base 602 at a hinge 616 and may be rotated about the hinge 616. The hinge may be one of various types of hinges, including a continuous piano hinge, double hinge, ball joint hinge, living hinge, and the like. The hinge 616 may permit the lid 604 to be opened and rotated away from the base portion 602, to allow access to the internal void defined by the base portion 602 (e.g., via opening 612). That is, the hinge 616 may facilitate rotation of the lid 604 from a closed configuration of the insulating container 600 (e.g., when the lid 604 is in place covering the internal void formed by the base 602) to an open configuration (e.g., when the lid 604 is not covering the internal void formed by the base 602), and vice versa. In some examples, the insulating container 600 is configured with at least one hinge 616. In another example, the insulating container is configured with a plurality of hinges 616. In still other configurations, hinge 616 comprises a first portion integrally molded in the lid 604 and a second portion integrally molded in the base 602.

In the examples described herein, base 602 and lid 604 may include an exterior surface or outer shell surrounding and enclosing an insulating portion, as shown and described in FIGS. 1C and 5A. The shell is typically formed from various materials, such as one or more metals, alloys, polymers, ceramics, or fiber-reinforced materials. In some examples, the shell may be formed of a plastic material, such as thermoplastic olefin elastomers (TPO), polypropylene with rubberizing agent, or polyethylene, that is molded to form both the base 602 and lid 604 portions. Thermoplastic olefinic elastomers (TPOs) consist of polypropylene, polyethylene or other polyolefin as hard segments and rubber component such as ethylene propylene rubber (ethylene propylene (EPM) or ethylene propylene diene monomer (EPDM)) as soft segments. In some examples, the insulating portion is formed of an insulating material that exhibits low thermal conductivity. For instance, the insulating portion may be formed of (or filled with) a polymer foam, such as polyurethane foam. Additional or other insulating materials may be used without departing from the invention. In some examples, the base 602 and lid 604 portions are formed using an injection molding process as would be understood by one of ordinary skill in the art (not shown). However, various other types of molding or other manufacturing processes (e.g., roto-molding, stamping, casting, forging, and the like) may be used to form the insulating container without departing from the invention.

Figure 19:
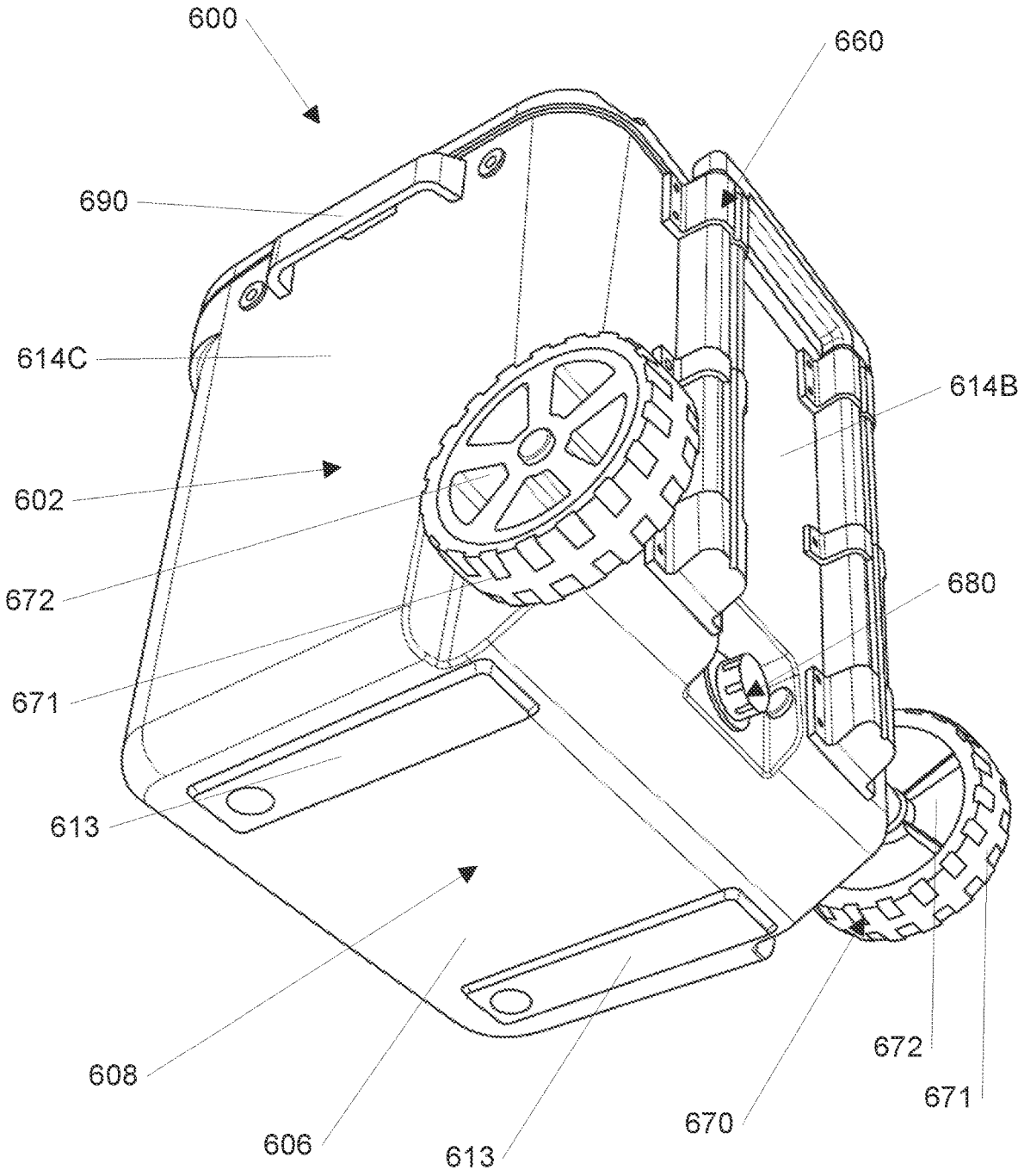
FIG. 19 illustrates a bottom perspective view of the insulating container shown in FIGS. 10A-10E showing a wheel assembly according to one or more aspects described herein.

The base portion 602 may include a first end 606, having a bottom surface 608. The bottom surface 608 may be configured to support the insulating container 600 on a surface, such as a table, the ground, a vehicle bed, boat deck, or the like and may include a plurality of feet, as described above and shown in FIG. 4B. In another example embodiment, the bottom surface 608 of the insulating container 600 may include one or more lateral feet 613, as illustrated in FIG. 19. The lateral feet 613 or feet may be configured to provide a non-skid or no-slip surface, and may be configured to keep the insulating container 600 elevated off the ground. In another example, the lateral feet 613 or feet may be configured to reduce friction with the ground or surface so that the insulating container may be moved more easily while the container is on the ground (i.e., the insulating container may easily slide or be easily pushed across the ground). The lateral feet 613 may be separated and parallel, thereby creating and providing an air gap between the bottom surface 608 of the insulating container and the ground. The lateral feet 613 or feet may be constructed of rubber, foam, plastic, or other suitable material. In another embodiment, the lateral feet 613 may be molded into the base 602 with an alternative finish or texture in the mold for the lateral feet 613. In still other embodiments, the bottom surface 608 may include a logo or name of a company or manufacturer of the insulating container embossed, integrally molded, or pressed into the exterior shell.

Figure 15:
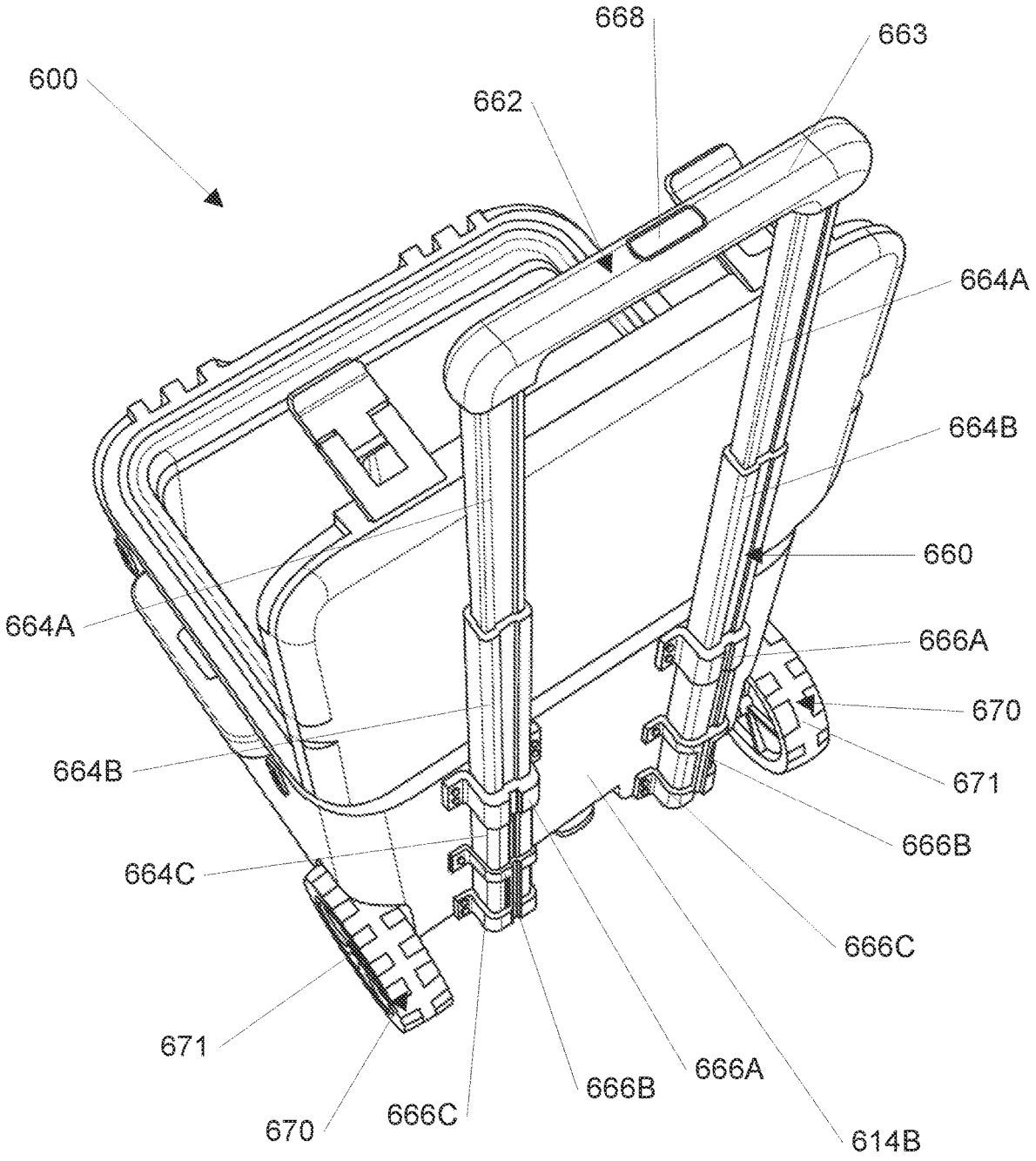
FIG. 15 illustrates a top rear perspective view of the insulating container shown in FIGS. 10A-10E with the lid open and the pull handle assembly in the extended configuration according to one or more aspects described herein.
Figure 16A:
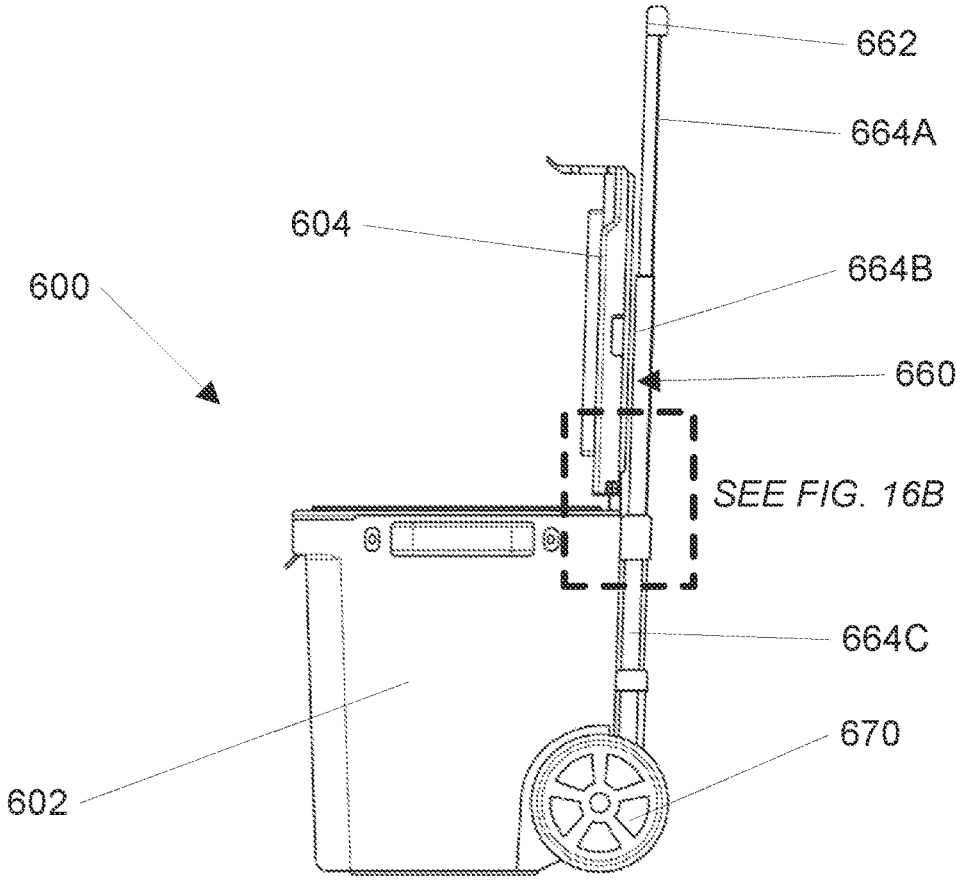
FIG. 16A illustrates a side view of the insulating container shown in FIG. 15 with the lid open and the pull handle assembly in the extended configuration according to one or more aspects described herein.

FIGS. 11, 15, and 16A illustrate the lid 604 of the insulating container 600 in a substantially open position. As shown in FIGS. 10A-10E, the lid 604 is in a substantially closed configuration. That is, the lid 604 is substantially perpendicular to the base 602 and is covering the opening. In order to open the lid 604, and thereby access the internal void defined by the base 602 of the insulating container 600, the lid 604 may be lifted upward. When the lid 604 is configured in the closed and secured position, the lid 604 seals the opening 612.

In addition, in some examples, as illustrated in FIG. 11, the insulating container 600 may include a gasket 650 or other sealing device. The gasket 650 may be arranged in either the lid 604 or the base 602 and may aid in sealing the lid 604 and the base 602 when the lid 604 is in a closed and secured configuration. In other examples, the gasket 650 may be arranged in either the lid 604 or the base 602 and may provide a watertight or near-watertight seal when the lid 604 is in a closed and secured configuration. In some examples, the gasket 650 may be seated in a recess formed in at least one of the base 602 and the lid 604 and extending around a perimeter of the at least one of the base 602 or the lid 604. In other examples, as shown in FIG. 11, the gasket 650 may be seated in a gasket adapter 652 formed in at least one of the base 602 or the lid 604 and extending around a perimeter of the at least one of the base 602 or the lid 604. In other examples, the gasket 650 may be constructed of rubber (such as neoprene or EPDM), silicone, or other suitable material. The gasket 650 may aid in maintaining the temperature of the contents or liquid contained within the insulating container 600. Various other gasket examples may be used with any of the insulating containers described herein.

In some examples, the gasket 650 may include strategically placed cut-outs that may reduce or eliminate a need for a vent (e.g., a vent to prevent lid lock), as will be discussed more fully below. The gasket 650 could include cut outs, or the lid 604 or the base 602 could include a change in geometry to allow reduced or eliminated compression in the gasket 650. A change in base 602 or lid 604 geometry may reduce compression in the gasket 650 and allow venting when the internal pressure of the insulating container 600 reaches a certain pressure. In some examples, the gasket 650 may be a traditional gasket having a substantially circular cross section. In other examples, the gasket 650 may have a particular cross section configured to aid in venting the insulating container. In some examples, the cross section is a V-shaped or substantially V-shaped portion of the gasket 650. In yet other examples, the gasket 650 may also include at least one weep hole to allow passive venting of air or fluids in and out of the interior void when the insulating container 600 is in a closed and secured configuration to prevent lid lock. In other examples, the gasket 650 may include a plurality of weep holes. In still other examples, the gasket 650 is configured to provide a watertight seal when the lid 604 is in a closed and secured configuration.

Figures 12A, 12B, 12C:
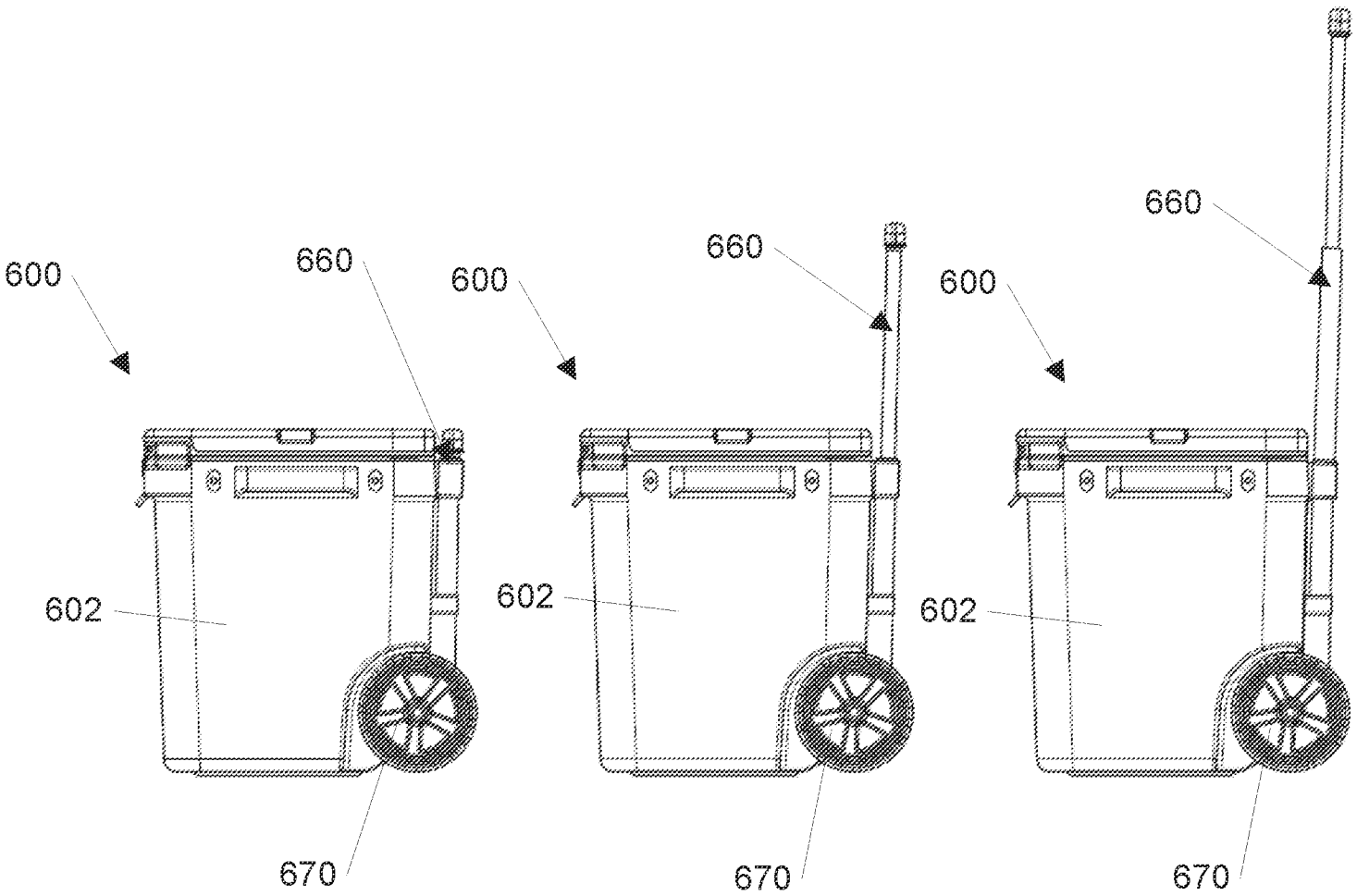
FIGS. 12A-12C illustrates a side view of the insulating container shown in FIGS. 10A-10E showing a pull handle assembly in various stowed and extended configurations according to one or more aspects described herein.
Figure 13:
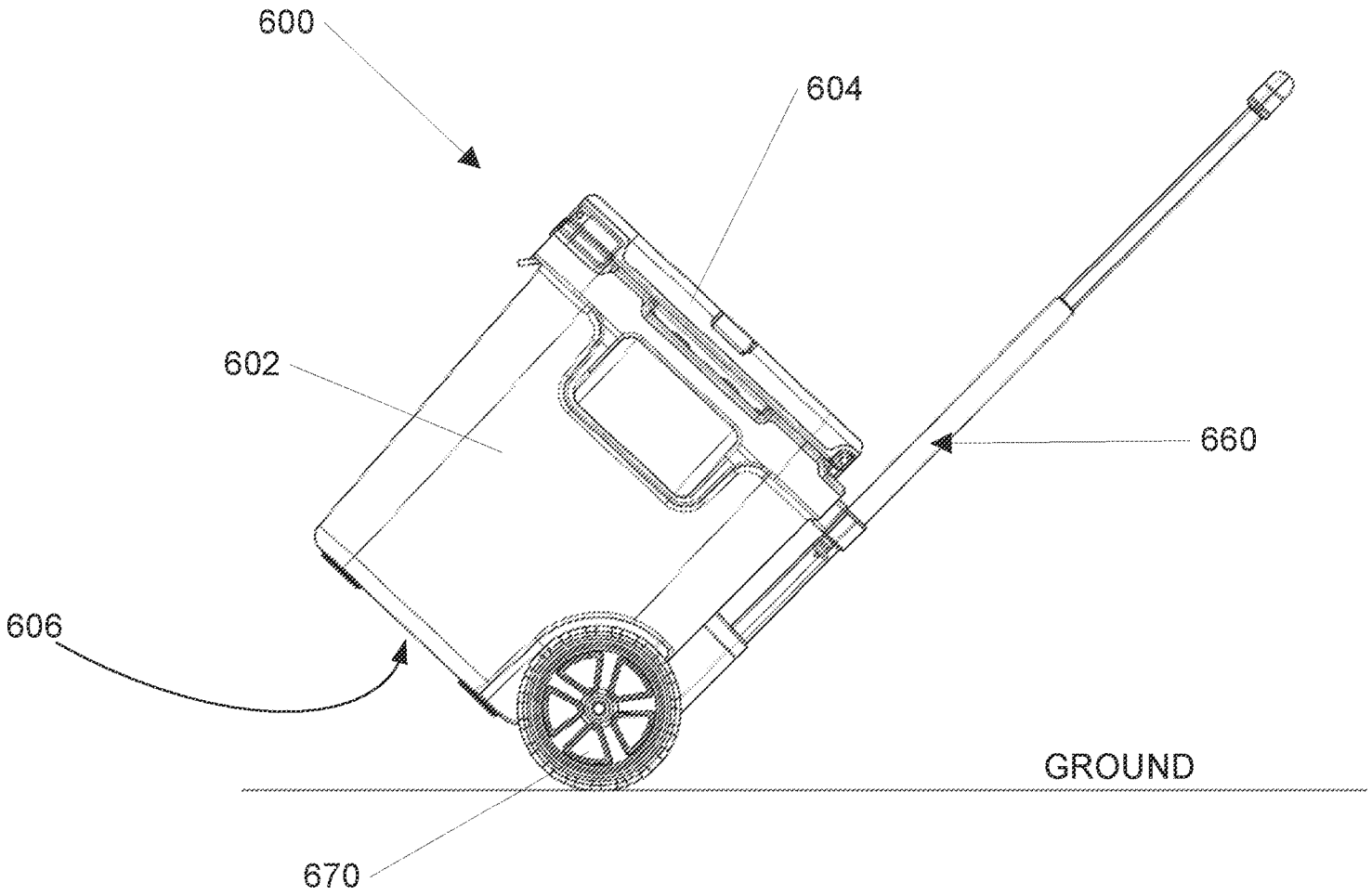
FIG. 13 illustrates a side view of the insulating container shown in FIGS. 10A-10E in a tilted configuration according to one or more aspects described herein.
Figure 14:
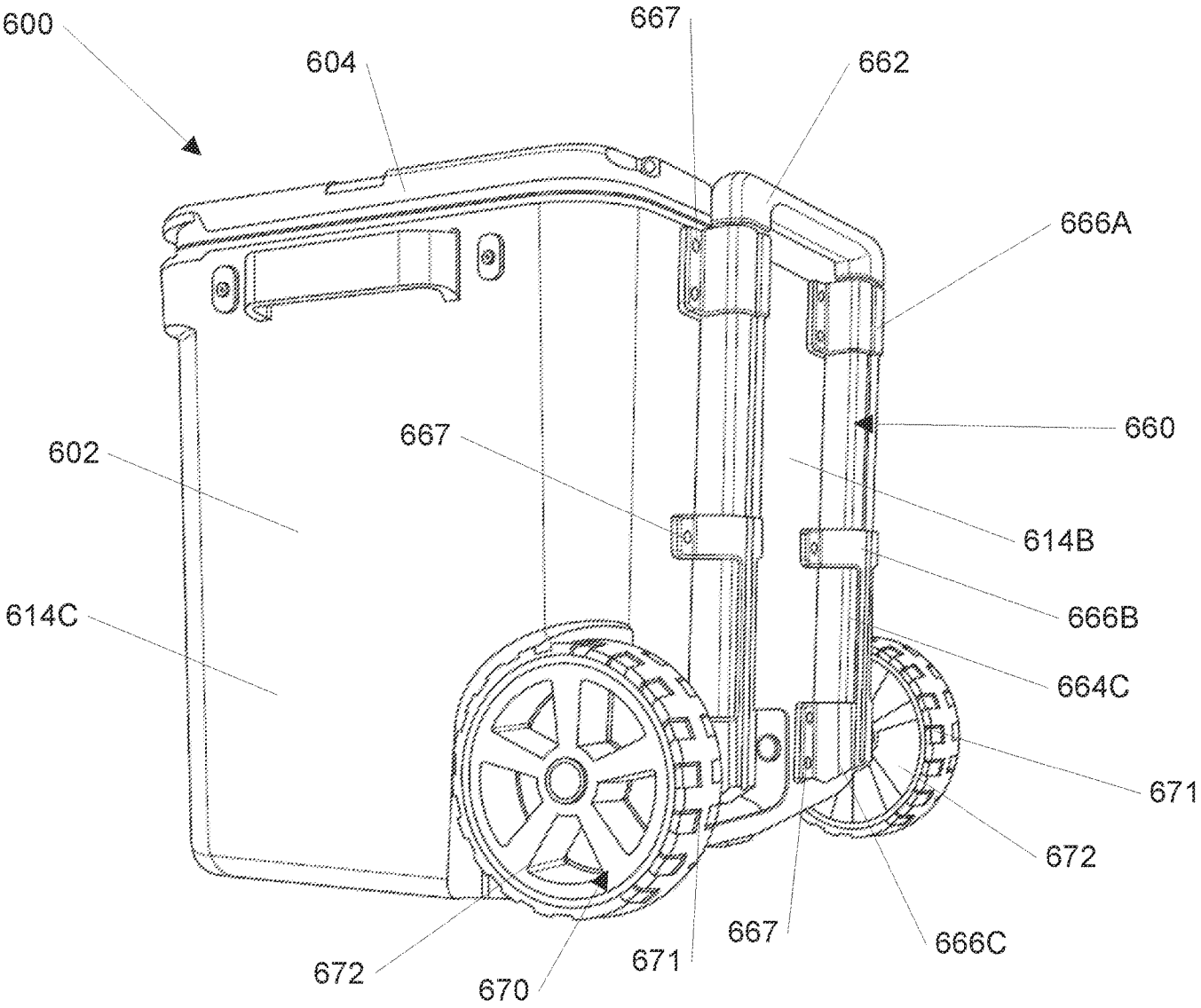
FIG. 14 illustrates a rear side perspective view of the insulating container shown in FIGS. 10A-10E that shows the pull handle assembly in the stowed configuration according to one or more aspects described herein.
Figure 16B:
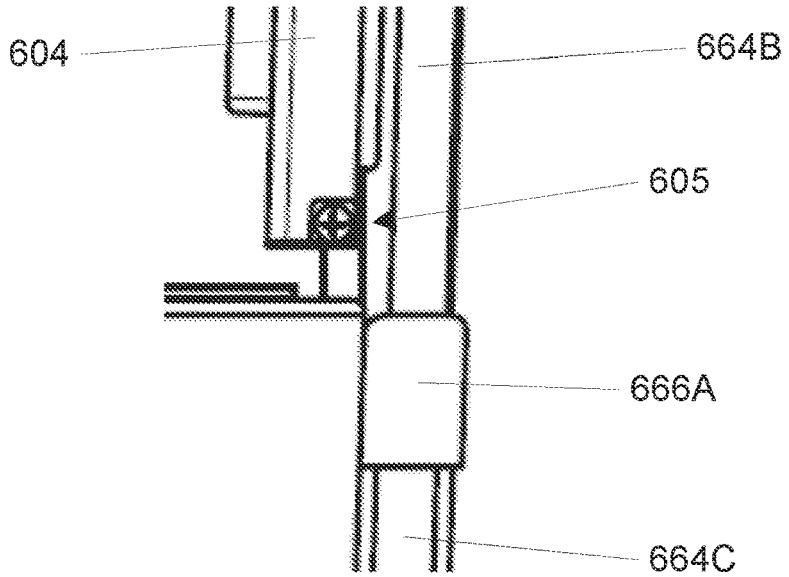
FIG. 16B illustrates a close-up side view of the pull handle assembly area and lid area from FIG. 16A according to one or more aspects described herein.
Figure 17A:
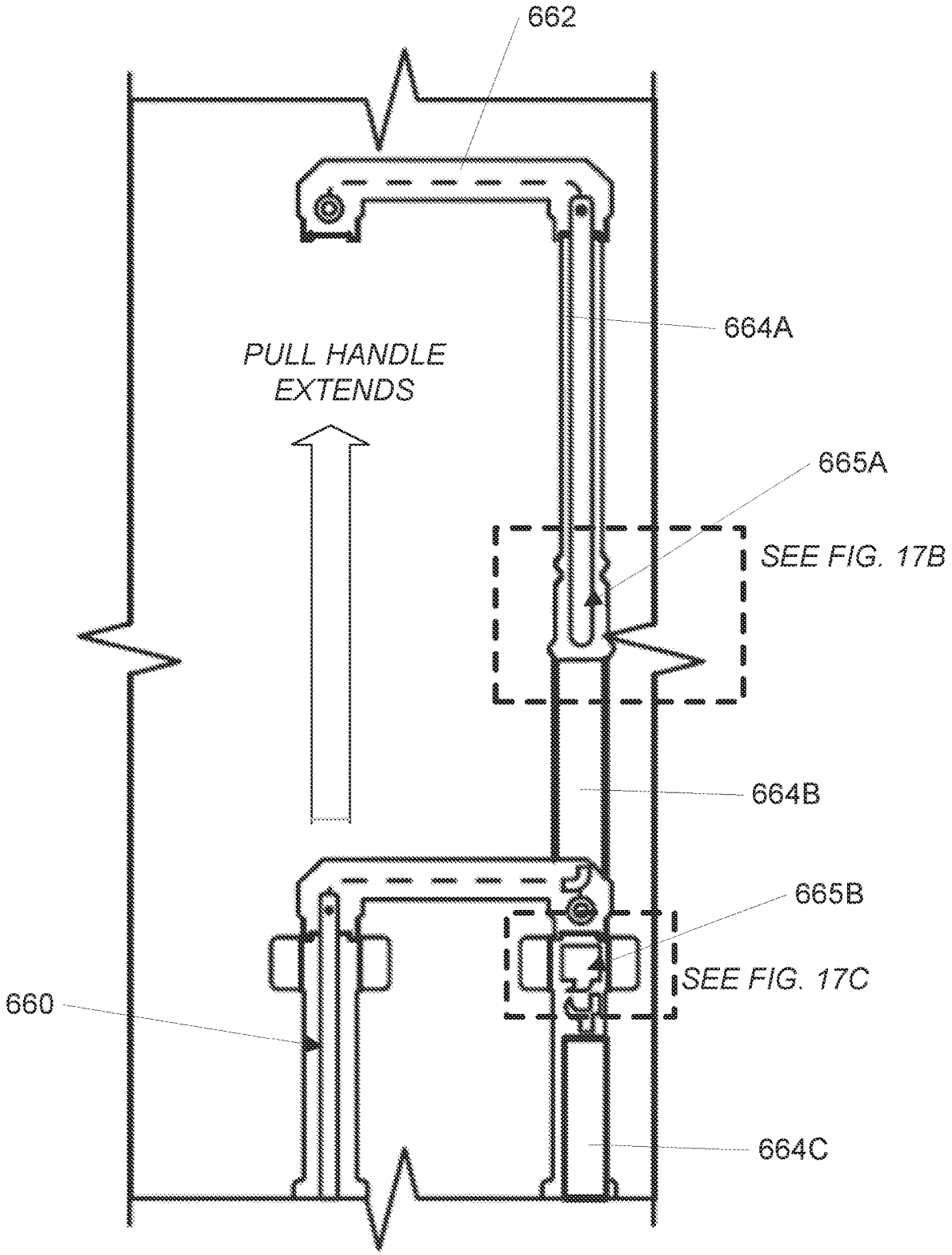
FIG. 17A illustrates a side view of the pull handle assembly in both the stowed position and the extended position according to one or more aspects described herein.
Figure 17B:
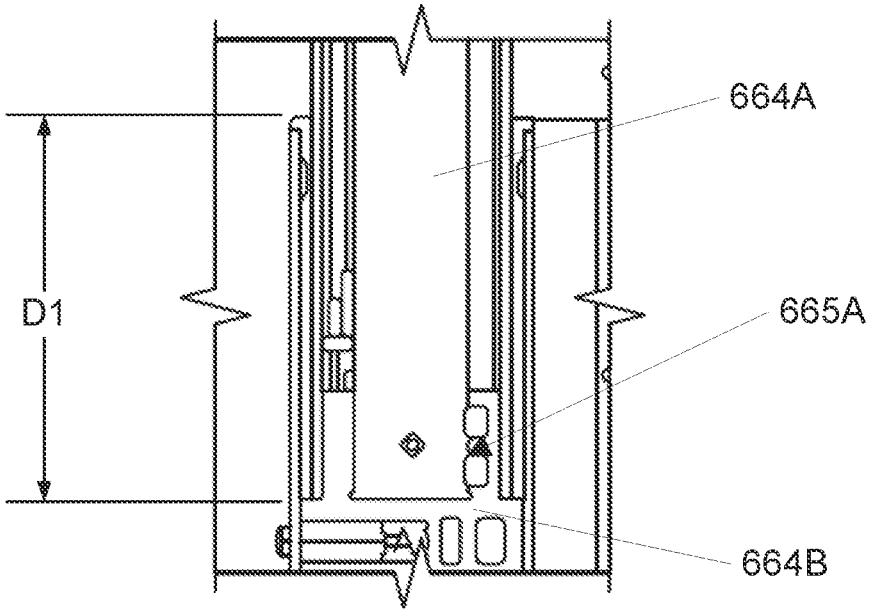
FIGS. 17B and 17C illustrate close-up side views of the pull handle assembly areas from FIG. 17A according to one or more aspects described herein.
Figure 17C:
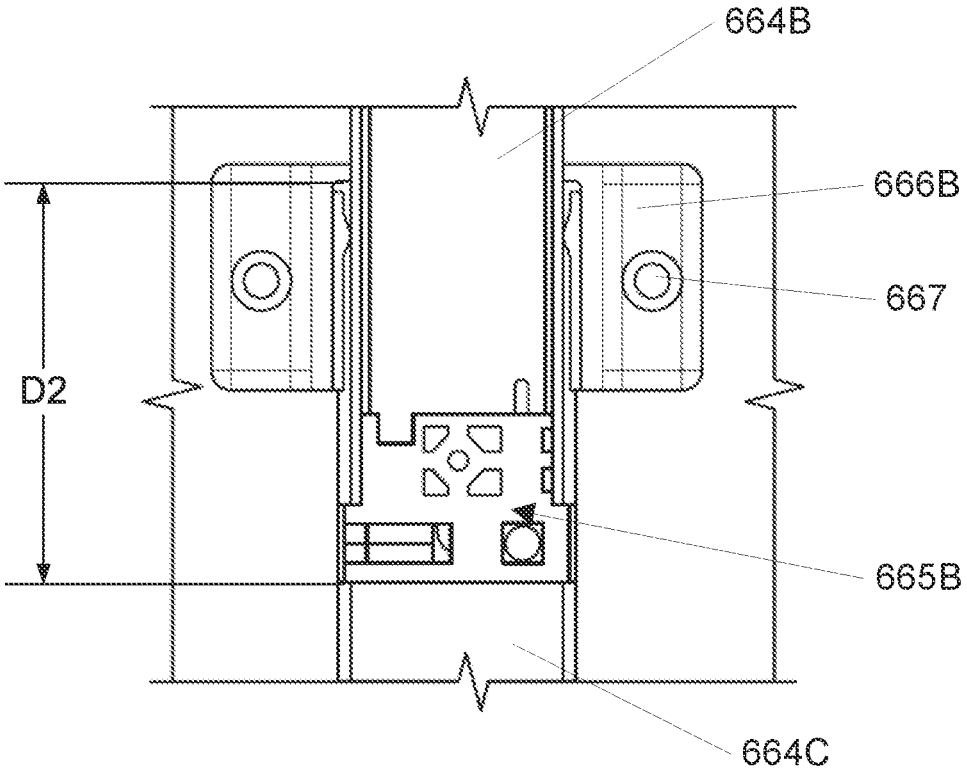
Figure 18:
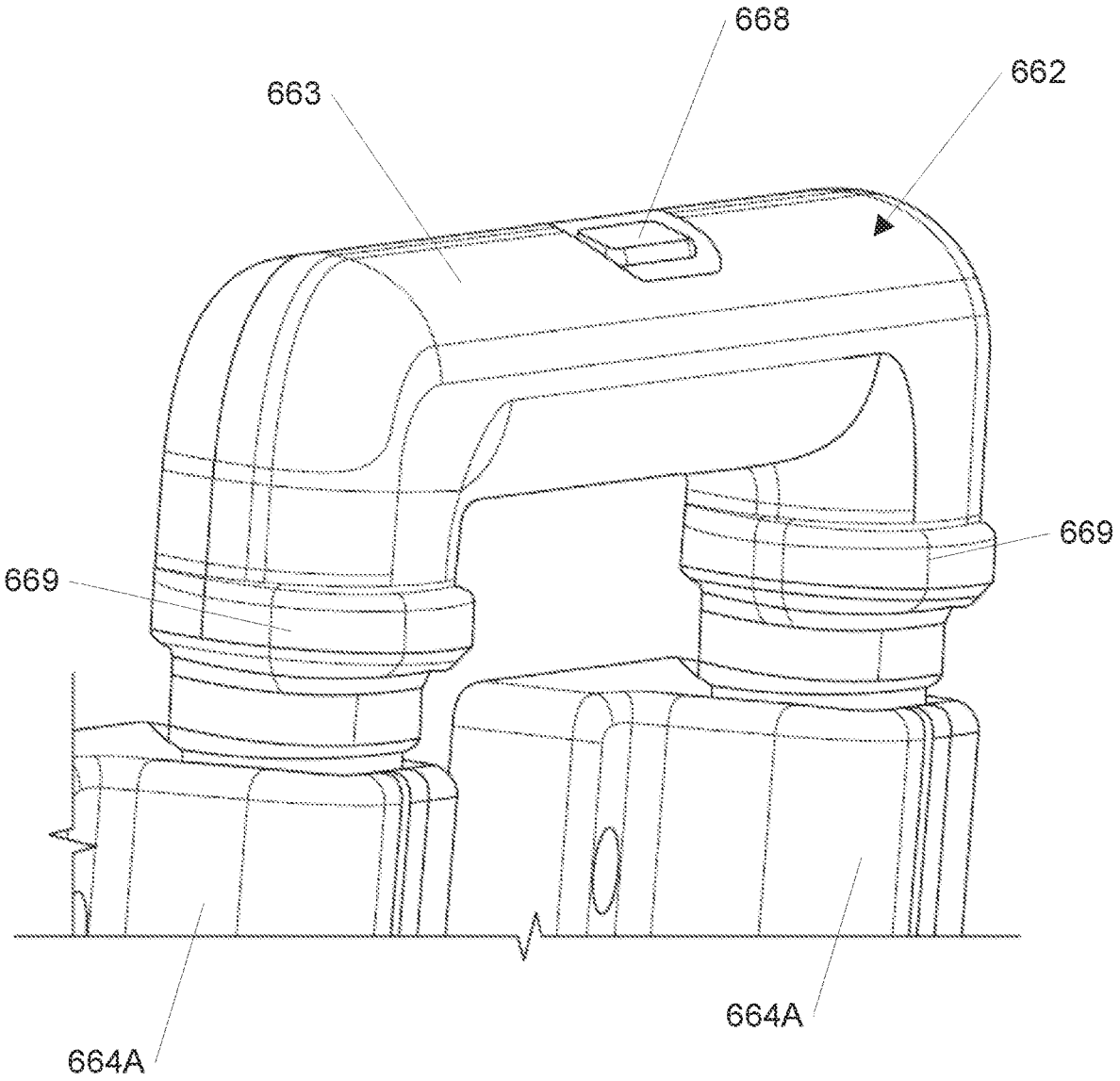
FIG. 18 illustrates a close-up perspective view of a handle bumper area of the pull handle assembly according to one or more aspects described herein.

In other examples, the insulating container 600 may include a pull handle assembly 660, as specifically illustrated in FIGS. 12A-18. FIGS. 12A-12C illustrates a side view of the insulating container 600 showing the pull handle assembly 660 in various stowed and extended configurations. FIG. 13 illustrates a side view of the insulating container 600 in a tilted configuration and the pull handle assembly 660 in the extended configuration. FIG. 14 illustrates a rear side perspective view of the insulating container 600 with the pull handle assembly 660 in the stowed configuration. FIG. 15 illustrates a top rear perspective view of the insulating container 600 with the lid 604 open and the pull handle assembly 660 in the extended configuration. FIG. 16A illustrates a side view of the insulating container 600 with the lid 604 open and the pull handle assembly 660 in the extended configuration. FIG. 16B illustrates a close-up side view of the pull handle assembly area and lid area from FIG. 16A. FIG. 17A illustrates a side view of the pull handle assembly 660 in both the stowed position and the extended position. FIGS. 17B and 17C illustrate close-up side views of the pull handle assembly areas from FIG. 17A. Lastly, FIG. 18 illustrates a close-up perspective view of a handle bumper area of the pull handle assembly 660.

FIGS. 12A-18 illustrate a pull handle assembly 660 that enables a user to ergonomically maneuver the insulating container 600. The pull handle assembly 660 may assist when the insulating container 600 is tilted into a rolling position with the end opposite the wheels 672 off the container's resting surface. FIGS. 12A-12C illustrate the pull handle assembly 660 as it transitions from a stowed configuration shown in FIG. 12A to an extended position in FIG. 12C. As illustrated in FIGS. 12A-12C, the pull handle assembly 660 may be a telescopic handle design with a 3-stage handle/arm configuration. FIG. 12A illustrates the pull handle assembly 660 in the first stage, with the pull handle assembly 660 in the stowed (or retracted or nested) configuration. FIG. 12B illustrates the pull handle assembly 660 in the second stage, with the pull handle assembly 660 in the partially extended configuration. FIG. 12C illustrates the pull handle assembly 660 in the third stage, with the pull handle assembly 660 in the fully extended configuration. The pull handle assembly 660 may have one or more locking mechanisms 665A, 665B for the stowed configuration, the partially extended configuration, and/or the fully extended configuration.

The pull handle assembly 660 may be connected to the side portions 614 of the base 602, and specifically the rear side portion 614B of the base 602. The pull handle assembly 660 may be arranged on the same rear side portion 614B that includes the wheel assembly 670. With the pull handle assembly 660 in the extended configuration, a user may grasp a pull handle 662 to tilt and raise the front side portion 614A upward, which shifts the weight of the insulating container 600 onto the wheels 672 and allows the user to pull the insulating container 600. The pull handle assembly 660 may have an extended configuration that enables a user to pull the container 600. FIG. 13 illustrates the insulating container 600 tilted with the pull handle assembly 660 fully extended. The pull handle assembly 660 may have a stowed configuration where the pull handle assembly 660 may be flush with the top of the insulating container 600. When the pull handle assembly 660 is in the stowed configuration, an upper surface 663 of the pull handle 662 may be substantially parallel an upper surface of the lid 604.

The pull handle assembly 660 may be attached to the rear side portion 614B. The pull handle assembly 660 may include one or more brackets 666A, 666B, 666C that attach the pull handle assembly 660 to the rear side portion 614B. The pull handle assembly 660 may include one or more brackets to attach the pull handle assembly to the rear side portion 614B, such as one bracket, two brackets, three brackets, or four or more brackets. The one or more brackets may include a first bracket 666A (or upper bracket) attached to a top portion of the pull handle assembly 660, a second bracket 666B (or middle bracket) attached to a middle portion of the pull handle assembly 660, and a third bracket 666C (or lower bracket) attached to a lower portion of the pull handle assembly 660. As shown in FIGS. 14 and 15, the first bracket 666A, the second bracket 666B, and the third bracket 666C may all connect to the lower arm 664C and specifically attach the lower arm 664C and the pull handle assembly 660 to the rear side portion 614B. The brackets 666 may be installed to mounting points on the rear side portion 614B of the base 602 before the insulating portion (foam) is filled into the base 602.

Additionally, the brackets 666A, 666B, 666C may be U-shaped brackets that fit around the exterior of a lower arm 664C of the pull handle assembly 660 to hold the lower arm 664C and pull handle assembly 660 against the rear side portion 614B of the insulating container 600. The brackets 666A, 666B, 666C may be various other shapes without departing from embodiments of the invention. Additionally, the brackets 666A, 666B, 666C may be various widths. In the exemplary embodiment illustrated in FIGS. 14 and 15, the first bracket 666A and the third bracket 666C may include a first width. The second bracket 666B may include a second width smaller than the first width. The brackets 666A, 666B, 666C may include one or more fasteners 667 on each side of the brackets 666A, 666B, 666C connecting the brackets 666A, 666B, 666C to the rear side portion 614B of the insulating container 600. In an exemplary embodiment, the first bracket 666A and the third bracket 666C may include two fasteners 667 on each side of the brackets 666A, 666C connecting the brackets 666A, 666C to the rear side portion 614B of the insulating container 600. The second bracket 666B may include one fastener 667 on each side of the second bracket 666B connecting the second bracket 666B to the rear side portion 614B of the insulating container 600.

As illustrated in FIGS. 16A, 16B, 17A, 17B, and 17C, the pull handle assembly 660 may include telescoping features. The pull handle assembly 660 may include an upper arm 664A, a middle arm 664B, and a lower arm 664C. The upper arm 664A may be nested and slidable inside the middle arm 664B. Additionally, the middle arm 664B may be nested and slidable inside the lower arm 664C. This nesting and sliding of the upper arm 664A, middle arm 664B, and lower arm 664C may create the telescoping feature of the pull handle assembly 660.

FIGS. 16A and 16B illustrate the pull handle assembly 660 in the extended configuration with the lid 604 open. The lid 604 may be a low-profile lid, such that it allows the lid 604 to be fully open with the pull handle assembly 660 in the fully extended configuration. In another embodiment, the lid 604 may include a low-profile seat cushion, such that it allows the lid 604 with seat cushion to be fully open with the pull handle assembly 660 in the fully extended configuration.

As further illustrated in FIGS. 16A and 16B, the lid 604 may include a step portion 605 located at the back of the lid 604. The step portion 605 may be inset from the top-most surface of the lid 604 closest to the rear portion 614B. In one embodiment, the step portion 605 may be inset approximately ½ inch from the top-most surface of the lid 604. In other embodiments, the step portion 605 may be inset ¼ inch, ¾ inch, 1 inch, 1½ inches from the top-most surface of the lid 604, or other dimensions without departing from this invention. The step portion 605 may help to eliminate a pinch risk between the middle arm 664B and the lid 604. The step portion 605 may include various shapes and sizes without departing from this invention.

FIGS. 17A, 17B, and 17C specifically illustrate the internal components of the pull handle assembly 660. FIG. 17A specifically shows the pull handle assembly 660 in both the partial extended configuration and the fully extended configuration. The pull handle assembly 660 may include one or more locking mechanisms, an upper locking mechanism 665A and a lower locking mechanism 665B. The locking mechanisms 665A, 665B may be installed between the arms 664A, 664B, 664C for latching and locking the pull handle assembly 660 in the stowed configuration and/or the fully extended configuration. Specifically, the upper locking mechanism 665A may be installed between the upper arm 664A and the middle arm 664B. The lower locking mechanism 665B may be installed between the middle arm 664B and the lower arm 664C. A release button 668 may be connected to and act as an actuator for the locking mechanisms 665A, 665B. The locking mechanisms 665A, 665B may be released with the release button 668 on the pull handle 662. The locking mechanisms 665A, 665B may include various components known and used in the art for telescoping pull handles, such as actuators, hinges, spring-loaded bearings, bushings, locking pins, locking holes, etc.

Additionally, as illustrated in FIGS. 17B and 17C, the pull handle assembly 660 may include an extended arm overlap distance D1, D2. The extended arm overlap distance D1, D2 may be defined as the overlap between nested arms when the arms 664A, 664B, 664C are in the extended configurations. The extended arm overlap distance D1, D2 may allow for more contact with the inner portions of the arms and bushings, thereby creating a stronger, more stable pull handle assembly 660 when in the extended configurations. The pull handle assembly 660 may include an extended upper arm overlap distance D1 that represents the distance between a bottom of the upper arm 664A and a top of the middle arm 664B when the upper arm 664A and the middle arm 664B are in a locked configuration and fully extended. The pull handle assembly 660 may also include an extended lower arm overlap distance D2 that represents the distance between a bottom of the middle arm 664B and a top of the lower arm 664C when the middle arm 664B and the lower arm 664C are in a locked configuration and fully extended. The extended arm overlap distances D1, D2 may be approximately 70 mm. The extended arm overlap distance D1, D2 may also be other distances without departing from this invention.

As illustrated in FIG. 18, the pull handle assembly 660 may include a pull handle 662. The pull handle 662 can be grasped by a user to extend the pull handle assembly 660 to the extended configuration. The user may grasp the pull handle 662 in the extended configuration to tilt and raise the front side portion 614A upward, which shifts the weight of the insulating container 600 onto the wheels 672 and allows the user to pull the insulating container 600.

The pull handle 662 may include handle bumpers 669. The handle bumpers 669 may be located on each of the pull handle arms 664 of the pull handle 662. The handle bumpers 669 may be utilized to prevent scuffing of the handle grip 663 on the pull handle 662 when/if the insulating container 600 is tipped over. The handle bumpers 669 may include a raised portion that extends circumferentially around the pull handle 662 adjacent to the upper pull handle arm 664A and/or around the upper pull handle arm 664A. The raised portion may extend partially or fully circumferentially around the pull handle 662 and/or the pull handle arms 664.

The pull handle assembly 660 components may be formed from polymeric materials, which may be a filled or unfilled polymer. For example, the polymeric materials may be a PC-ABS, polyethylene, or other similar material. In addition, pull handle assembly 660 components can be manufactured by polymer processing techniques, such as various molding and casting techniques and/or other known techniques. Alternatively or optionally, the pull handle assembly 660 may be formed of a metallic material such as an aluminum alloy, magnesium alloy, or other metallic material with a density below 3 g/cc. As another option, the insulating container 600 components such as the lid, body, lid support member and pull handle assembly may include a structural foam with a composite polymer material with a low density foamed core and a higher density polymer skin.

Figure 20A:
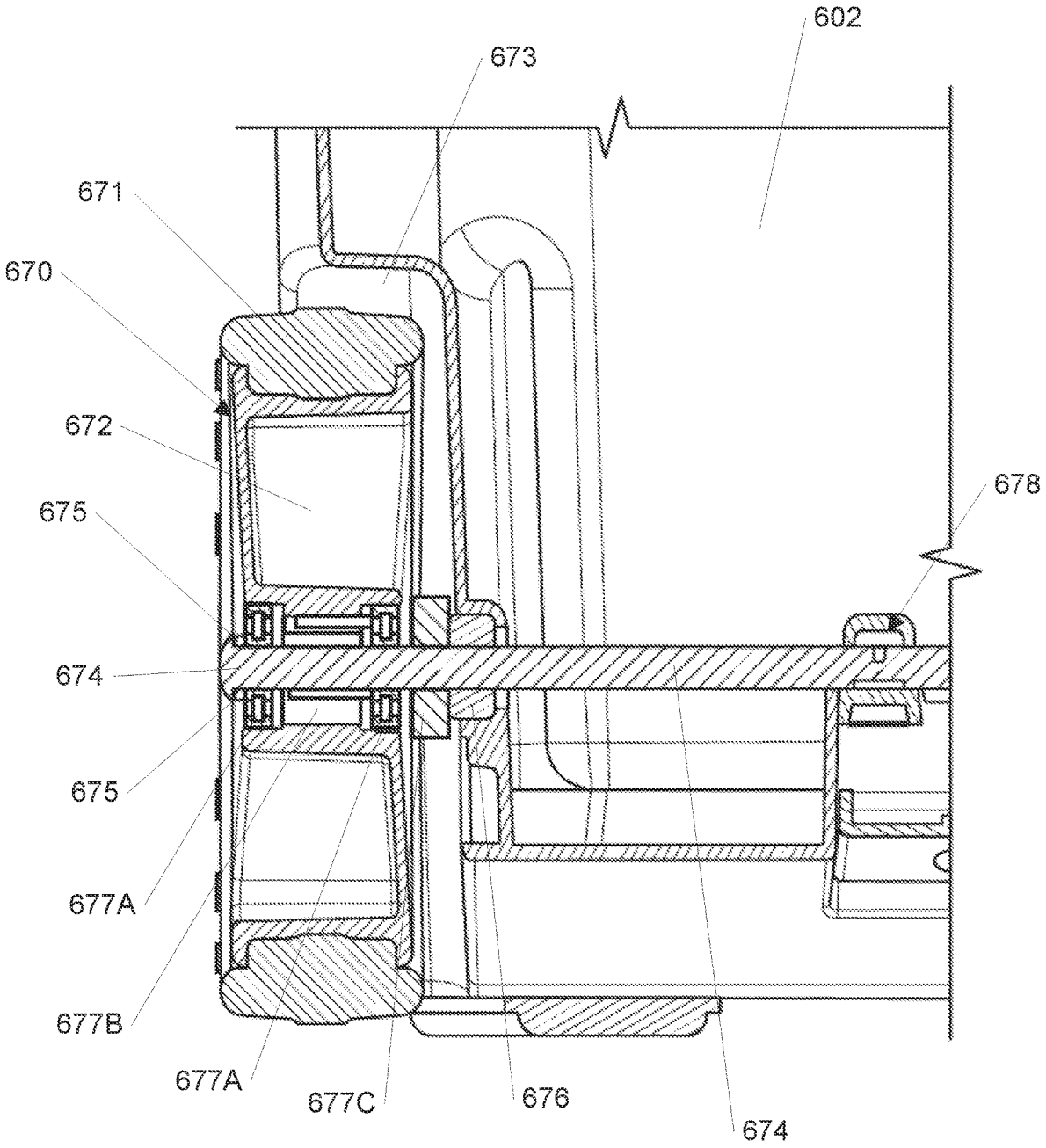
FIG. 20A illustrates a rear cross-sectional view of the wheel and axle attachment for the insulating container shown in FIGS. 10A-10E according to one or more aspects described herein.
Figure 20B:
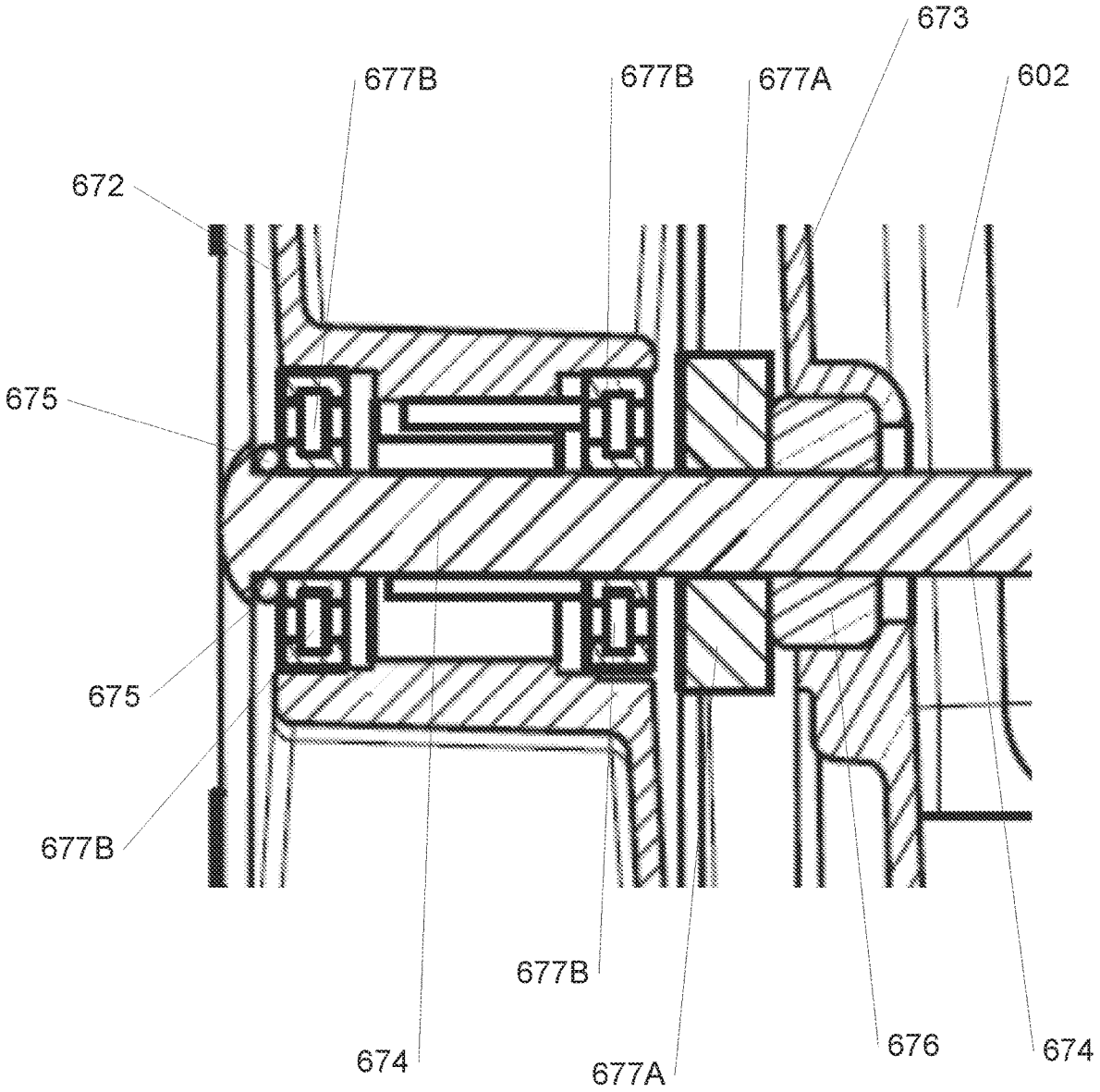
FIG. 20B illustrates a close-up rear cross-sectional view of the wheel and axle attachment for the insulating container shown in FIG. 20A according to one or more aspects described herein.
Figure 21:
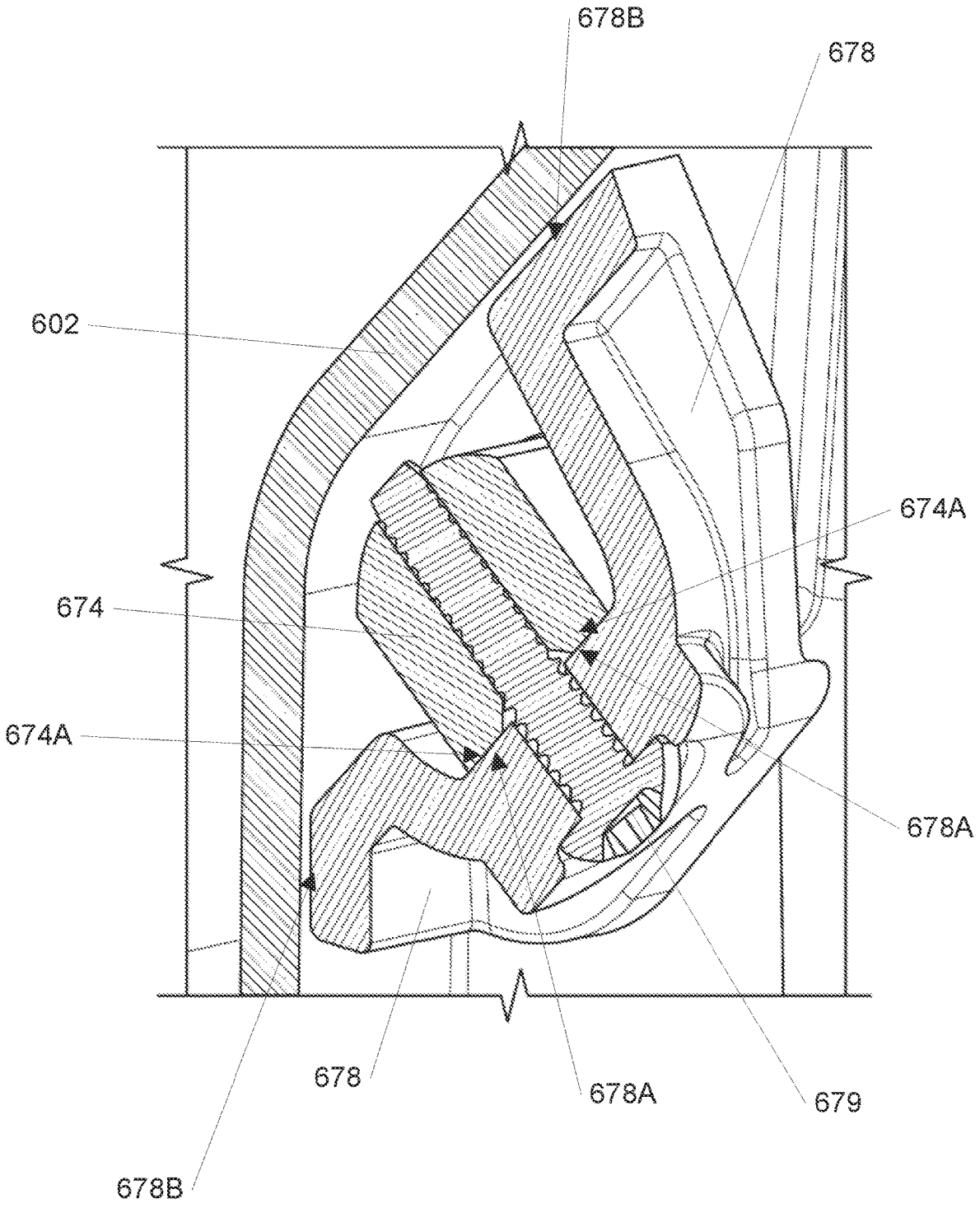
FIG. 21 illustrates a rear cross-sectional view of the axle attachment and anti-rotation mount for the insulating container shown in FIGS. 10A-10E according to one or more aspects described herein.

In other examples, the insulating container 600 may include a rear wheel assembly 670, as specifically illustrated in FIGS. 10A-10D and 19-21. FIG. 19 illustrates a bottom perspective view of the insulating container 600 showing the wheel assembly 670. FIGS. 20A and 20B illustrate rear cross-sectional views of the wheel assembly 670 and an axle attachment for the insulating container 600. FIG. 21 illustrates a rear cross-sectional view of the axle attachment and anti-rotation mount for the wheel assembly 670 of the insulating container 600.

The insulating container 600 may include a wheel assembly 670 that includes a pair of wheels 672 to assist a user in easily moving the insulating container 600. The wheel assembly 670 may include a tire 671 and a wheel 672, where each wheel 672 may be mounted with an axle 674 to the base 602. The wheel assembly 670 may include a single axle 674 for both wheels 672 or a double axle 674 with an axle for each wheel 672. The tire 671 may be made of polyurethane foam with a hardness of approximately 80 shore A, and a density of 0.75 KG/LT. The wheel 672 may be made of a rigid material, such as a glass filled nylon material. The tire 671 may be over-molded, stretch-fit, or grip-fit over the wheel 672. The wheel 672 may include ribs or other gripping structures on an internal rim of the wheel 672 to help grip the foam tire 671.

Each wheel assembly 670 and wheel 672 may be mounted to the base 602. More specifically, each wheel 672 may be mounted to the rear side portion 614B adjacent to the bottom surface 608 of the insulating container 600. Each wheel 672 may be secured into a wheel recess 673 on the base portion 602 and the rear side portion 614B. Each wheel 672 may be secured within the recess 673 using at least one spring retention ring 675 and connected to at least one axle 674. Additionally, the wheels 672 and tires 671 may extend to the rear past the pull handle assembly 660, thereby providing additional tip protection to the pull handle assembly 660. Additionally, the wheels 672 and the tires 671 may be elevated from the ground when the insulating container 600 is sitting flat on the ground. The tires 671 may also include a flat tread profile for improved sand/soft terrain performance. The wheels 672 may also include a single wall wheel hub that provides lighter weight. Additionally, the flatter and thinner tread profile of the tires 671 may provide a lightweight wheel.

FIGS. 20A and 20B specifically illustrate an exemplary embodiment of the wheel assembly 670 showing the wheels 672 and the axle 674 for the insulating container 600. The wheel assembly 670 may include one or more ball bearings 677A, an internal spacer 677B, and an external spacer 677C that sets the distance between the bearings 677A. The internal spacer 677B may be made of an aluminum material. The external spacer 677C may be made of a rigid polypropylene material and may be used to set the location of the wheel 672. The wheel 672, the internal spacer 677B, the external spacer 677C, and a wheel grommet 676 may be retained along an axis of the axle 674 by a spring retention ring 675 along the end of the axle 674. The spring retention ring 675 may fit radially around the end of the axle 674 to hold the axle 674 through the wheel 672 and within the base 602.

Additionally, the wheel assembly 670 may include a wheel grommet 676. The wheel grommet 676 may be located between the wheel recess 673 and the external spacer 677C. The wheel grommet 676 may also be located around the axle 674. The wheel grommet 676 may provide a seal between the wheel recess 673 and the inner portion of the base 602. The wheel grommet 676 may be a rubber/non-rigid material (such as EPDM rubber). The wheel grommet 676 may be used to prevent water or other materials from entering the insulation center of the base 602. The wheel grommet 676 may be a bushing or grommet to absorb shock or forces impacted on the wheels 672 and absorb shock and cushion the axle 674. By absorbing shock, the wheel grommet 676 may allow the axle 674 to rotate when there is a high force put on the wheels 672. For example, during a drop test simulating the insulating container 600 being dropped and the insulating container 600 is loaded with approximately seventy-five pounds, the wheel assembly 670 will not break because of the wheel grommet 676. The entire force from the drop may get concentrated on the axle 674 instead of the wheels 672. The force from the drop may be absorbed and or dissipated by the wheel grommet 676, reducing and preventing high shock from reaching the base 602, the axle 674, the axle brackets 678, and other critical components. The drop testing may include dropping the insulating container 600 from approximately one meter off the ground and completed in a cold, hot, and room temperature condition. The insulating container 600 may be dropped on multiple orientations including back with impact force applied to both wheels 672 and on the corner of the wheel, with the force applied to a singular wheel 672.

FIG. 21 specifically illustrates an exemplary embodiment of an axle bracket 678 to prevent the axle 674 from rotating and coming out. The axle bracket 678 may be an anti-rotation mount against the base 602. There may be at least one axle bracket 678 per axle 674. Additionally, there may be multiple, such as two, three, or four axle brackets 678 per axle 674. The one or more axle brackets 678 may be covered from view by the pull handle assembly 660. The axle bracket 678 may be attached with a fastener 679 to the axle 674. The axle 674 may include a flat section 674A with fastener attachment points 679A. The flat sections 674A of the axle 674 may be compressed and permanently mated with flat sections 678A of the axle bracket 678. The axle bracket 678 may include additional flat and mating features 678B that contact and hold the axle bracket 678 against the base 602. These flat sections 678A may prevent the axle 674 from rotating about the base 602, by holding the axle 674 stationary and in a permanent location in the base 602.

Figure 22:
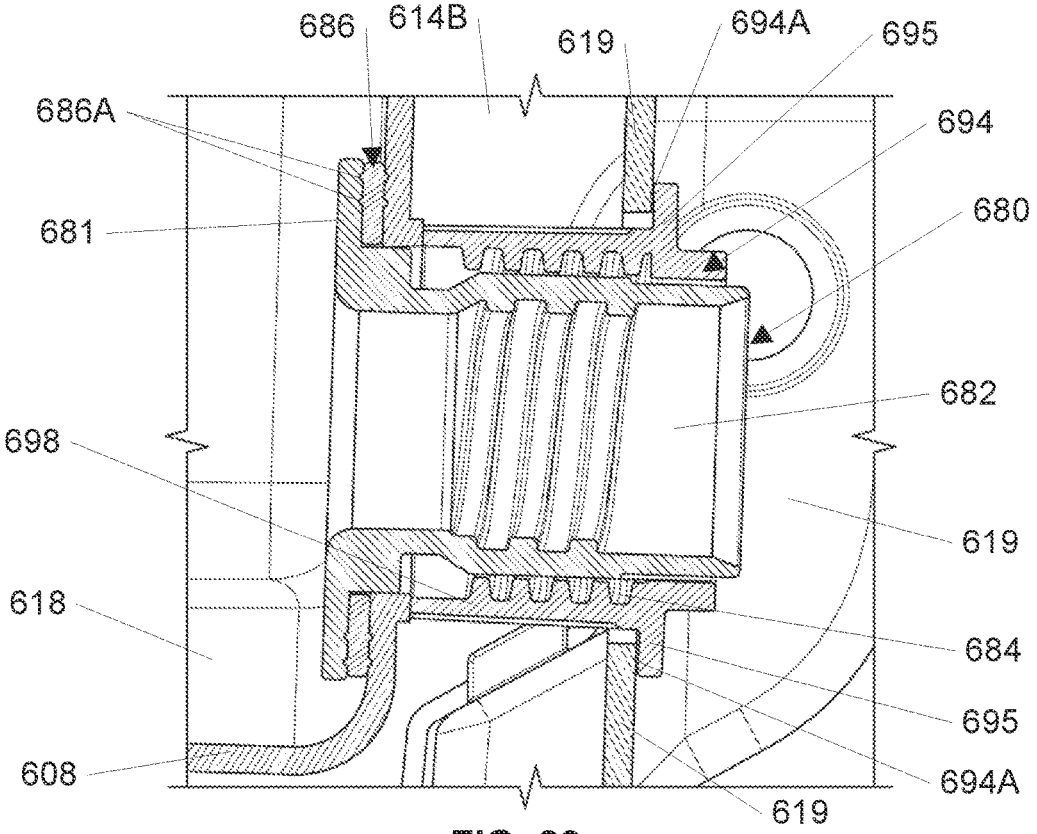
FIG. 22 illustrates a side cross-sectional view of a drain plug assembly for the insulating container shown in FIGS. 10A-10E according to one or more aspects described herein.
Figure 23:
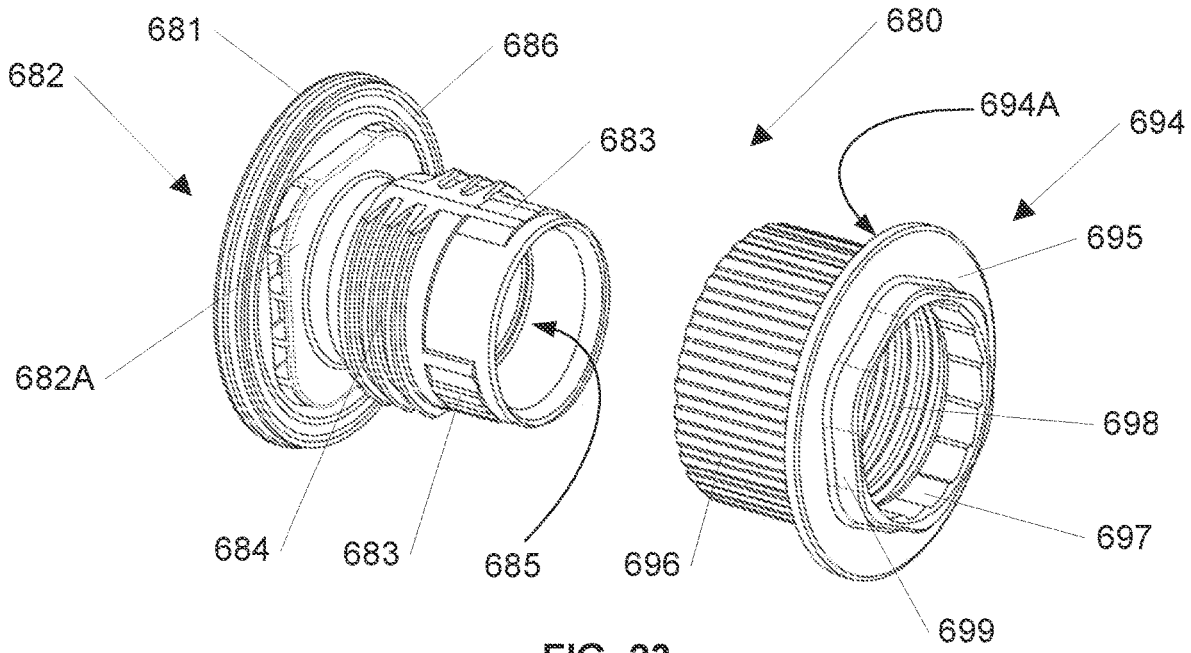
FIG. 23 illustrates an exploded view of the drain plug assembly for the insulating container shown in FIGS. 10A-10E according to one or more aspects described herein.

In other examples, the insulating container 600 may include a drain plug assembly 680, as specifically illustrated in FIGS. 10C, 19, 22, and 23. FIG. 19 illustrates a bottom perspective view of the insulating container 600 showing the drain plug assembly 680. FIG. 22 illustrates a side cross-sectional view of the drain plug assembly 680 for the insulating container 600. FIG. 23 illustrates an exploded view of a drain plug assembly 680 for the insulating container 600.

As shown in FIGS. 22 and 23, the drain plug assembly 680 may include a main tube 682, an outer tube 694, and a gasket 686. The drain plug assembly 680 may be located and installed within a pass through of the wall of the base portion 602. In the illustrated embodiment, the drain plug assembly 680 may be located on the rear side portion 614B adjacent to the bottom surface 608 of the insulating container 600. The drain plug assembly 680 may be installed and located within a drain plug inset 609 that provides a protected drain plug assembly 680. The drain plug assembly 680 may include ratchet features wherein the main tube 682 (or inner tube) is keyed so the main tube 682 cannot rotate/open when the main tube 682 is screwed into the outer tube 694.

The main tube 682 may include a drain pass-through portion 685 having one or more ratchet keys 683 on a first end and a main tube rim 681 on the other end opposite the first end. The main tube 682 may also have an external threaded connection 684 located between the main tube rim 681 and the ratchet keys 683. The main tube 682 may also include a gasket 686. The gasket 686 may provide compression between the main tube 682 and the inner wall 681 of the base 602. The gasket 686 may include radial features 686A that help seat the gasket 686 against the main tube rim 681 and the inner wall 618 of the base 602. The gasket 686 may be a separate component or the gasket 686 may be molded into the main tube 682. The gasket 686 may be a softer material, such as silicone, while the main tube 682 is a more rigid material. The gasket 686 may be for example, have a durometer 40, shore A.

The outer tube 694 may also include a sealing ring 694A that is inherent to the outer tube rim 695 of the outer tube 694. The sealing ring 694A contacts the rear side portion 614B and the base outer wall structure 619 The outer tube 694 may include an internal threaded connection 698. The outer tube 694 may also include an outer tube rim 695 and ratchet teeth 697 on the same end. The ratchet teeth 697 may be located on an internal portion of the outer tube 694. The outer tube 694 may also include a sealing ring 694A that is inherent to the outer tube rim 695 of the outer tube 694. The sealing ring 694A may contacts the rear side portion 614B and the base outer wall structure 619. The sealing ring 694A may also create a seal that prevents foam from escaping during assembly. The sealing ring 694A may be a singular ring concentric about an axis of the outer tube 694. The sealing ring 694A may also include multiple rings or non-circular.

As shown in FIG. 22, the main tube 682 and the outer tube 694 may engage to form and create the drain plug assembly 680. The main tube 682 and the outer tube 694 may pass through the rear side portion 614B, a base inner wall structure 618, and a base outer wall structure 619. The main tube 682 and the outer tube 694 may cooperatively engage with each other, thereby creating the drain plug assembly 680 of the insulating container 600. The main tube 682 may be installed first, using a rectangular fitting with flats 682A on the main tube 682 that mate with a rectangular opening in the rear side portion 614B and inner wall 618 of the base 602. This rectangular fitting 682A may prevent rotation of the drain plug assembly 680 relative to the base 602. The outer tube 694 may then be screwed onto the main tube 682.

Next, external threaded connection 684 of the main tube 682 may engage with internal threaded connection 698 on the outer tube 694. Then, the ratchet keys 683 and the ratchet teeth 697 may engage and ratchet the main tube 682 and the outer tube 694 together. The outer tube 694 may include a flat head structure 699 to allow for tools to tighten the outer tube 694 into the main tube 682. The flat head structure 699 may be any polygon shape with one or more flat sides, such as for example, square, pentagon, hexagon, or other polygon shapes. The flat head structure 699 may also include curved sides. The flat head structure 699 may be any shape with one or more flat sides. The outer tube 694 may have bottom out features with a specific length that stops the threaded connection between the main tube 682 and the outer tube 694 and against inner wall/face 618 of the base 602. The bottom out features sets the distance of the inner wall 618 and the outer wall 619 of the base 602.

The ratchet features of the drain plug assembly 680 may consist of the ratchet teeth 697 on the outer tube 694 with one or more ratchet keys 683 (or pawls) on the main tube 682 that engage the ratchet teeth 697. As the outer tube 694 is screwed onto the main tube 682, the ratchet keys 683 of the main tube 682 engage with the ratchet teeth 697 on the outer tube 694. The engagement of the ratchet keys 683 and ratchet teeth 697 allows continuous rotary motion of the main tube 682 in only one direction (closing), while preventing motion in the opposite direction (opening). The ratchet teeth 697 may be uniform but asymmetrical, with each tooth having a moderate slope on one edge and a much steeper slope on the other edge. When the ratchet teeth 697 are moving in the unrestricted (i.e. closing) direction, the ratchet keys 683 easily slide up and over the gently sloped edges of the ratchet teeth 697, with the pressure of the connection forcing the ratchet keys 683 (potentially with an audible 'click') into a depression between the ratchet teeth 697 as the ratchet keys 683 pass a tip of each ratchet tooth 697. When the ratchet teeth 697 move in the opposite (opening) direction, however, the ratchet keys 683 will catch against the steeply sloped edge of the first ratchet tooth 697 the ratchet key 683 encounters, thereby locking ratchet key 683 against the ratchet tooth 697 and preventing any further motion in that direction.

When the main tube 682 is fully screwed into the outer tube 694, the main tube rim 681 may engage the rear side portion 614B and the gasket 686 may engage the base inner wall structure 618. The gasket 686 may prevent liquid from escaping the insulating container 600 between the drain plug assembly 680 and the cooler base 602. The gasket 686 may also prevent foam from escaping during the assembly process.

FIGS. 24A-33 illustrate another example insulating container 700 according to one or more aspects described herein. For the embodiment of FIGS. 24A-33, the features are referred to using similar reference numerals under the "7xx" series of reference numerals, rather than "1xx" as used in the embodiment of FIG. 1A/1B/1C, "2xx" as used in the embodiment of FIGS. 3A/3B/3C, "4xx" as used in the embodiment of FIGS. 7A/7B, or "6xx" as used in the embodiment of FIGS. 10A-23. A "7xx" feature may be similar to a "1xx," "2xx," "4xx," or "6xx" feature. Accordingly, certain features of the insulating container 700 that were already described above with respect to the insulating container 100, 200, 400, or 600 of FIGS. 1A/1B/1C, 3A/3B/3C, 7A/7B, and 10A-23 may be described in lesser detail, or may not be described at all. Additionally, any features described above with respect to the insulating container 100, 200, 400, and 600 in FIGS. 1A through 23 may be utilized with the insulating container 700.

Figure 24B:
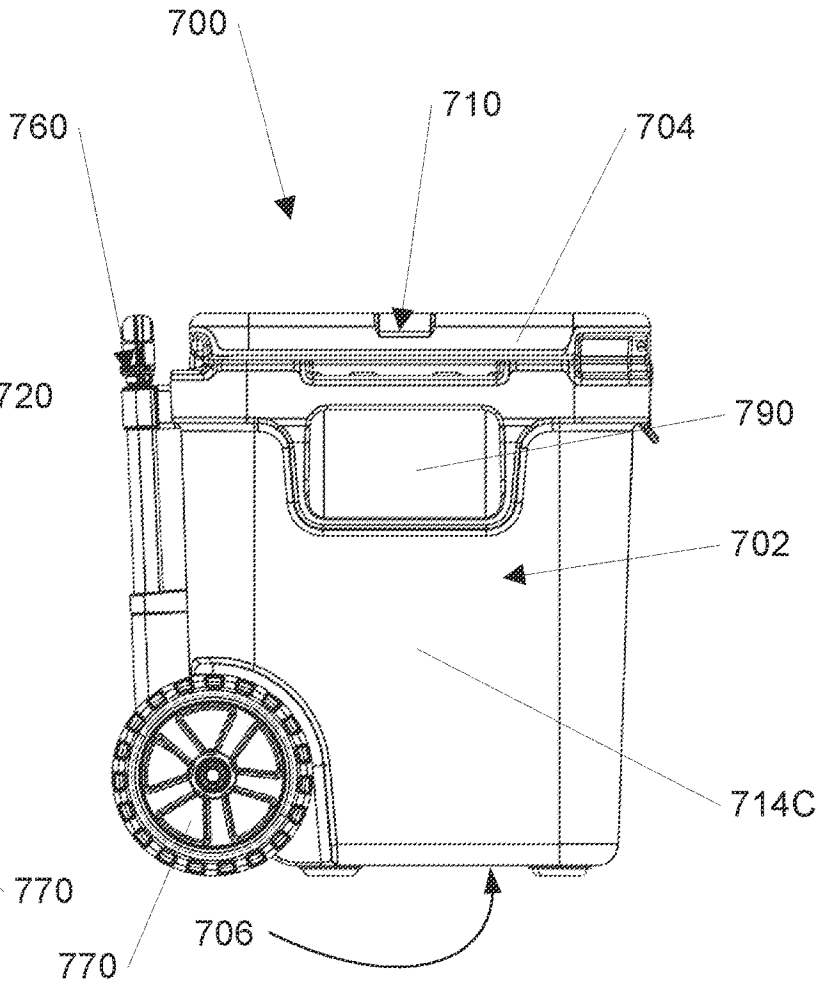
FIGS. 24A, 24B, 24C, and 24D illustrate a front view, side view, rear view, and side view of another insulating container according to one or more aspects described herein.
Figure 24A:
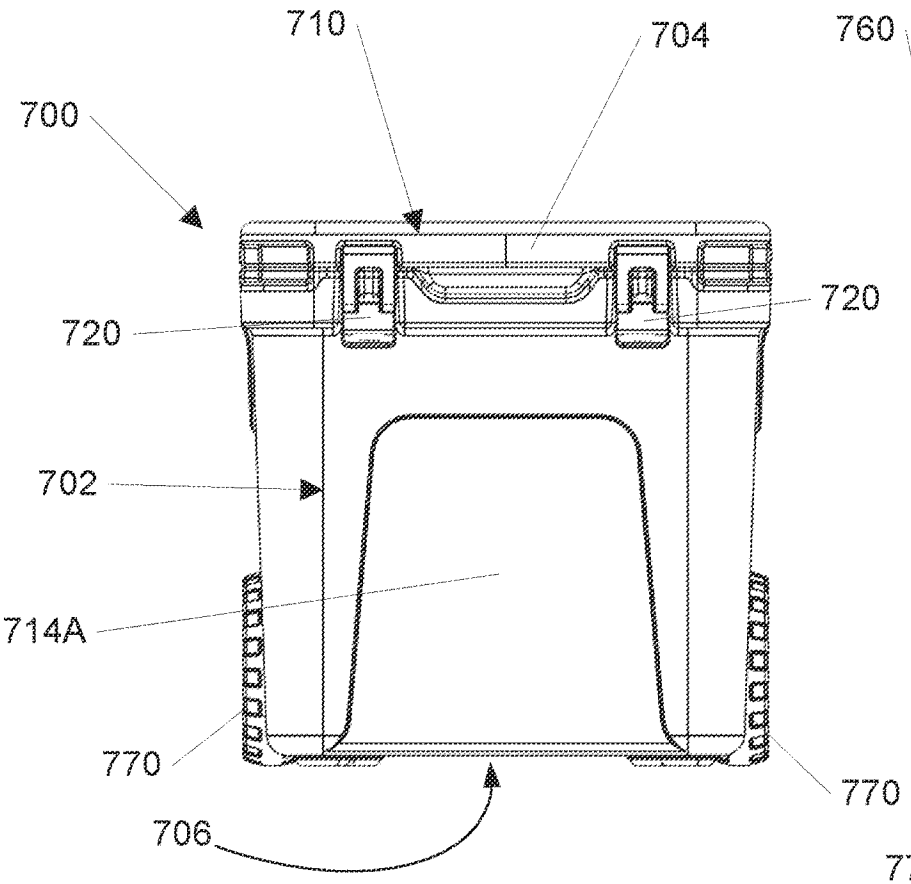
Figure 24D:
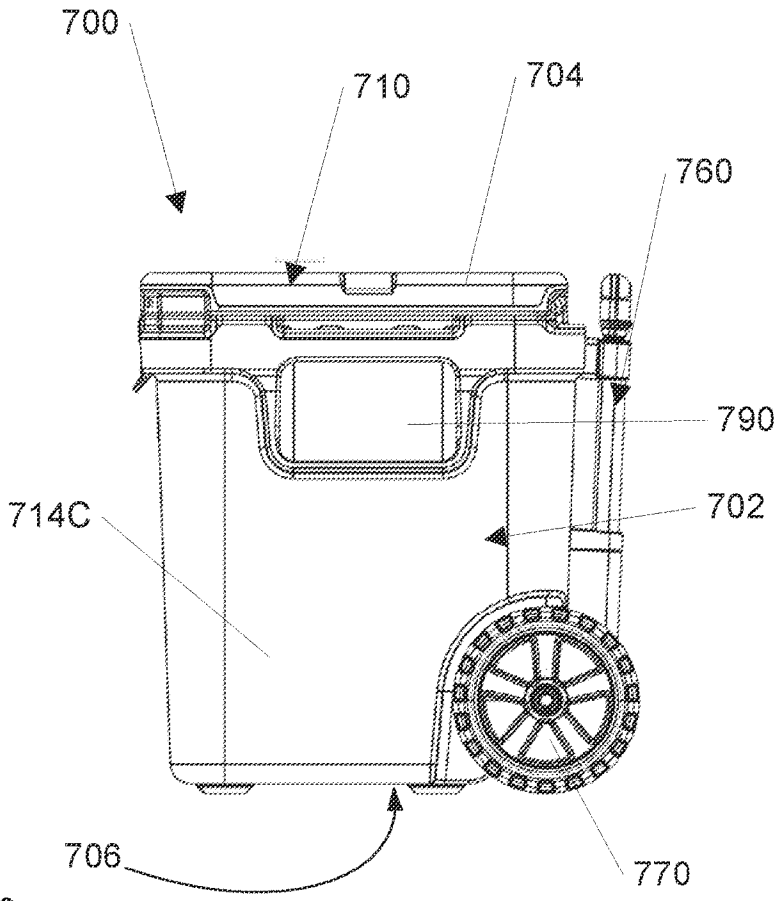
Figure 24C:
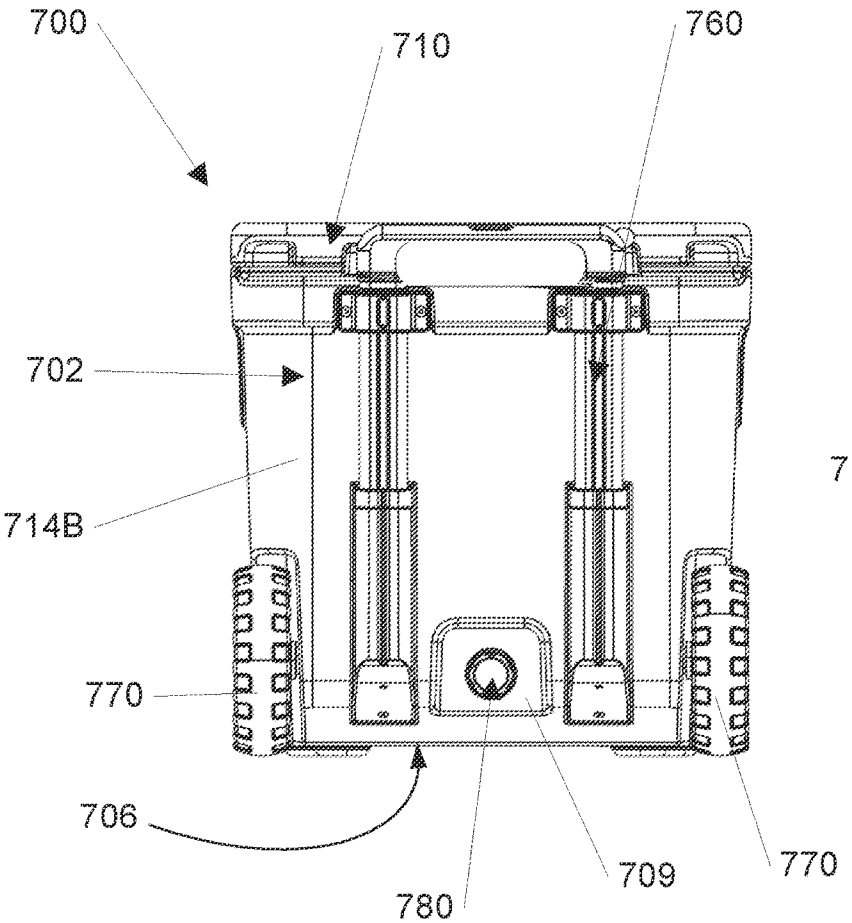
Figure 24F:
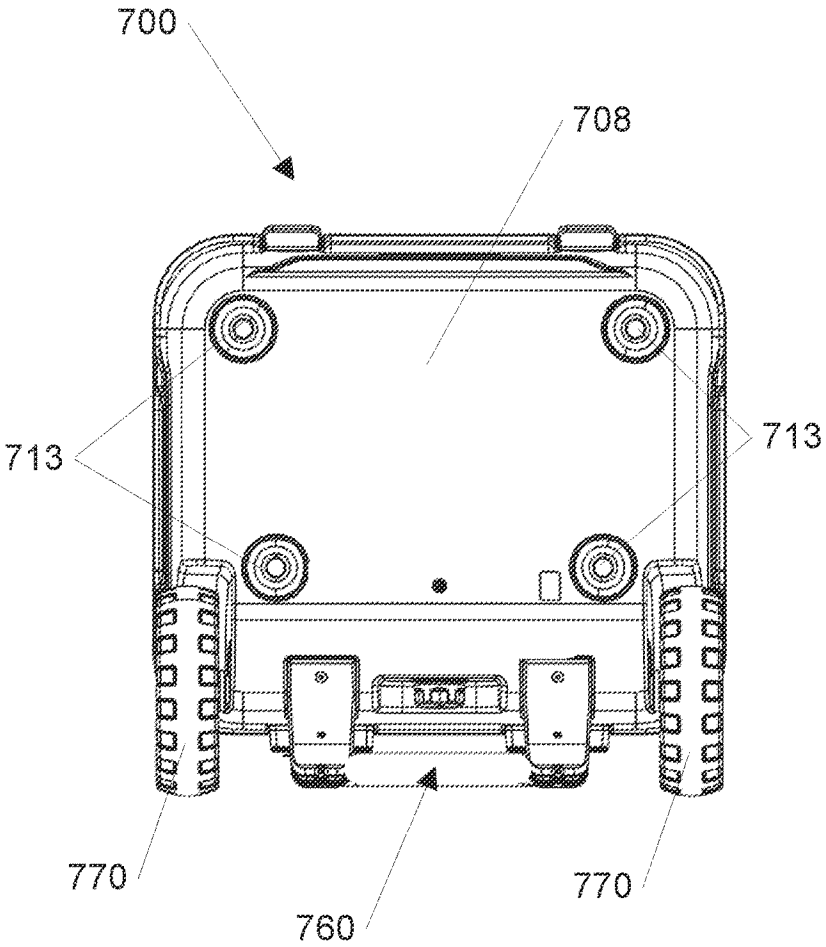
FIGS. 24E and 24F illustrate a top view and a bottom view of the insulating container shown in FIGS. 24A-24D according to one or more aspects described herein.
Figure 24E:
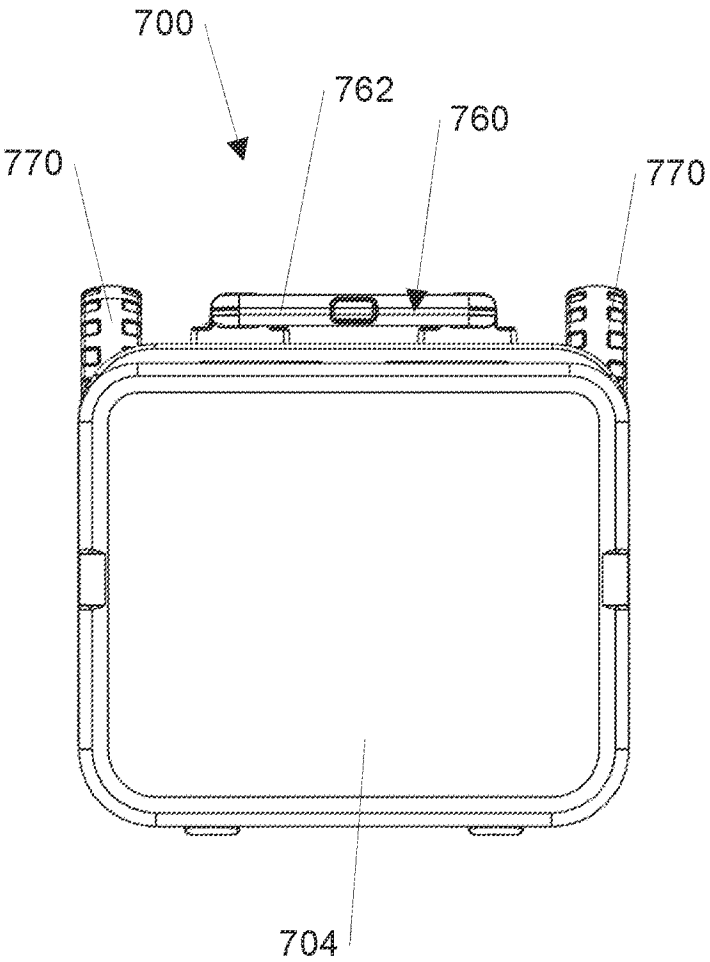
Figure 24G:
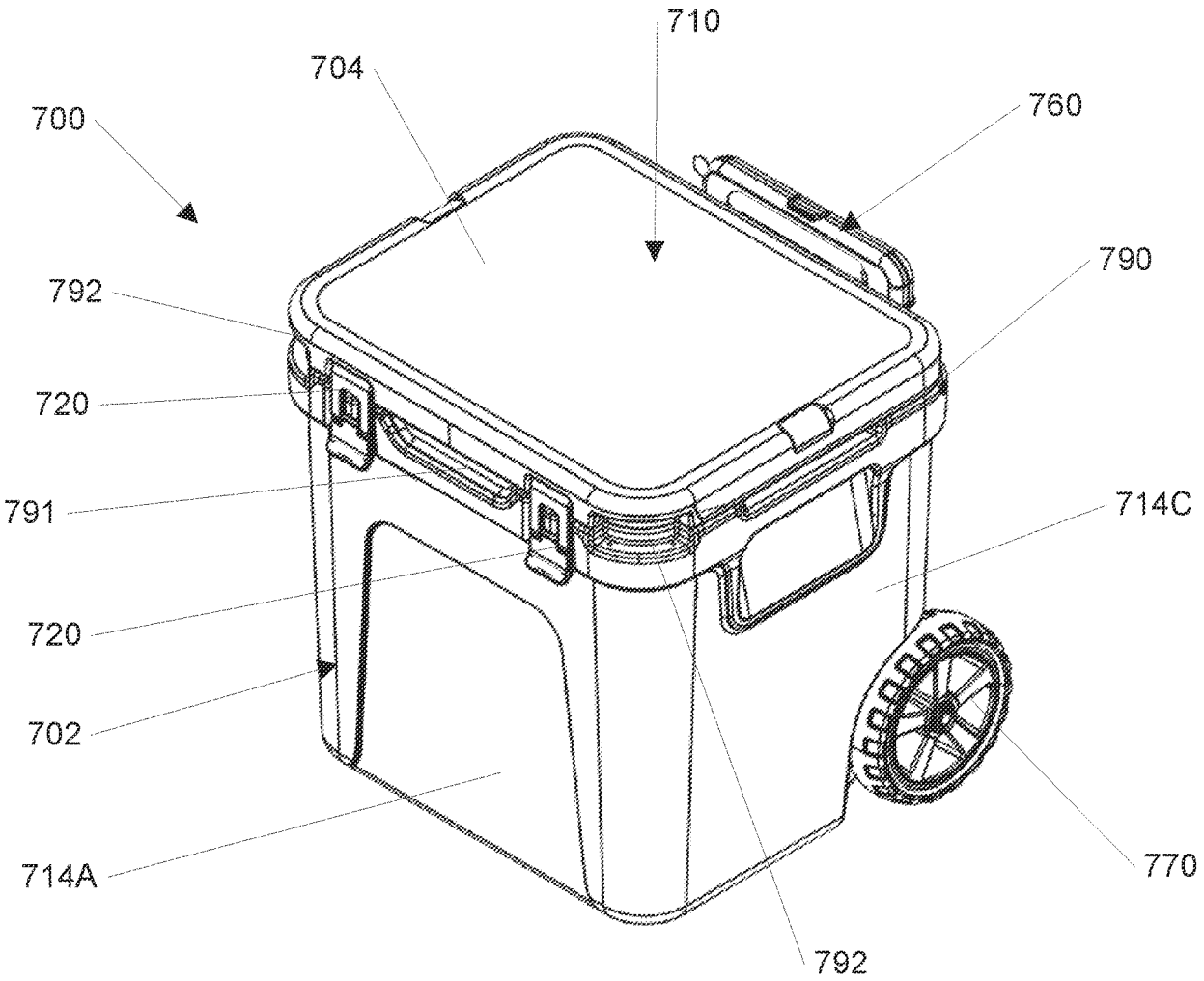
FIG. 24G illustrates a front perspective view of the insulating container shown in FIGS. 24A-24F according to one or more aspects described herein.

FIG. 24A depicts a front view of an insulating container 700. FIGS. 24B and 24D depict side views of the insulating container 700. FIG. 24C depicts a rear view of the insulating container 700. FIG. 24E illustrates a top view of the insulating container 700. FIG. 24F illustrates a bottom perspective view of the insulating container 700. FIG. 24G illustrates a front perspective view of the insulating container 700.

In one example, the insulating container 700 may comprise a base portion 702 and a lid 704 that, in some examples, may be non-destructively, removably coupled thereto. The base portion 702 may be an insulated structure forming an interior void for containing contents or a liquid. In some examples, the base portion 702 may be cuboidal or substantially cuboidal in shape. In still other examples, the base portion 702 may be substantially cylindrical in shape or may have a substantially rectangular cross section. Various other shapes may be used without departing from the invention.

The base portion 702 may include a first end 706, having a bottom surface 708 (as specifically illustrated in FIG. 24F). The bottom surface 708 may be configured to support the insulating container on a surface, such as a table, the ground, a vehicle bed, boat deck, or the like.

The base portion 702 further includes a second end 710 defining an opening (shown in FIG. 11) that may be used to access the interior void of the insulating container. The opening may be covered by the lid 704, when the insulating container 700 is in use (e.g., when the insulating container 700 is in a closed configuration). The base portion 702 may further include a plurality of side portions 714 connected to the bottom surface 708 that define a void for receiving contents in the insulating container 700. The side portions 714 may be arranged such that they extend generally perpendicularly from the bottom surface 708. The plurality of side portions 714 may include a front side portion 714A, a rear side portion 714B opposite the front side portion 714A, and two lateral side portions 714C between the front side portion 714A and the rear side portion 714B.

In some examples, one or more side pocket handles 790 may be arranged in one or more side portions 714 (or other region of the base portion 702). The side pocket handles 790 may be integrally molded with the base portion 702 and may generally be an undercut or cutout formed in the side portion 714 of the base 702. In some examples, such as shown in FIGS. 10B and 10D) the undercut or cutout forming the side pocket handle 790 may include a recess extending along substantially all or a majority of a length of the side portion 714. This may provide ease of manufacturing the base 702 with the integrally molded handles 790. In some examples, the side pocket handles 790 may be flush with an exterior surface of the base 702 in order to reduce the risk of breakage.

As discussed above, the insulating container 700 may be configured to contain, store, carry, etc., a volume of contents or possibly a liquid. In some examples, the insulating container 700 may be configured to store approximately 60 liters (approximately 63.4 quarts) or 48 liters (approximately 50.7 quarts). In some examples, the insulating container 700 may be configured to store between twenty-two (22) and twenty-eight (28) quarts of contents. In some examples, the insulating container 700 may be configured to store approximately twenty-four (24) quarts of contents. In other examples, the insulating container 700 may be configured to store at least twenty-two (22) quarts of contents, or the insulating container may be configured to store at least twenty-eight (28) quarts of contents, among others. In yet other examples, the insulating container 700 may be configured to store approximately sixteen (16) quarts of contents, twenty-four (24) quarts of contents, thirty-six (36) to thirty-eight (38) quarts of contents, or forty-eight (48) to fifty-eight (58) quarts of contents. In still other examples, the insulating container 700 may be configured to store between about fourteen (14) and about forty-five twenty-eight (45) quarts of contents. Additionally or alternatively, the insulating container 700 may be configured to store materials in a solid, liquid, or a gaseous state, or combinations thereof, without departing from the scope of the disclosure described herein.

In at least some examples, the insulating container 700 (and various other containers described herein) may be sized to accommodate the volume of contents described above. For example, the insulating container 700 may be at least seventeen (17) inches tall, at least sixteen (16) inches wide, and at least fourteen (14) inches deep. Additionally or alternatively, the insulating container 700 may be configured in different sizes (i.e., height, width, and depth) without departing from the scope of the disclosure described herein.

As previously discussed, the insulating container 700 includes a lid 704. In some examples, the lid 704 may connect to the base 702 in a closed configuration using a press fit. Additionally or alternatively, other securing systems or devices may be used to secure the lid 704 to the base. Insulating container 700 may include latching devices 720 and keepers of the base 702 on the front of the container, as shown in FIGS. 24A and 24G, to secure the lid 704 in the closed position. In some examples, the lid 704 may be configured to remain secured or locked in a closed position using latching devices 720. The latching devices 720 may be various types of latches, including a latch having a latch portion and a keeper portion on the base 702, as well as various other types of latches. The insulating container 700 may include any of the latching devices and keepers as described above and specifically illustrated in FIGS. 1A, 1B, 3A, 4A, 5A, 5C, 6A, 6B, and 6C.

In other configurations as illustrated in FIG. 24G, the insulating container 700 may include a lid 704 and base 702 that form at least one corner lift ledge 792 to facilitate easy gripping of the lid for opening. In other examples, the insulating container 700 may include a plurality of corner lift ledges 792. In certain examples, the lift ledge 792 may be formed by an integrally molded portion of the corner of the lid 704, and an integrally molded portion of the front corner at the top of the base 702. In still other configurations, the insulating container 700 may include front lift ledge 791 integrally molded in the base 702. The front lift ledge 791 may integrally molded at the top of the base 702. The lift ledge 791 may be configured to provide the insulating container 700 an easily accessible region to allow an individual to grasp the lid 704 for ease of opening (i.e., one handed operation).

In some examples, the lid 704 may be hinged such that it is connected to (either removably or permanently) the base 702 at a hinge and may be rotated about the hinge. The hinge may be one of various types of hinges, including a continuous piano hinge, double hinge, ball joint hinge, living hinge, and the like. The hinge may permit the lid 704 to be opened and rotated away from the base portion 702, to allow access to the internal void defined by the base portion 702 (e.g., via opening). That is, the hinge may facilitate rotation of the lid 704 from a closed configuration of the insulating container 700 (e.g., when the lid 704 is in place covering the internal void formed by the base 702) to an open configuration (e.g., when the lid 704 is not covering the internal void formed by the base 702), and vice versa. In some examples, the insulating container 700 is configured with at least one hinge. In another example, the insulating container is configured with a plurality of hinges. In still other configurations, hinge comprises a first portion integrally molded in the lid 704 and a second portion integrally molded in the base 702.

In the examples described herein, base 702 and lid 704 may include an exterior surface or outer shell surrounding and enclosing an insulating portion, as shown and described in FIGS. 1C and 5A. The shell is typically formed from various materials, such as one or more metals, alloys, polymers, ceramics, or fiber-reinforced materials. In some examples, the shell may be formed of a plastic material, such as thermoplastic olefin elastomers (TPO), polypropylene with rubberizing agent, or polyethylene, that is molded to form both the base 702 and lid 704 portions. Thermoplastic olefinic elastomers (TPOs) consist of polypropylene, polyethylene or other polyolefin as hard segments and rubber component such as ethylene propylene rubber (ethylene propylene (EPM) or ethylene propylene diene monomer (EPDM)) as soft segments. In some examples, the insulating portion is formed of an insulating material that exhibits low thermal conductivity. For instance, the insulating portion may be formed of (or filled with) a polymer foam, such as polyurethane foam. Additional or other insulating materials may be used without departing from the invention. In some examples, the base 702 and lid 704 portions are formed using an injection molding process as would be understood by one of ordinary skill in the art (not shown). However, various other types of molding or other manufacturing processes (e.g., roto-molding, stamping, casting, forging, blow-molding, and the like) may be used to form the insulating container without departing from the invention.

The base portion 702 may include a first end 706, having a bottom surface 708. The bottom surface 708 may be configured to support the insulating container 700 on a surface, such as a table, the ground, a vehicle bed, boat deck, or the like and may include a plurality of feet 713, as illustrated in FIG. 24F. The plurality of feet 713 may include four separate feet located around the perimeter of the bottom surface 708. In another example embodiment, the bottom surface 708 of the insulating container 700 may include one or more lateral feet, as described above and illustrated in FIG. 19. The plurality of feet 713 may be configured to provide a non-skid or no-slip surface, and may be configured to keep the insulating container 700 elevated off the ground. In another example, the plurality of feet 713 may be configured to reduce friction with the ground or surface so that the insulating container may be moved more easily while the container is on the ground (i.e., the insulating container may easily slide or be easily pushed across the ground). The plurality of feet 713 may be separated and parallel, thereby creating and providing an air gap between the bottom surface 708 of the insulating container and the ground. The plurality of feet 713 may be constructed of rubber, foam, plastic, or other suitable material. In another embodiment, the plurality of feet 713 may be molded into the base 702 with an alternative finish or texture in the mold for the plurality of feet 713. In still other embodiments, the bottom surface 708 may include a logo or name of a company or manufacturer of the insulating container embossed, integrally molded, or pressed into the exterior shell.

Figure 25:
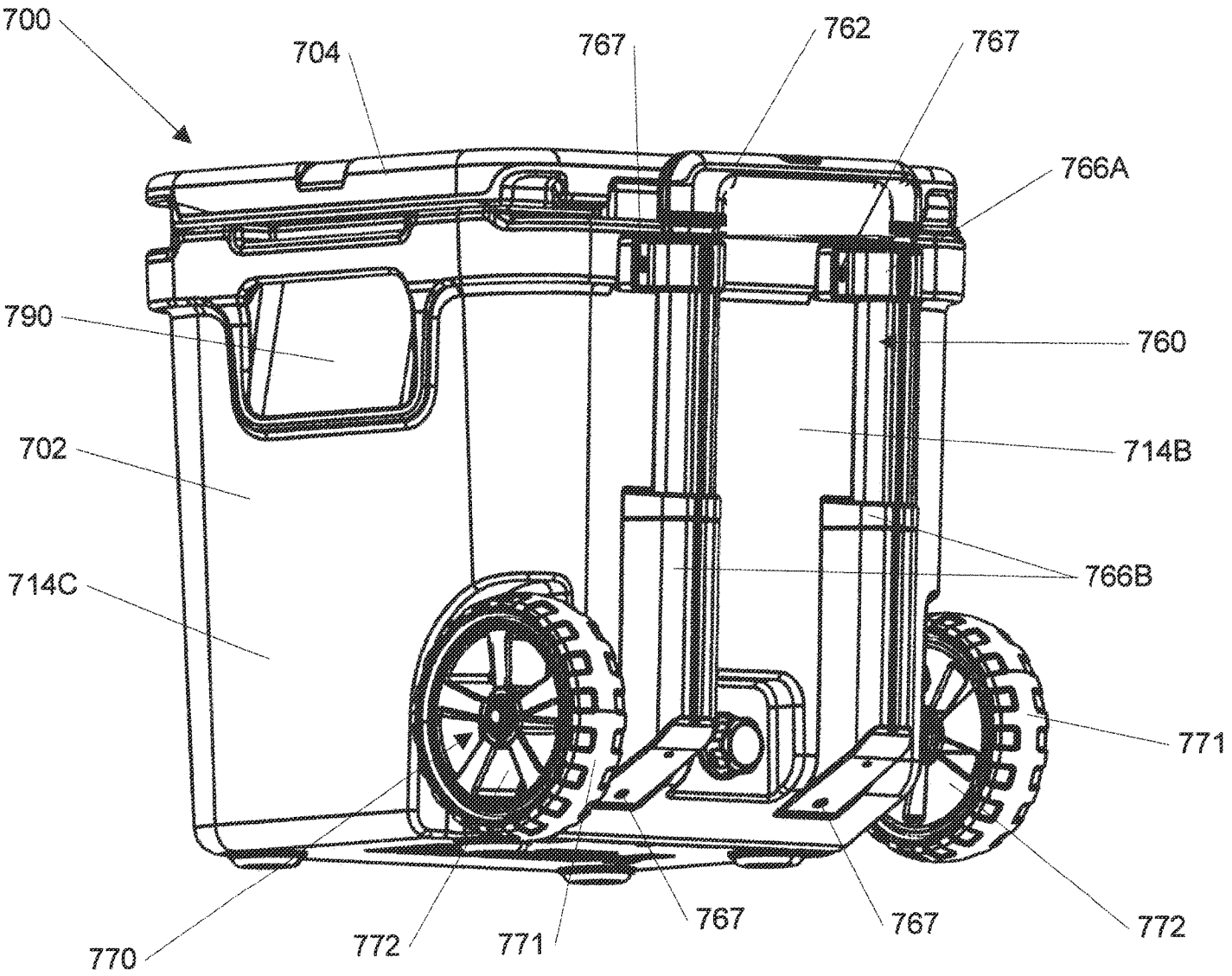
FIG. 25 illustrates a rear side perspective view of the insulating container shown in FIGS. 24A-24F that shows the pull handle assembly in the stowed configuration according to one or more aspects described herein.
Figure 26:
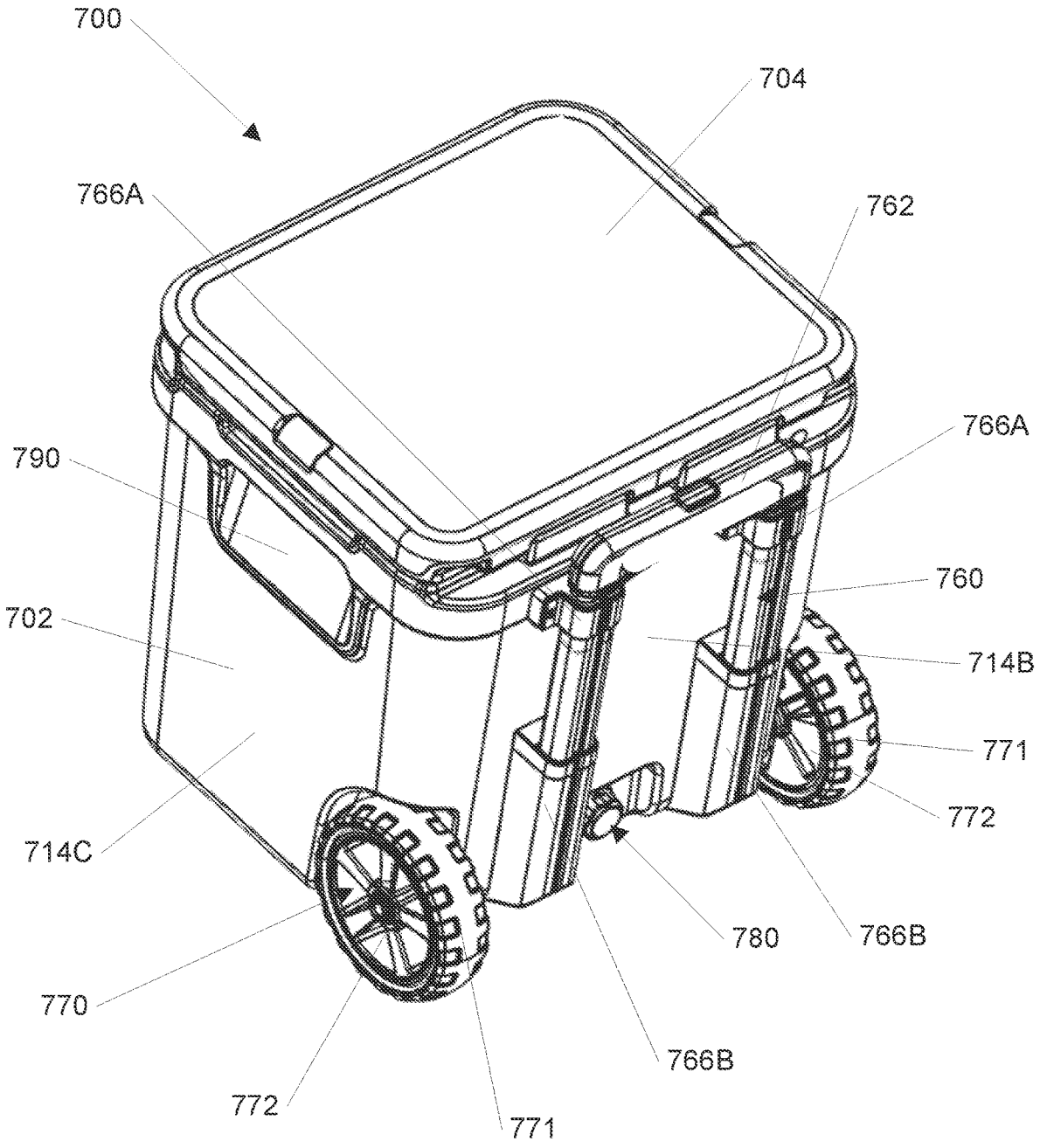
FIG. 26 illustrates a rear top perspective view of the insulating container shown in FIGS. 24A-24F according to one or more aspects described herein.
Figure 27B:
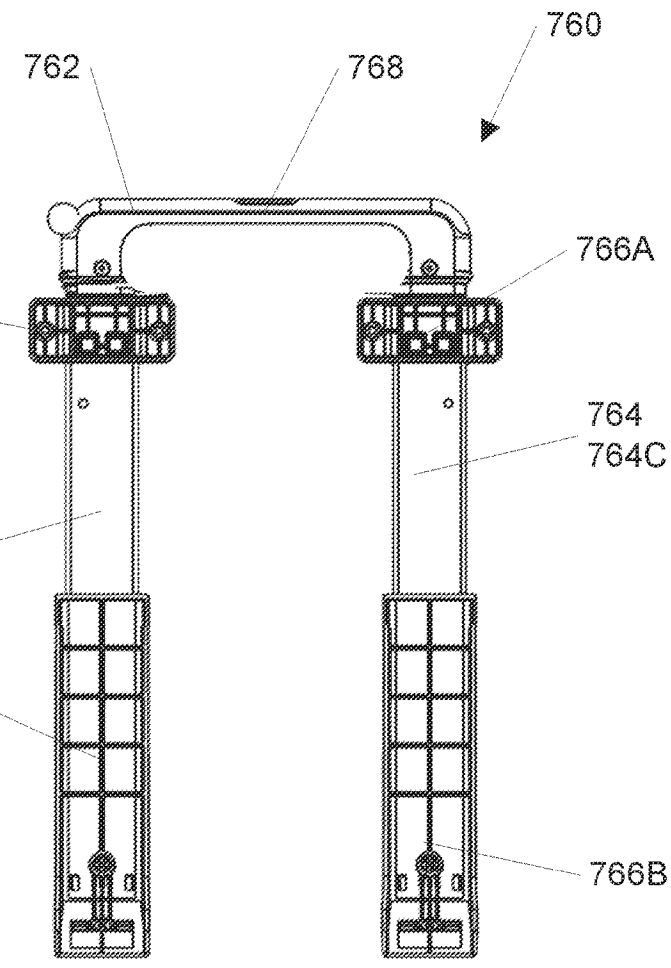
FIGS. 27A, 27B, and 27C illustrate a front view, rear view, and side perspective view of the pull handle assembly of the insulating container shown in FIGS. 24A-24F according to one or more aspects described herein.
Figure 27A:
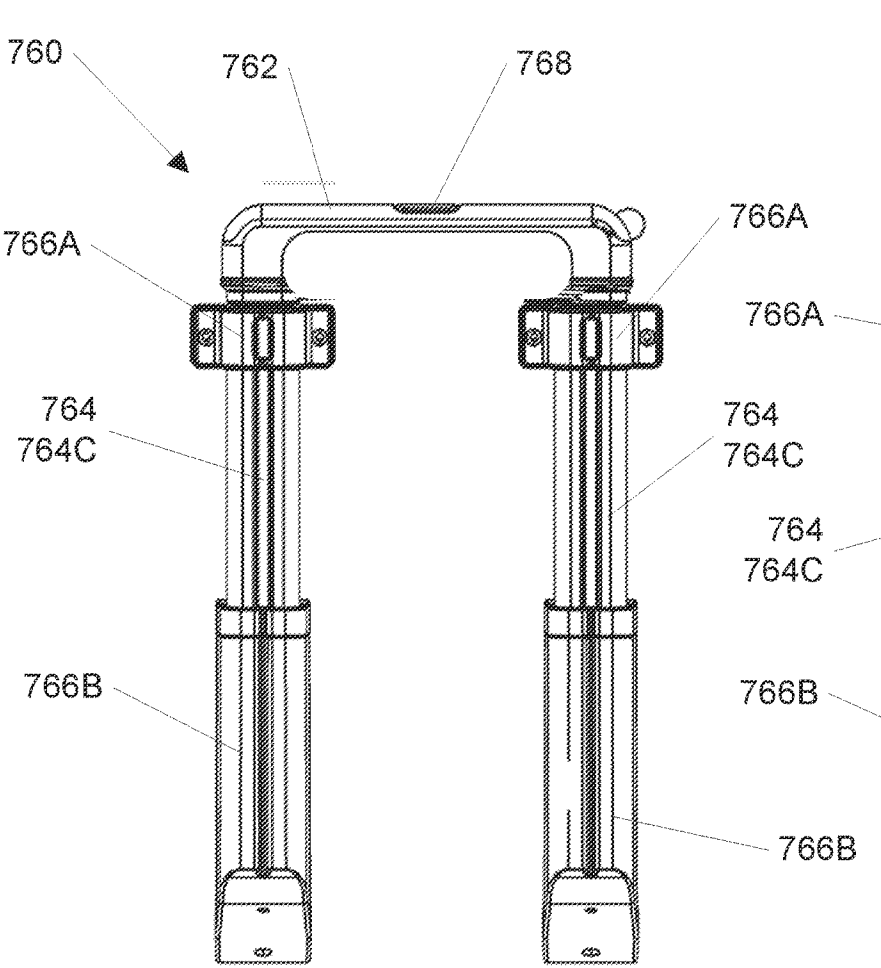
Figure 27C:
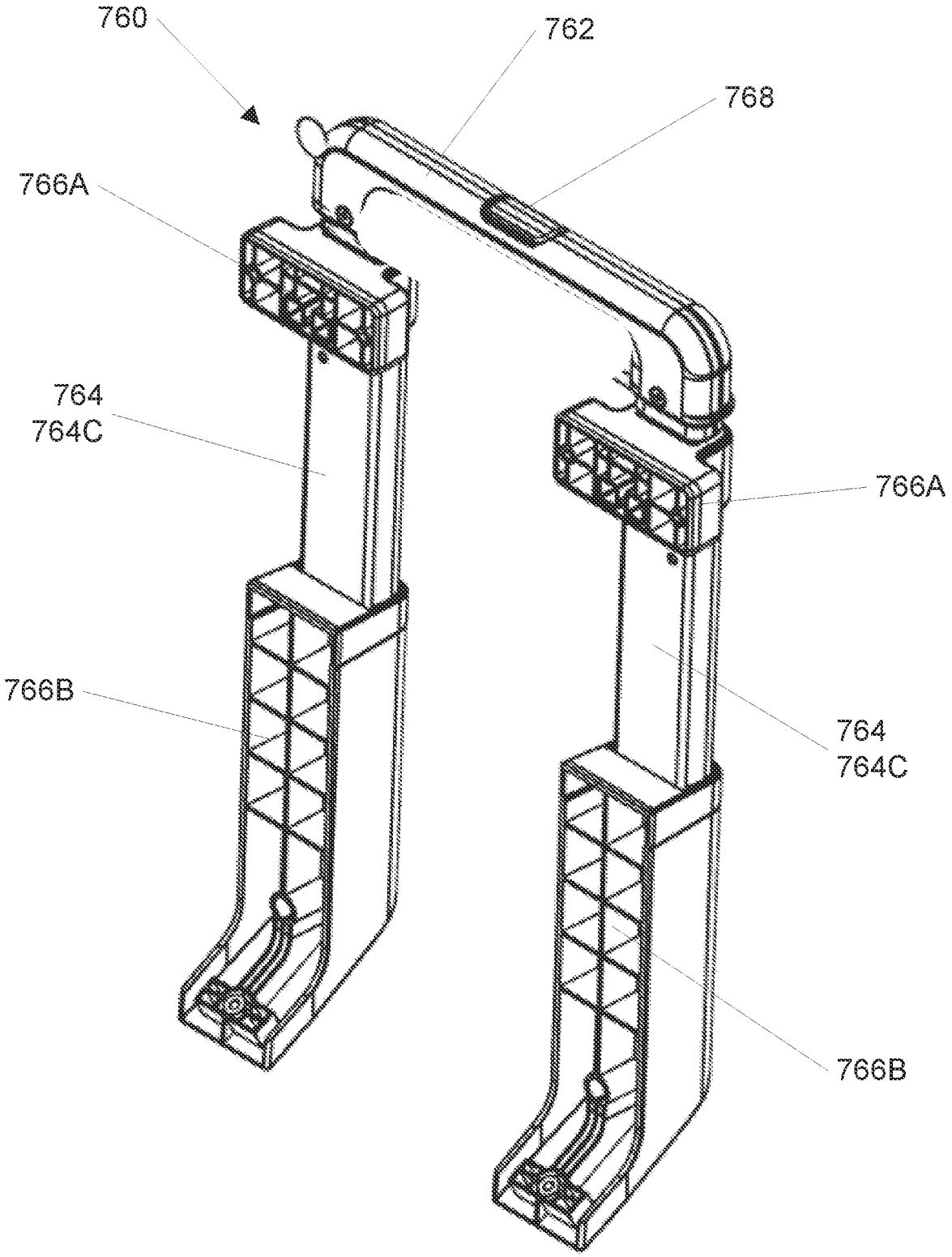

In other examples, the insulating container 700 may include a pull handle assembly 760, as specifically illustrated in FIGS. 25, 26, and 27A-27C. FIGS. 12A-12C illustrates a side view of the insulating container 700 showing the pull handle assembly 760 in various stowed and extended configurations. FIG. 13 illustrates a side view of the insulating container 700 in a tilted configuration and the pull handle assembly 760 in the extended configuration. FIG. 25 illustrates a bottom rear perspective view of the insulating container 700 with the pull handle assembly 760 in the stowed configuration. FIG. 26 illustrates a top rear perspective view of the insulating container 700 with the pull handle assembly 760 in the stowed configuration. FIGS. 27A-27C illustrate component views of the pull handle assembly 760. Specifically, FIG. 27A illustrates a front view of the pull handle assembly 760, FIG. 27B illustrates a rear view of the pull handle assembly 760, and FIG. 27C illustrates a rear perspective view of the pull handle assembly 760.

FIGS. 25, 26, and 27A-27C illustrate a pull handle assembly 760 that enables a user to ergonomically maneuver the insulating container 700. The pull handle assembly 760 may assist when the insulating container 700 is tilted into a rolling position with the end opposite the wheels 772 off the container's resting surface. The pull handle assembly 760 may be a telescopic handle design with a 3-stage handle/arm configuration. In the first stage, the pull handle assembly 760 may be in the stowed (or retracted or nested) configuration. In the second stage, the pull handle assembly 760 may be in the partially extended configuration. In the third stage, the pull handle assembly 760 may be in the fully extended configuration. The pull handle assembly 760 may have one or more locking mechanisms for the stowed configuration, the partially extended configuration, and/or the fully extended configuration.

The pull handle assembly 760 may be connected to the side portions 714 of the base 702, and specifically the rear side portion 714B of the base 702. The pull handle assembly 760 may be arranged on the same rear side portion 714B that includes the wheel assembly 770. With the pull handle assembly 760 in the extended configuration, a user may grasp a pull handle 762 to tilt and raise the front side portion 714A upward, which shifts the weight of the insulating container 700 onto the wheels 772 and allows the user to pull the insulating container 700. The pull handle assembly 760 may have an extended configuration that enables a user to pull the container 700. The pull handle assembly 760 may have a stowed configuration where the pull handle assembly 760 may be flush with the top of the insulating container 700. When the pull handle assembly 760 is in the stowed configuration, an upper surface 763 of the pull handle 762 may be substantially parallel an upper surface of the lid 704. When the pull handle assembly 760 is in the stowed configuration, the upper surface 763 of the pull handle 762 may also can be in line or below the upper surface of the lid 704.

The pull handle assembly 760 may be attached to the rear side portion 714B. The pull handle assembly 760 may include one or more brackets 766A, 766B that attach the pull handle assembly 760 to the rear side portion 714B. The pull handle assembly 760 may include one or more brackets to attach the pull handle assembly to the rear side portion 714B, such as one bracket, two brackets, three brackets, or four or more brackets. The one or more brackets may include a first bracket 766A (or upper bracket) attached to a top portion of the pull handle assembly 760 and a second bracket 766B (or lower bracket) attached to a lower portion of the pull handle assembly 760. As shown in FIGS. 25 and 26, the first bracket 766A and the second bracket 766B may both connect to the lower arm 764C and specifically attach the lower arm 764C and the pull handle assembly 760 to the rear side portion 714B. The brackets 766 may be installed to mounting points on the rear side portion 714B of the base 702 before the insulating portion (foam) is filled into the base 702.

Additionally, the one or more of the brackets 766A, 766B may be U-shaped brackets that fit around the exterior of a lower arm 764C of the pull handle assembly 760 to hold the lower arm 764C and pull handle assembly 760 against the rear side portion 714B of the insulating container 700. As illustrated in FIGS. 27A, 27B, and 27C, the second bracket or lower bracket 766B may include a bracket housing for the lower arm 764C of the pull handle assembly 760 to hold the lower arm 764 and pull handle assembly 760 against the rear side portion 714B of the insulating container. The brackets 766A, 766B may be various other shapes without departing from embodiments of the invention. Additionally, the brackets 766A, 766B may be various widths and lengths. The brackets 766A, 766B may include one or more fasteners 767 on each side of the brackets 766A, 766B connecting the brackets 766A, 766B to the rear side portion 714B of the insulating container 700.

As described and illustrated above (specifically in FIGS. 16A, 16B, 17A, 17B, and 17C), the pull handle assembly 760 may include telescoping features. The pull handle assembly 760 may include an upper arm, a middle arm, and a lower arm 764C. The upper arm may be nested and slidable inside the middle arm. Additionally, the middle arm may be nested and slidable inside the lower arm 764C. This nesting and sliding of the upper arm, middle arm, and lower arm 764C may create the telescoping feature of the pull handle assembly 760.

FIGS. 27A, 27B, and 27C specifically illustrate the various component views of the pull handle assembly 760. FIG. 17A specifically shows the pull handle assembly 760 from the front view. The pull handle assembly 760 may include one or more locking mechanisms, such as an upper locking mechanism and a lower locking mechanism. The locking mechanisms may be installed between the arms for latching and locking the pull handle assembly 760 in the stowed configuration and/or the fully extended configuration. Specifically, the upper locking mechanism may be installed between the upper arm and the middle arm. The lower locking mechanism may be installed between the middle arm and the lower arm 764C. A release button 768 may be connected to and act as an actuator for the locking mechanisms. The locking mechanisms may be released with the release button 768 on the pull handle 762. The locking mechanisms may include various components known and used in the art for telescoping pull handles, such as actuators, hinges, spring-loaded bearings, bushings, locking pins, locking holes, etc.

As illustrated in FIGS. 25, 26, and 27A-27C, the pull handle assembly 760 may include a pull handle 762. The pull handle 762 can be grasped by a user to extend the pull handle assembly 760 to the extended configuration. The user may grasp the pull handle 762 in the extended configuration to tilt and raise the front side portion 714A upward, which shifts the weight of the insulating container 700 onto the wheels 772 and allows the user to pull the insulating container 700.

The pull handle 762 may include handle bumpers (as previously detailed above and illustrated in FIG. 18). The handle bumpers may be located on each of the pull handle arms of the pull handle 762. The handle bumpers may be utilized to prevent scuffing of the handle grip 763 on the pull handle 762 when/if the insulating container 700 is tipped over. The handle bumpers may include a raised portion that extends circumferentially around the pull handle 762 adjacent to the upper pull handle arm and/or around the upper pull handle arm. The raised portion may extend partially or fully circumferentially around the pull handle 762 and/or the pull handle arms.

The pull handle assembly 760 components may be formed from polymeric materials, which may be a filled or unfilled polymer. For example, the polymeric materials may be a PC-ABS, polyethylene, or other similar material. In addition, pull handle assembly 760 components can be manufactured by polymer processing techniques, such as various molding and casting techniques and/or other known techniques. Alternatively or optionally, the pull handle assembly 760 may be formed of a metallic material such as an aluminum alloy, magnesium alloy, or other metallic material with a density below 3 g/cc. As another option, the insulating container 700 components such as the lid, body, lid support member and pull handle assembly may include a structural foam with a composite polymer material with a low density foamed core and a higher density polymer skin.

Figure 28:
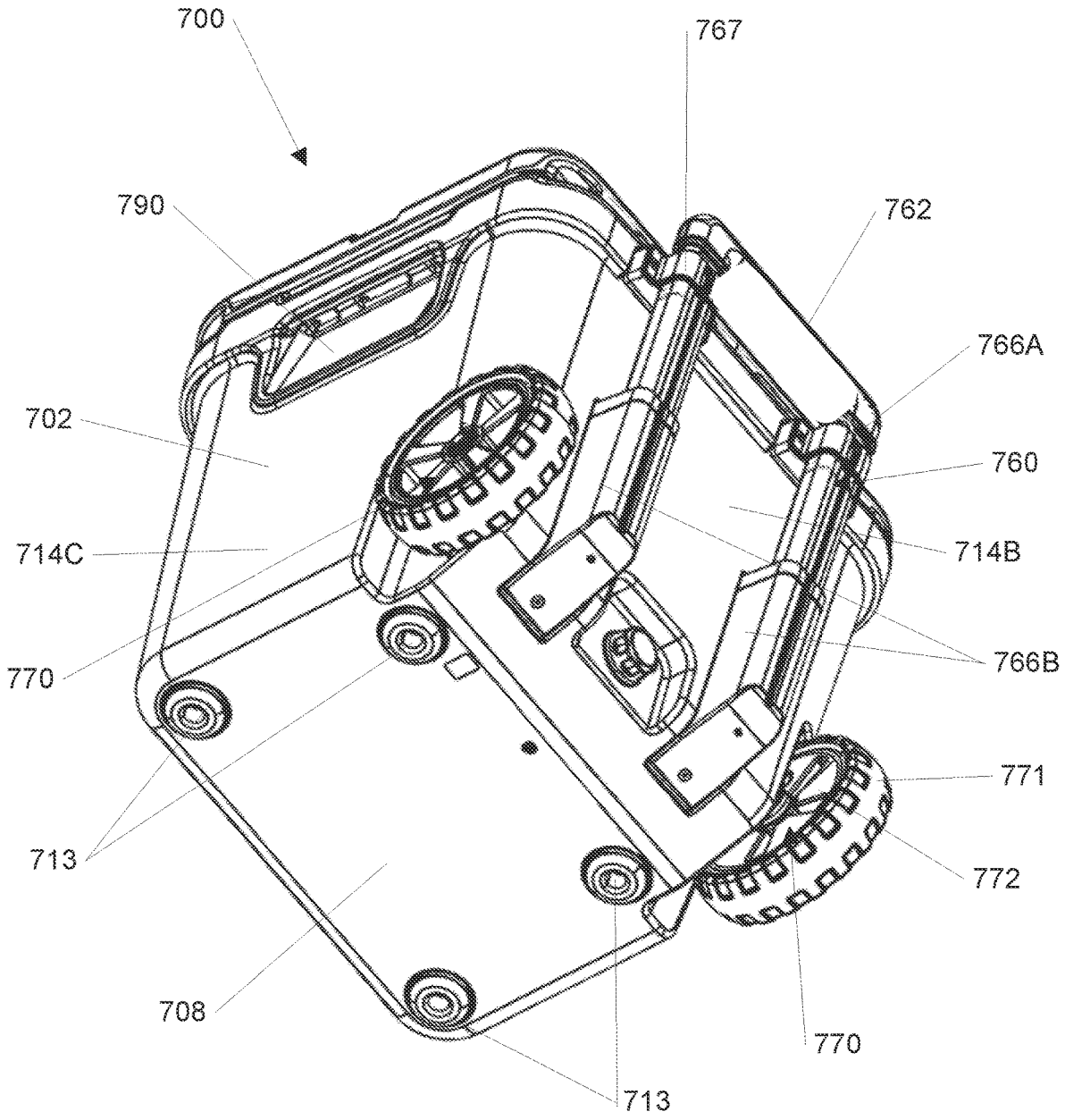
FIG. 28 illustrates a bottom perspective view of the insulating container shown in FIGS. 24A-24F showing a wheel assembly according to one or more aspects described herein.
Figure 29A:
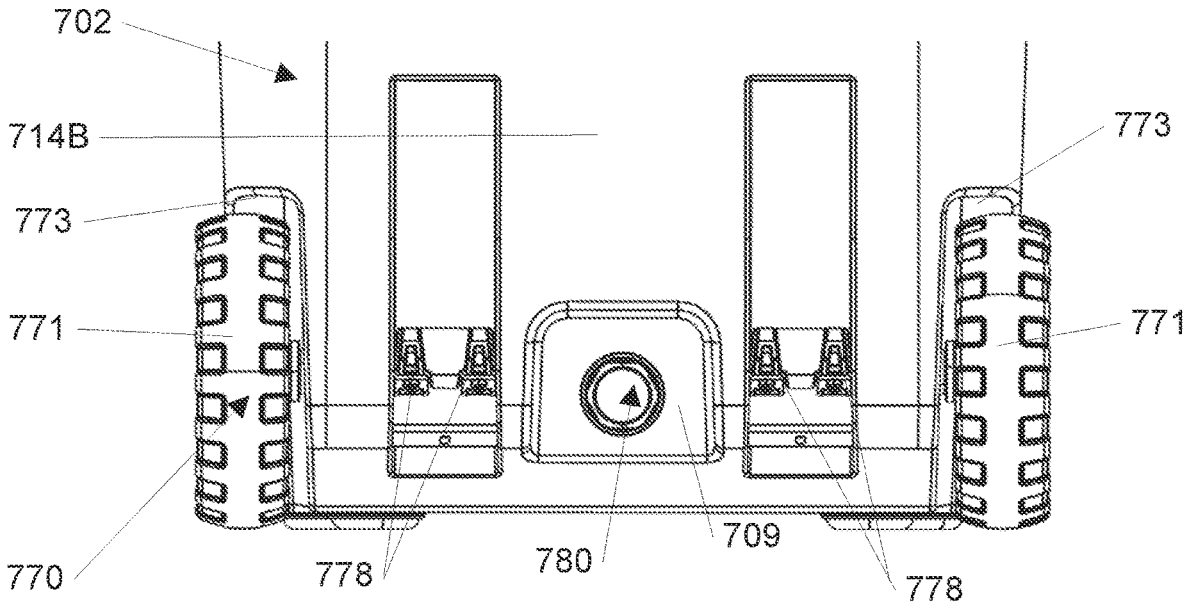
FIGS. 29A and 29B illustrate rear side views of the wheel assembly and an anti-rotation mount for the insulating container shown in FIGS. 24A-24F with portions of the pull handle assembly removed according to one or more aspects described herein.
Figure 29B:
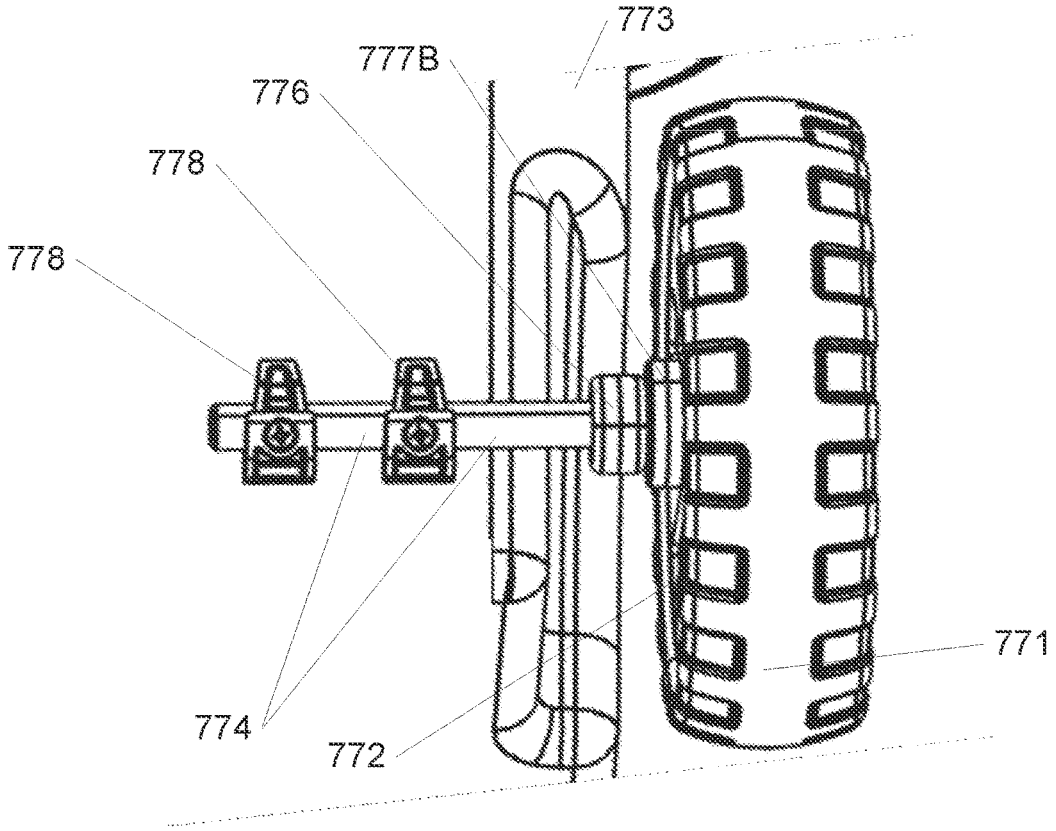
Figure 29C:
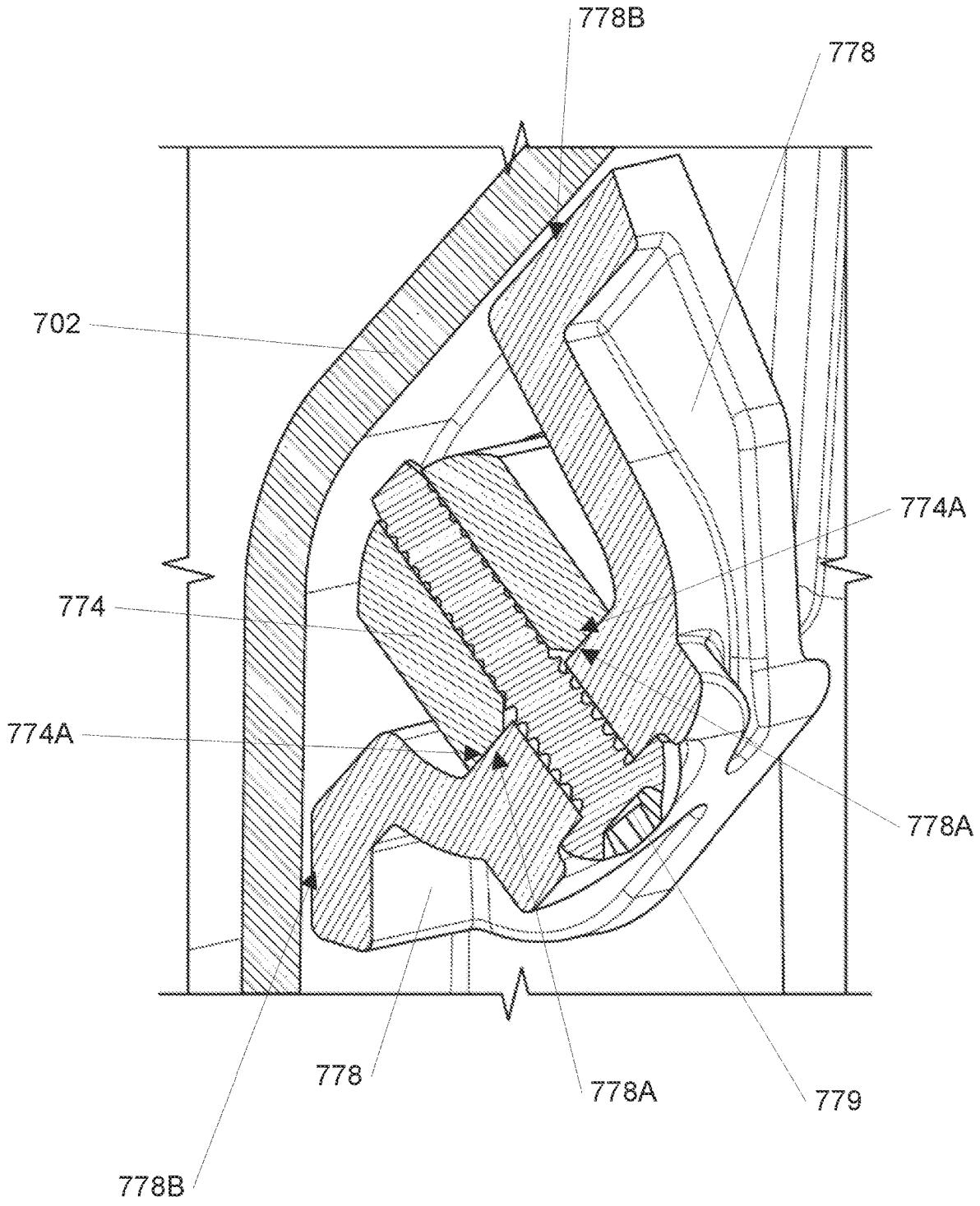
FIG. 29C illustrates a rear cross-sectional view of the axle attachment and anti-rotation mount for the insulating container shown in FIGS. 24A-24F according to one or more aspects described herein.
Figure 30:
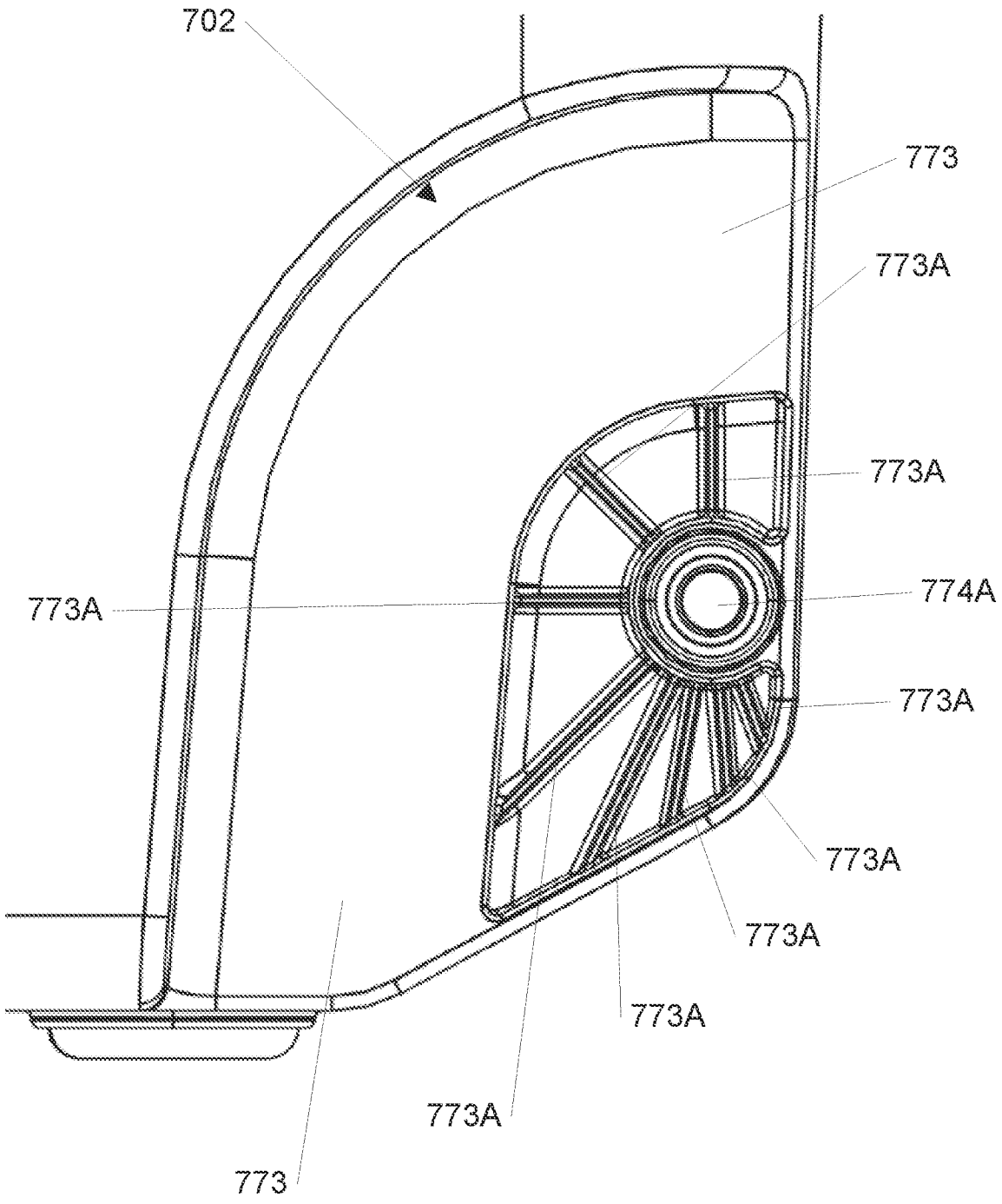
FIG. 30 illustrates a side perspective view of a wheel recess on the insulating container shown in FIGS. 24A-24F according to one or more aspects described herein.

In other examples, the insulating container 700 may include a rear wheel assembly 770, as specifically illustrated in FIGS. 28, 29A, 29B, 29C, 30, and 31. FIG. 28 illustrates a bottom perspective view of the insulating container 700 showing the wheel assembly 770. FIGS. 29A and 29B illustrate views of the wheel assembly 770 and an anti-rotation mount 778 for the insulating container 700 with portions of the pull handle assembly 760 removed. FIG. 29C illustrates a rear cross-sectional view of the axle attachment and anti-rotation mount 778 for the wheel assembly 770 of the insulating container 700. FIG. 30 illustrates a side perspective view of a wheel recess 773 on the base 702 of the insulating container 700 wherein each wheel 772 may be secured into the base 702.

The insulating container 700 may include a wheel assembly 770 that includes a pair of wheels 772 to assist a user in easily moving the insulating container 700. The wheel assembly 770 may include a tire 771 and a wheel 772, where each wheel 772 may be mounted with an axle 774 to the base 702. The wheel assembly 770 may include a single axle 774 for both wheels 772 or a double axle 774 with an axle for each wheel 772. The tire 771 may be made of polyurethane foam with a hardness of approximately 80 shore A, and a density of 0.75 KG/LT. The wheel 772 may be made of a rigid material, such as a glass filled nylon material. The tire 771 may be over-molded, stretch-fit, or grip-fit over the wheel 772. The wheel 772 may include ribs or other gripping structures on an internal rim of the wheel 772 to help grip the foam tire 771.

Each wheel assembly 770 and wheel 772 may be mounted to the base 702. More specifically, each wheel 772 may be mounted to the rear side portion 714B adjacent to the bottom surface 708 of the insulating container 700. Each wheel 772 may be secured into a wheel recess 773 on the base portion 702 and the rear side portion 714B. Each wheel 772 may be secured within the recess 773 using at least one spring retention ring and connected to at least one axle 774. Additionally, the wheels 772 and tires 771 may extend to the rear past the pull handle assembly 760, thereby providing additional tip protection to the pull handle assembly 760. Additionally, the wheels 772 and tires 771 may be elevated from the ground when the insulating container 700 is sitting flat on the ground. The tires 771 may also include a flat tread profile for improved sand/soft terrain performance. The wheels 772 may also include a single wall wheel hub that provides lighter weight. Additionally, the flatter and thinner tread profile of the tires 771 may provide a light-weight wheel.

FIGS. 29A and 29B specifically illustrate an exemplary embodiment of the wheel assembly 770 showing the wheels 772 and the axle 774 for the insulating container 700. The wheel assembly 770 may include one or more ball bearings and a spacer 777B on the axle 774 that sets the distance between the bearings. The spacer 777B may be made of a rigid polypropylene material and may be used to set the location of the wheel 772. The wheel 772, the spacer 777B, and a wheel grommet 776 may be retained along an axis of the axle 774 by a spring retention ring along the end of the axle 774. The spring retention ring may fit radially around the end of the axle 774 to hold the axle 774 through the wheel 772 and within the base 702.

Additionally, the wheel assembly 770 may include a wheel grommet 776 as detailed and illustrated above in FIGS. 20A and 20B. The wheel grommet 776 may be located between the wheel recess 773 and the spacer 777B. The wheel grommet 776 may also be located around the axle 774 and may provide a seal between the wheel recess 773 and the inner portion of the base 702. The wheel grommet 776 may be a rubber/non-rigid material (such as EPDM rubber). The wheel grommet 776 may be used to prevent water or other materials from entering the insulation center of the base 702. The wheel grommet 776 may be a bushing or grommet to absorb shock or forces impacted on the wheels 772 and absorb shock and cushion the axle 774. By absorbing shock, the wheel grommet 776 may allow the axle 774 to rotate when there is a high force put on the wheels 772. For example, during a drop test simulating the insulating container 700 being dropped and the insulating container 700 is loaded with approximately seventy-five pounds, the wheel assembly 770 will not break because of the wheel grommet 776. The entire force from the drop may get concentrated on the axle 774 instead of the wheels 772. The force from the drop may be absorbed and or dissipated by the wheel grommet 776, reducing and preventing high shock from reaching the base 702, the axle 774, the axle brackets 778, and other critical components. The drop testing may include dropping the insulating container 700 from approximately one meter off the ground and completed in a cold, hot, and room temperature condition. The insulating container 700 may be dropped on multiple orientations including back with impact force applied to both wheels 772 and on the corner of the wheel, with the force applied to a singular wheel 772.

FIGS. 29A, 29B, and 29C specifically illustrate an exemplary embodiment of an axle bracket 778 to prevent the axle 774 from rotating and coming out. FIGS. 29A and 29B illustrate the axle bracket 778 with the pull handle assembly 760 hidden. The axle bracket 778 may be an anti-rotation mount against the base 702. There may be at least one axle bracket 778 per axle 774. Additionally, there may be multiple, such as two, three, or four axle brackets 778 per axle 774. The one or more axle brackets 778 may be covered from view by the pull handle assembly 760. The axle bracket 778 may be attached with a fastener 779 to the axle 774. The axle 774 may include a flat section 774A with fastener attachment points 779A. The flat sections 774A of the axle 774 may be compressed and permanently mated with flat sections 778A of the axle bracket 778. The axle bracket 778 may include additional flat and mating features 778B that contact and hold the axle bracket 778 against the base 702. These flat sections 778A may prevent the axle 774 from rotating about the base 702, by holding the axle 774 stationary and in a permanent location in the base 702.

FIG. 30 illustrates the wheel recess 773 of the base 702 of the insulating container 700. As illustrated in FIG. 30, the wheel recess 773 may include molded radial ribs 773A extending from an axle hole/opening 774A. The radial ribs 773A may create strength within the base 702 for holding the axle 774 and the wheel assembly 770. Any number of radial ribs 773 may be utilized to help create strength within the base 702 and insulating container 700.

Figure 31:
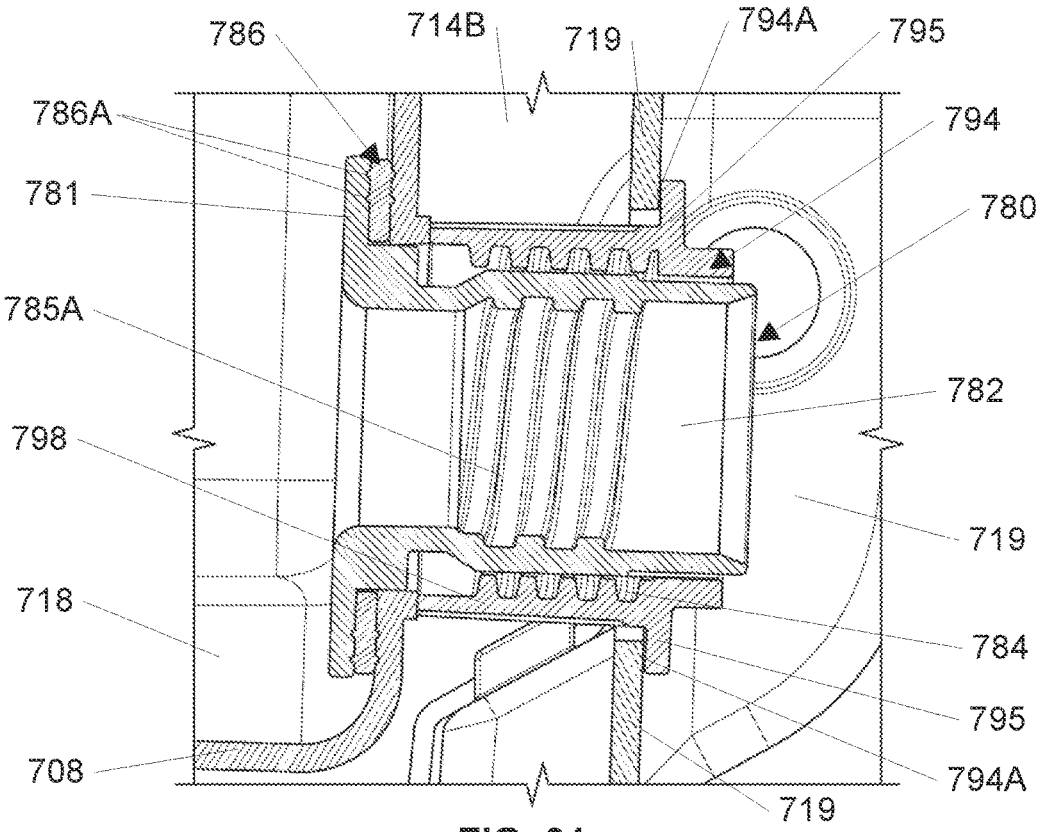
FIG. 31 illustrates a side cross-sectional view of a drain plug assembly for the insulating container shown in FIGS. 24A-24G according to one or more aspects described herein.
Figure 32:
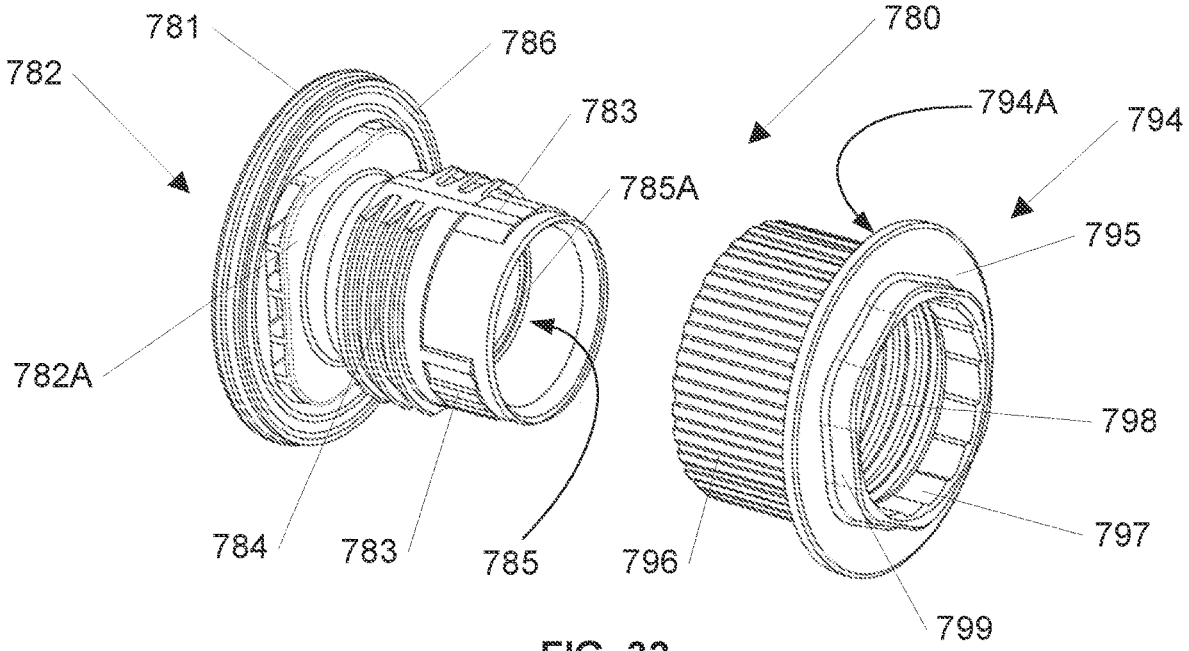
FIG. 32 illustrates an exploded view of the drain plug assembly for the insulating container shown in FIGS. 24A-24G according to one or more aspects described herein.
Figure 33:
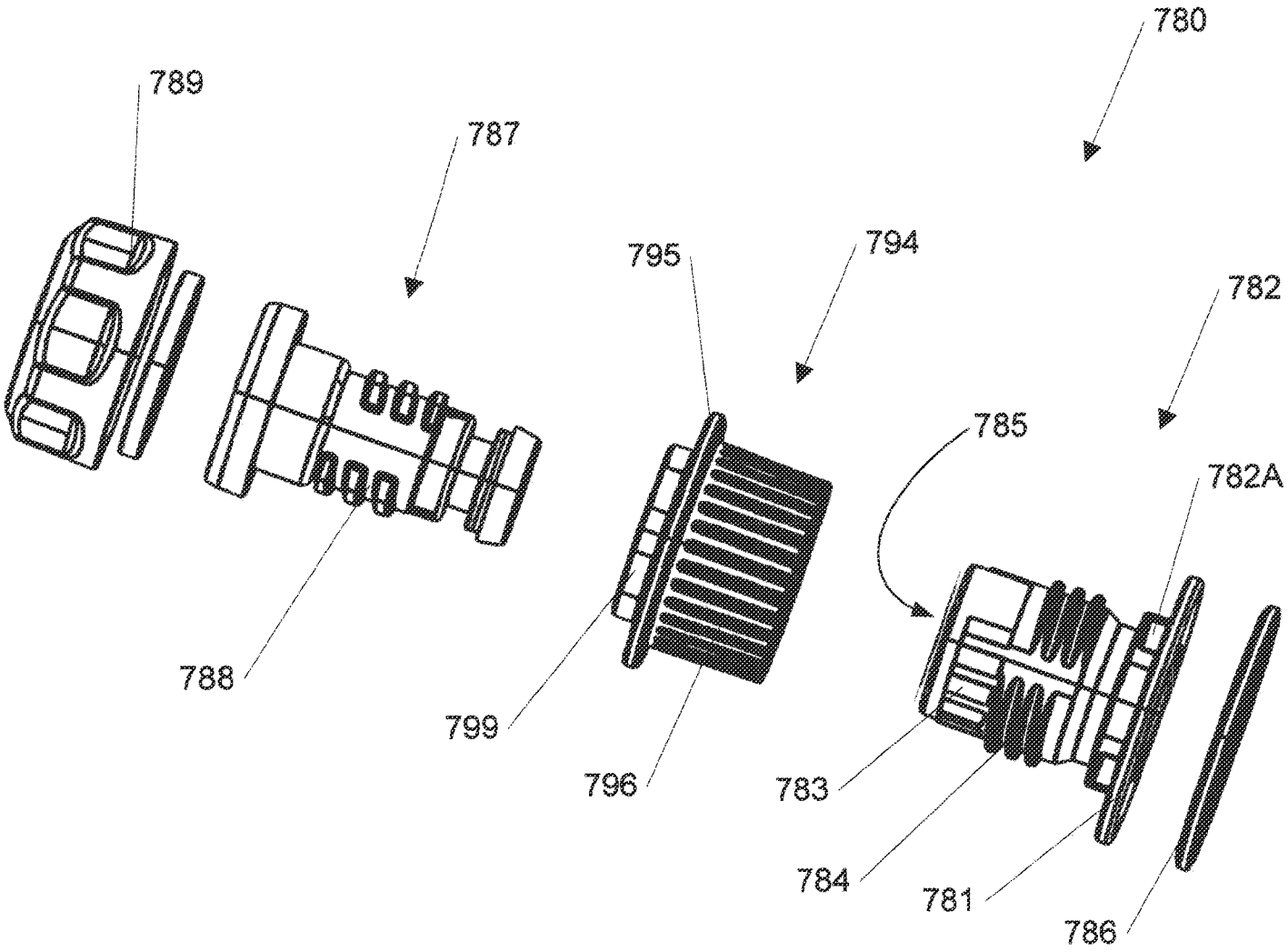
FIG. 33 illustrates another exploded view of the drain plug assembly for the insulating container shown in FIGS. 24A-24G according to one or more aspects described herein.

In other examples, the insulating container 700 may include a drain plug assembly 780, as specifically illustrated in FIGS. 24C, 25, 31, 32, and 33. FIG. 31 illustrates a side cross-sectional view of the drain plug assembly 780 for the insulating container 700. FIG. 32 illustrates an exploded view of a drain plug assembly 780 for the insulating container 700. FIG. 33 illustrates an additional exploded view of a drain plug assembly 780 with a drain plug 787 for the insulating container 700.

As shown in FIGS. 31-33, the drain plug assembly 780 may include a main tube 782, an outer tube 794, a gasket 786, and a drain plug 787. The drain plug 787 may be utilized by the user to screw into or out of the drain plug assembly 780 to drain the insulating container 700. The drain plug assembly 780 may be located and installed within a pass through of the wall of the base portion 702. In the illustrated embodiment, the drain plug assembly 780 may be located on the rear side portion 714B adjacent to the bottom surface 708 of the insulating container 700. The drain plug assembly 780 may be installed and located within a drain plug inset 709 that provides a protected drain plug assembly 780. The drain plug assembly 780 may include ratchet features wherein the main tube 782 (or inner tube) is keyed so the main tube 782 can not rotate/open when the main tube 782 is screwed into the outer tube 794.

The main tube 782 may include a drain pass-through portion 785 having one or more ratchet keys 783 on a first end and a main tube rim 781 on the other end opposite the first end. The drain pass-through portion 785 may include internal threads 785A that engage with external threads 788 on the drain plug 787. The main tube 782 may also have an external threaded connection 784 located between the main tube rim 781 and the ratchet keys 783. The main tube 782 may also include a gasket 786. The gasket 786 may provide compression between the main tube 782 and the inner wall 781 of the base 702. The gasket 786 may include radial features 786A that help seat the gasket 786 against the main tube rim 781 and the inner wall 718 of the base 702. The gasket 786 may be a separate component or the gasket 786 may be molded into the main tube 782. The gasket 786 may be a softer material, such as silicone, while the main tube 782 is a more rigid material. The gasket 786 may be for example, have a durometer 40, shore A. The outer tube 794 may include an internal threaded connection 798. The outer tube 794 may also include an outer tube rim 795 and ratchet teeth 797 on the same end. The ratchet teeth 797 may be located on an internal portion of the outer tube 794. The outer tube 794 may also include a sealing ring 794A that sets against the outer tube rim 795 of the outer tube 794. The sealing ring 794A may sit between the outer tube rim 795 and the rear side portion 714B and the base outer wall structure 719. The sealing ring 794A may also create a seal that prevents foam from escaping during assembly. The sealing ring 794A may be a singular ring concentric about an axis of the outer tube 794. The sealing ring 794A may also be multiple rings or non-circular.

As shown in FIG. 31, the main tube 782 and the outer tube 794 may engage to form and create the drain plug assembly 780. The main tube 782 and the outer tube 794 may pass through the rear side portion 714B, a base inner wall structure 718, and a base outer wall structure 719. The main tube 782 and the outer tube 794 may cooperatively engage with each other, thereby creating the drain plug assembly 780 of the insulating container 700. The main tube 782 may be installed first, using a rectangular feature with flats 782A on the main tube 782 that mate with a rectangular opening in the rear side portion 714B and inner wall 718 of the base 702. This rectangular fitting may prevent rotation of the drain plug assembly 780 relative to the base 702. The outer tube 794 may then be screwed onto the main tube 782. Next, external threaded connection 784 of the main tube 782 may engage with internal threaded connection 798 on the outer tube 794. Then, the ratchet keys 783 and the ratchet teeth 797 may engage and ratchet the main tube 782 and the outer tube 794 together. The outer tube 794 may include a flat head structure 799 to allow for tools to tighten the outer tube 794 into the main tube 782. The flat head structure 799 may be any polygon shape with one or more flat sides, such as for example, square, pentagon, hexagon, or other polygon shapes. The flat head structure 799 may also include curved sides. The flat head structure 799 may be any shape with one or more flat sides. The outer tube 794 may have bottom out features with a specific length that stops the threaded connection between the main tube 782 and the outer tube 794 and against inner wall/face 718 of the base 702. The bottom out features sets the distance of the inner wall 718 and the outer wall 719 of the base 702.

The ratchet features of the drain plug assembly 780 may consist of the ratchet teeth 797 on the outer tube 794 with one or more ratchet keys 783 (or pawls) on the main tube 782 that engage the ratchet teeth 797. As the outer tube 794 is screwed onto the main tube 782, the ratchet keys 783 of the main tube 782 engage with the ratchet teeth 797 on the outer tube 794. The engagement of the ratchet keys 783 and ratchet teeth 797 allows continuous rotary motion of the main tube 782 in only one direction (closing), while preventing motion in the opposite direction (opening). The ratchet teeth 797 may be uniform but asymmetrical, with each tooth having a moderate slope on one edge and a much steeper slope on the other edge. When the ratchet teeth 797 are moving in the unrestricted (i.e. closing) direction, the ratchet keys 783 easily slide up and over the gently sloped edges of the ratchet teeth 797, with the pressure of the connection forcing the ratchet keys 783 (potentially with an audible 'click') into a depression between the ratchet teeth 797 as the ratchet keys 783 pass a tip of each ratchet tooth 797. When the ratchet teeth 797 move in the opposite (opening) direction, however, the ratchet keys 783 will catch against the steeply sloped edge of the first ratchet tooth 797 the ratchet key 783 encounters, thereby locking ratchet key 783 against the ratchet tooth 797 and preventing any further motion in that direction.

When the main tube 782 is fully screwed into the outer tube 794, the main tube rim 781 may engage the rear side portion 714B and the gasket 786 may engage the base inner wall structure 718. The gasket 786 may prevent liquid from escaping the insulating container 700 between the drain plug assembly 780 and the cooler base 702. The gasket 786 may also prevent foam from escaping during the assembly process.

As illustrated in FIG. 33, the drain plug 787 may include external threads 788. The external threads 788 on the drain plug 787 may engage with the internal threads 785A of the drain pass-through portion 785 of the drain plug assembly 780 when the drain plug 787 is screwed into the drain plug assembly 780 and the main tube 782. Additionally, a drain plug cap 789 and gasket may be included with a top portion of the drain plug 787. The drain plug cap 789 may include features to help a user screw and unscrew the drain plug 787 from the drain plug assembly 780. Additionally, the drain plug 787 may include various gaskets to ensure a watertight seal when the drain plug 787 is tightened onto the main tube 782 and the drain plug assembly 780.

FIGS. 34A-34C and 35A-35E illustrate another example insulating container 800 according to one or more aspects described herein. For the embodiment of FIGS. 34A-34C and 35A-35E, the features are referred to using similar reference numerals under the "8xx" series of reference numerals, rather than "1xx" as used in the embodiment of FIG. 1A/1B/1C, "2xx" as used in the embodiment of FIGS. 3A/3B/3C, "4xx" as used in the embodiment of FIGS. 7A/7B, "6xx" as used in the embodiment of FIGS. 10A-23, or "7xx" as used in the embodiment of FIGS. 24A-33. A "7xx" feature may be similar to a "1xx," "2xx," "4xx," or "6xx" feature. Accordingly, certain features of the insulating container 700 that were already described above with respect to the insulating container 100, 200, 400, 600, or 700 of FIGS. 1A/1B/1C, 3A/3B/3C, 7A/7B, and 10A-33 may be described in lesser detail, or may not be described at all. Additionally, any features described above with respect to the insulating container 100, 200, 400, 600, and 700 in FIGS. 1A through 33 may be utilized with the insulating container 800.

Figure 34B:
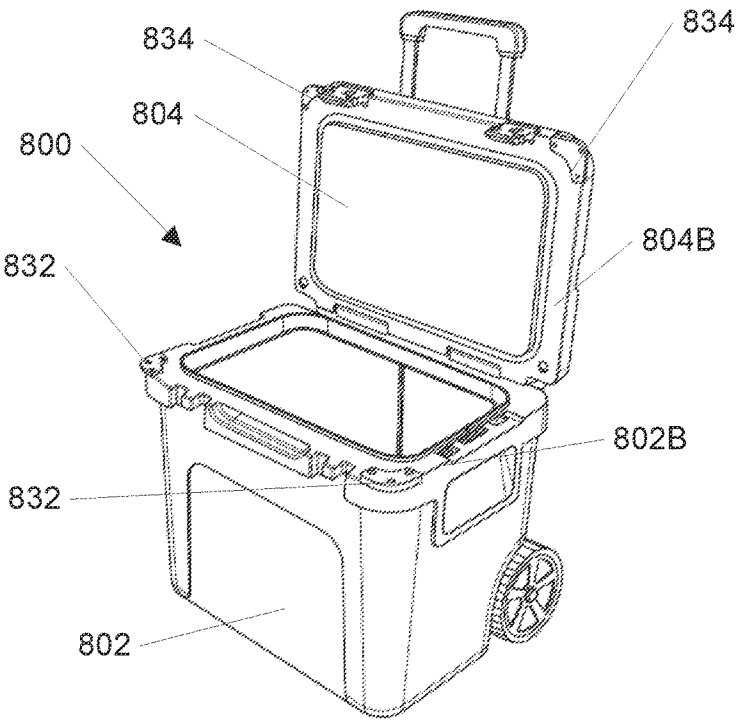
FIGS. 34A-34C illustrate an example corner bracket kit for an insulating container according to one or more aspects described herein.
Figure 34C:
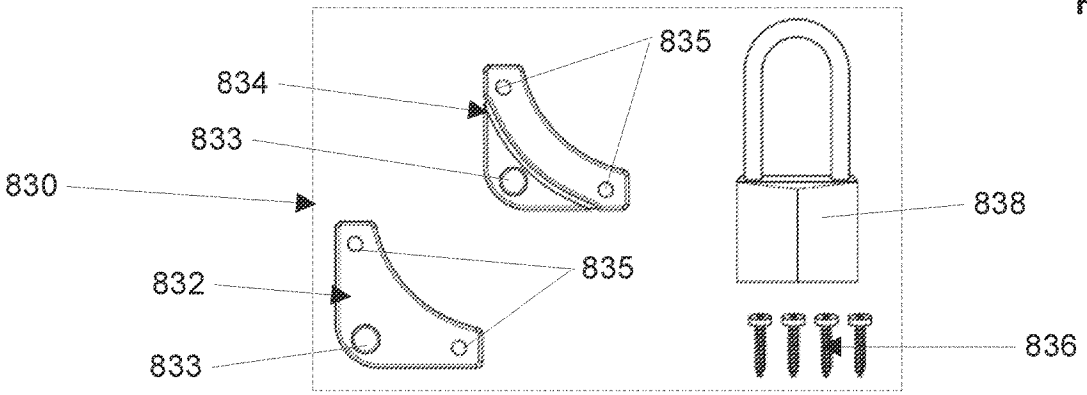
Figure 34A:
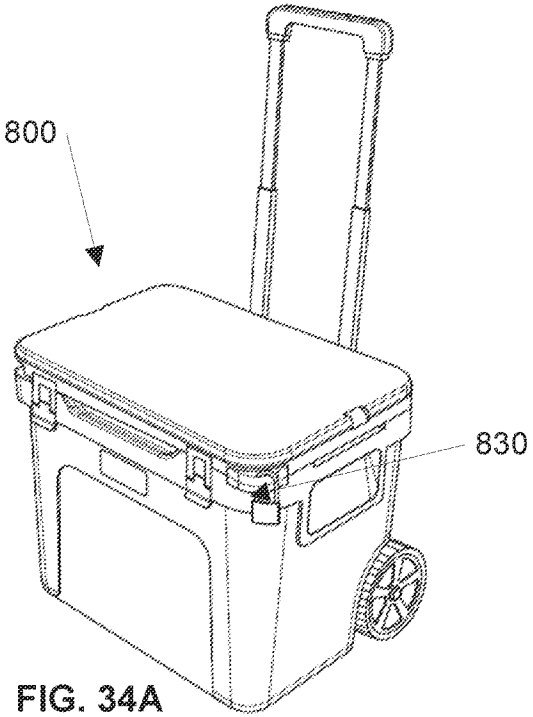
Figure 35A:
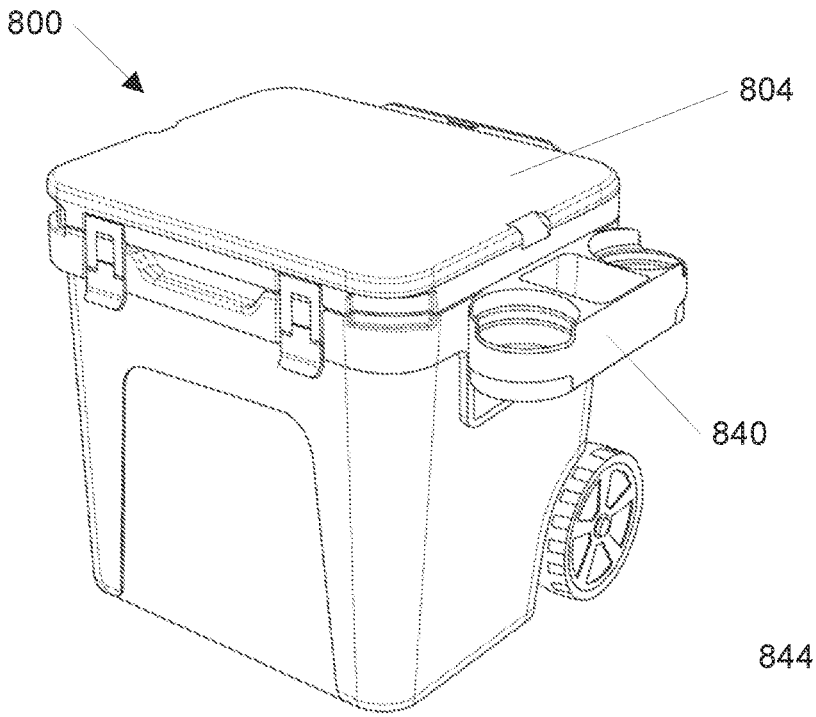
FIGS. 35A-35E illustrate accessories for an insulating container according to one or more aspects described herein.
Figure 35B:
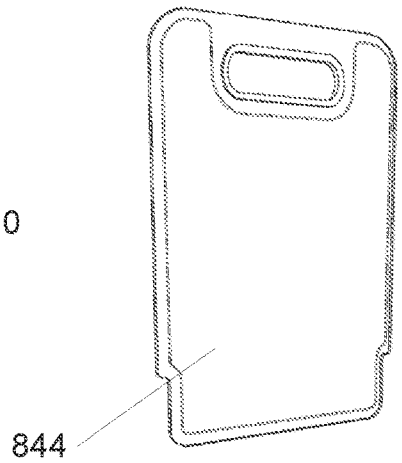
Figure 35C:
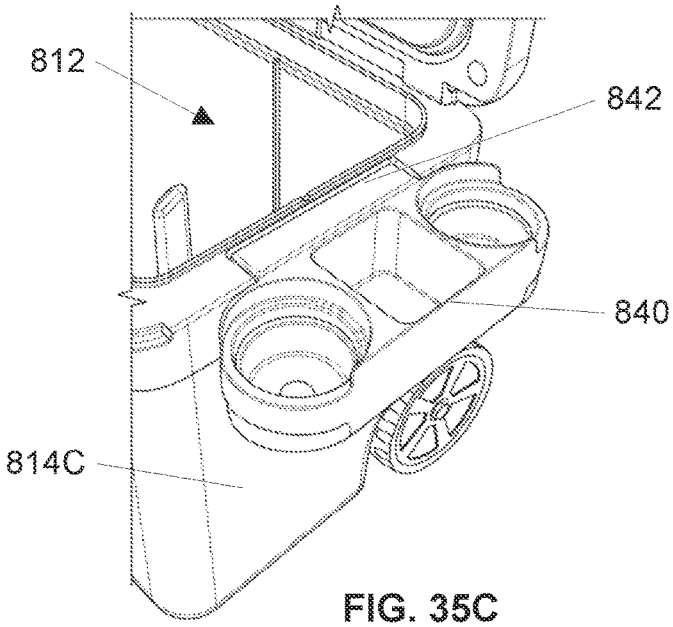
Figure 35D:
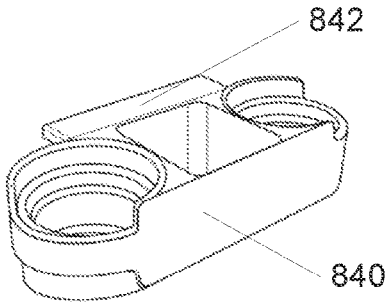
Figure 35E:
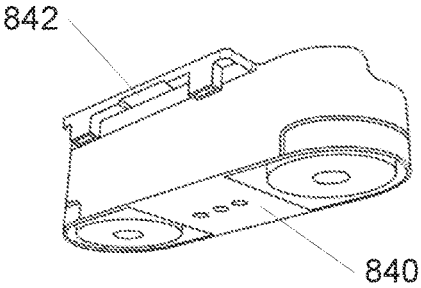

As illustrated in FIGS. 34A-34C, the insulating container 800 may include a corner locking bracket 830. The corner locking bracket 830 may be installed and/or attached on the insulating container 800 to lock the insulating container 800 in a closed/locked configuration. The corner locking bracket 830 may be a corner bracket kit in one embodiment. In one example, the corner locking bracket 830 may include a container bracket 832, a lid bracket 834, a plurality of fasteners 836, and a lock 838. The container bracket 832 and lid bracket 834 may include a lock hole 833 and one or more fastener holes 835. As illustrated in FIG. 34B, the container bracket 832 and the lid bracket 834 may be attached to a corner of the insulating container 800. The container bracket 832 and the lid bracket 834 may be attached to the insulating container 800 using one or more fasteners 836 through the one or more fastener holes 835. As illustrated in FIG. 34B, the container bracket 832 may be attached to a corner of the base 802 along an topside portion 802B of the base 802 and the lid bracket 834 may be attached to a corner of a underside portion 804B of the lid 804. When the lid 804 is in a closed and secured configuration, the container bracket 832 and the lid bracket 834 match together with the lock hole 833 from the container bracket 832 and the lock hole 833 from the lid bracket 834, thereby allowing the lock 838 to be inserted into to both lock holes 833. The corner locking brackets 830 may include a metal washer molded into the corner locking brackets to reinforce the lock holes 833. Additionally, one or more screw bosses may be hidden in the base 802 and/or the lid 804. The one or more screw bosses may include a dimple for fastener/screw alignment wherein one or more of the plurality of fasteners 836 may penetrate the surface of the base 802 and/or lid 804 before the fastener 836 can engage in the screw boss.

As illustrated in FIGS. 35A-35E, accessories 840 such as trays or baskets 840 or container separator panels 844 may be located or stored in the bottom of the interior void of the insulating container 800, and/or may be configured to rest at the top of the interior void. In some examples one or more container separator panels 844 may be located in the interior void of the insulating container 800 to separate contents within the insulating container 800. In some examples, a tray or basket 840 may include a lip 842 around the perimeter of the tray that allows the tray 840 to hang from the edge of the opening 812 while remaining within the interior void of the insulating container 800. Such a configuration allows the lid 804 to be configured in the closed and secured position thereby sealing the interior void while the tray or basket 840 and/or the container separator panels 844 is secured in place inside/within the insulating container 800.

In other example embodiments, the insulating containers may be an injection molded container. For example, portions or parts of the insulating containers may be formed in multiple pieces using an exemplary welding processing, such as the lid may be formed in two pieces. The exemplary welding processing may be used with portions or parts of the insulating containers disclosed herein, using an adhesive, ultrasonic welding technique, or electromagnetic bonding (such as Emabond®). For example, as described in U.S. Pat. No. 7,984,738 (the disclosure of which is hereby incorporated by reference) an electromagnetic weld element preform may be a structure comprised of plastic and magnetic particles. When an energized high frequency induction coil is placed in proximity to the joint, the particles act as susceptors of electromagnetic radiation and resultant induced eddy currents cause the element to become heated sufficiently to melt the preform and adjacent plastic, thereby fusing the joint. The metal particles remain within the fused plastic part.

In one example, a hermetic seal may be formed between the two pieces forming the lid and the two pieces forming lower shell of the insulating container. The exemplary welding processing may provide superior plastic welds for demanding applications. For example, the electromagnetic bonding (such as Emabond®) welding process uses high frequency energy coupled with electromagnetic susceptor materials to deliver heat precisely to a bond line to provide superior welding of virtually all thermoplastic materials. The hermetic seal may be formed completely around the perimeter of the insulating container where the weld is located, which will ensure moisture, etc. will not be able to deteriorate the foam and the internal portion of the insulating container.

Figures 36A, 36B, 36C:
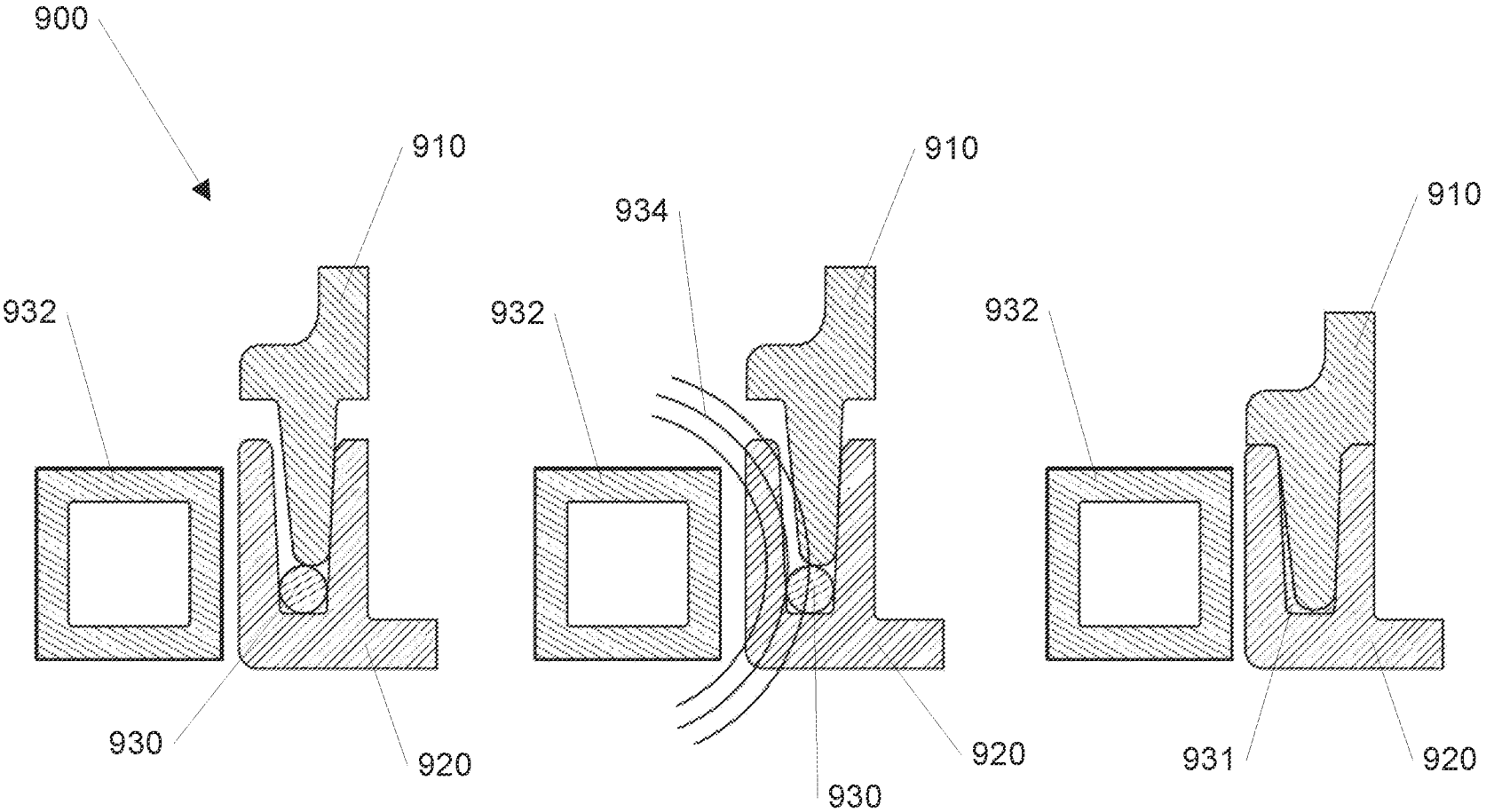
FIGS. 36A-36C illustrate an exemplary welding processing used with an insulating container according to one or more aspects described herein.

FIGS. 36A-36C illustrate an exemplary electromagnetic bonding (such as Emabond®) welding process 900 that may be used with the insulating container according to one or more aspects described herein. As illustrated in FIG. 36A, a first component 910 (can be referred to as tongue) may be welded to a second component 920 (can also be referred to as groove) using an electromagnetic susceptor material 930 and a high-frequency energy source 932, such as a radio-frequency (RF) coil. The parameters of the electromagnetic bonding may be generally standard, with minor adjustments to meet the needs of the specific design and/or materials, similar to process settings on an injection molding machine.

In one example, the first component 910 can be in the form of a tongue and the second component 920 can be in the form of a groove to form a tongue and groove joint. The first component 910 may be the lid and the second component 920 may be the base/body. The lid and the base/body may have the same geometry for both the tongue and groove. The joints on the lid and the base of the insulating container may have the same tongue and grove. There may be additional ribs or geometry added to the tongue side that guides the tongue within the groove, which may help hold the part geometry and the electromagnetic susceptor material 930 preventing the electromagnetic susceptor material 930 from leaking out at the seam and/or preventing the electromagnetic susceptor material 930 from creating variation in the finish material surface. The electromagnetic susceptor material 930 may be placed within a joint between the first component 910 and the second component 920. The first component 910 and the second component 920 may be brought together and placed within a fixture containing the high-frequency energy source 932 which may conform to the weld line geometry.

FIG. 36B illustrates the RF coil 932 emitting precise and focused high-frequency energy (RF energy) to the welding location and the electromagnetic susceptor material 930 between the first component 910 and the second component 920. During joining the first component 910 and the second component 920, the activated RF coil 932 heats and melts the electromagnetic susceptor material 930 causing the adjoining surfaces to melt. Energy may only be consumed during the actual heating cycle, which typically is between 1 and 30 seconds.

FIG. 36C illustrates the final weld of the formed and welded electromagnetic susceptor material 931 between the first component 910 and the second component 920. After joining the first component 910 and the second component 920, the electromagnetic susceptor material 930 may have filled the joint design gap. The exemplary welding processing may have fused the first component 910 and the second component 920, resulting in a polymer to polymer weld. Additionally, although the first component 910 and the second component 920 can be in the form of a tongue and groove joint, other joints and connections are contemplated, such as dovetail, butt, pocket, dado, half lap, box, rabbet, biscuit, etc.

Any features described above with respect to the insulating containers 100, 200, 400, 600, 700, or 800 in FIGS. 1A through 36C may be utilized with any of the other insulating containers 100, 200, 400, 600, 700, and 800, even if not specifically described with that insulating container. Accordingly, certain features of any of the insulating containers 100, 200, 400, 600, 700, or 800 that were already described above with respect to the insulating container 100, 200, 400, 600, 700, or 800 may be described in lesser detail, or may not be described at all with any or all of the other insulating containers 100, 200, 400, 600, 700, and 800.

Additionally or alternatively, various other venting or pressure regulation arrangements may be used without departing from the invention. For instance, a portion of the base may include a material that is breathable for air but does not permit water or other liquids to penetrate. This mesh material may allow venting without permitting spillage of the liquid contained within the insulating container.

The insulating containers described herein include various features that ensure easy and efficient manufacture of the insulating containers, while providing durability and wear resistance. The insulating containers and the various integrally molded features, such as side pocket handles, pressure regulation mechanisms or devices, latch devices, etc., may be advantageous in improving durability and wear resistance.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. An insulating container comprising:

a base;

a lid hingedly attached to the base;

the base including:

a sidewall structure having a front sidewall, a rear sidewall opposite the front sidewall, and two lateral sidewalls between the front sidewall and the rear sidewall;

a bottom portion connected to a first end of each sidewall of the sidewall structure, the bottom portion being configured to support the insulating container on a surface;

an opening formed at a second end of each sidewall of the sidewall structure, opposite the first end of each sidewall of the sidewall structure, the opening being configured to allow access to an interior void of the insulating container formed by the sidewall structure and the bottom portion, wherein a gasket is configured to provide a watertight seal when the lid is in a closed and secured position; and at least one latch device configured to secure the lid when the lid is in a closed position, wherein the at least one latch device further includes:

a latch upper wherein a top portion of the latch upper is pivotally attached to the lid; and a latch lower wherein a top portion of the latch lower is pivotally attached to a bottom portion of the latch upper, wherein the latch lower further includes an engaging tab, wherein the engaging tab is configured to engage a keeper, wherein the keeper is positioned on a front side of the bottom portion of the insulating container when the lid is secured in the closed position, and wherein the latch upper and the latch lower are configured in a recessed position, and flush with a front side of the lid and flush with a front side of a bottom portion of the insulating container when the latch device secures the lid in a closed position; and a pull handle assembly attached to the rear sidewall, the pull handle assembly with a telescopic three-stage arm configuration defined by a first stage with the pull handle assembly in a stowed configuration, a second stage with the pull handle assembly in a partially extended configuration, and a third stage with the pull handle assembly in a fully extended configuration, the pull handle assembly including an upper arm, a middle arm, and a lower arm, with the upper arm nested and slidable inside the middle arm, and the middle arm nested and slidable inside the lower arm thereby creating the telescopic three-stage arm configuration, wherein the pull handle assembly includes two pull handle arms with a pull handle with one or more pull handle bumpers located on each of the pull handle arms that include a raised portion that extends circumferentially around the pull handle.

2. The insulating container of claim 1, wherein the pull handle assembly is attached to the rear sidewall with one or more brackets, the one or more brackets are U-shaped brackets that fit around an exterior of the lower arm against the rear sidewall.

3. The insulating container of claim 1, wherein the lid includes a step portion located adjacent the rear sidewall, the step portion includes an inset portion from a top surface of the lid.

4. The insulating container of claim 1, wherein the pull handle assembly further includes one or more locking mechanisms for locking the pull handle assembly in the stowed configuration and the fully extended configuration, with an upper locking mechanism between the upper arm and the middle arm and a lower locking mechanism between the middle arm and the lower arm.

5. The insulating container of claim 4, wherein the pull handle assembly further includes a release button located on a pull handle, the release button connected to and actuating the one or more locking mechanisms to lock and release the pull handle assembly between the stowed configuration and the fully extended configuration.

6. The insulating container of claim 1, wherein the pull handle assembly includes an extended arm overlap distance defined as an overlap distance between the nested arms when the upper arm, the middle arm, and the lower arm are in the fully extended configuration, the extended arm overlap distance being approximately 70 mm.

7. The insulating container of claim 1 further comprising:

a corner locking bracket that includes a container bracket attached to the base, a lid bracket attached to the lid, and a lock, wherein the container bracket includes a first lock hole and the lid bracket includes a second lock hole, wherein when the lid is in the closed and secured position, the first and second lock holes match together, thereby allowing the lock to be inserted into to the first and second lock holes.

8. An insulating container comprising:

a base;

a lid hingedly attached to the base;

the base including:

a sidewall structure having a front sidewall, a rear sidewall opposite the front sidewall, and two lateral sidewalls between the front sidewall and the rear sidewall;

a bottom portion connected to a first end of each sidewall of the sidewall structure, the bottom portion being configured to support the insulating container on a surface;

an opening formed at a second end of each sidewall of the sidewall structure, opposite the first end of each sidewall of the sidewall structure, the opening being configured to allow access to an interior void of the insulating container formed by the sidewall structure and the bottom portion, wherein a gasket is configured to provide a watertight seal when the lid is in a closed and secured position; and at least one latch device configured to secure the lid when the lid is in a closed position, wherein the at least one latch device further includes:

a latch upper wherein a top portion of the latch upper is pivotally attached to the lid; and a latch lower wherein a top portion of the latch lower is pivotally attached to a bottom portion of the latch upper, wherein the latch lower further includes an engaging tab, wherein the engaging tab is configured to engage a keeper, wherein the keeper is positioned on a front side of the bottom portion of the insulating container when the lid is secured in the closed position, and wherein the latch upper and the latch lower are configured in a recessed position, and flush with a front side of the lid and flush with a front side of a bottom portion of the insulating container when the latch device secures the lid in a closed position;

a wheel assembly located adjacent the rear sidewall, the wheel assembly including a pair of wheels on opposite sides of the rear sidewall, with each wheel mounted in a wheel housing with an axle to an axle bracket, and further including a wheel grommet located between the wheel housing and the axle bracket, the wheel grommet absorbing shock and cushioning the axle; and a pull handle assembly attached to the rear sidewall adjacent to the bottom portion, the pull handle assembly with a telescopic three-stage arm configuration defined by a first stage with the pull handle assembly in a stowed configuration, a second stage with the pull handle assembly in a partially extended configuration, and a third stage with the pull handle assembly in a fully extended configuration, wherein the pull handle assembly includes two pull handle arms with a pull handle with one or more pull handle bumpers located on each of the pull handle arms that include a raised portion that extends circumferentially around the pull handle, wherein when the pull handle assembly is in the fully extended configuration and the base is tilted, a weight of the insulating container is shifted onto the wheels to allow a user to pull and roll the insulating container.

9. The insulating container of claim 8, wherein an exterior of each wheels extends toward the rear sidewall past the pull handle assembly providing tip protection to the insulating container.

10. The insulating container of claim 8, wherein each wheel is elevated from a ground area when the bottom portion and the base are sitting flat on the ground area.

11. The insulating container of claim 8, wherein the pull handle assembly includes an upper arm, a middle arm, and a lower arm, with the upper arm nested and slidable inside the middle arm, and the middle arm nested and slidable inside the lower arm thereby creating the telescopic three-stage arm configuration.

12. The insulating container of claim 11, wherein the pull handle assembly includes an extended arm overlap distance defined as an overlap distance between the nested arms when the upper arm, the middle arm, and the lower arm are in the fully extended configuration, the extended arm overlap distance being approximately 70 mm.

13. An insulating container comprising:

a base;

a lid hingedly attached to the base;

the base including:

a sidewall structure having a front sidewall, a rear sidewall opposite the front sidewall, and two lateral sidewalls between the front sidewall and the rear sidewall;

a bottom portion connected to a first end of each sidewall of the sidewall structure, the bottom portion being configured to support the insulating container on a surface;

an opening formed at a second end of each sidewall of the sidewall structure, opposite the first end of each sidewall of the sidewall structure, the opening being configured to allow access to an interior void of the insulating container formed by the sidewall structure and the bottom portion, wherein a gasket is configured to provide a watertight seal when the lid is in a closed and secured position; and at least one latch device configured to secure the lid when the lid is in a closed position, wherein the at least one latch device further includes:

a latch upper wherein a top portion of the latch upper is pivotally attached to the lid; and a latch lower wherein a top portion of the latch lower is pivotally attached to a bottom portion of the latch upper, wherein the latch lower further includes an engaging tab, wherein the engaging tab is configured to engage a keeper, wherein the keeper is positioned on a front side of the bottom portion of the insulating container when the lid is secured in the closed position, and wherein the latch upper and the latch lower are configured in a recessed position, and flush with a front side of the lid and flush with a front side of a bottom portion of the insulating container when the latch device secures the lid in a closed position;

a drain plug assembly on the rear sidewall adjacent to the bottom portion of the base, the drain plug assembly comprising a main tube that cooperatively engages with an outer tube that extends through the rear sidewall, wherein the main tube includes one or more ratchet keys on an external threaded connection and the outer tube includes an internal threaded connection that threadedly engages the external threaded connection of the main tube and a plurality of ratchet teeth that engage the one or more ratchet keys on the main tube, wherein when the main tube is screwed into the outer tube, the ratchet keys of the main tube engage with the ratchet teeth on the outer tube; and a pull handle assembly attached to the rear sidewall adjacent to the bottom portion, the pull handle assembly with a telescopic three-stage arm configuration defined by a first stage with the pull handle assembly in a stowed configuration, a second stage with the pull handle assembly in a partially extended configuration, and a third stage with the pull handle assembly in a fully extended configuration, wherein the pull handle assembly includes two pull handle arms with a pull handle with one or more pull handle bumpers located on each of the pull handle arms that include a raised portion that extends circumferentially around the pull handle.

14. The insulating container of claim 13, wherein the pull handle assembly includes an upper arm, a middle arm, and a lower arm, with the upper arm nested and slidable inside the middle arm, and the middle arm nested and slidable inside the lower arm thereby creating the telescopic three-stage arm configuration.

15. The insulating container of claim 13, wherein the outer tube further includes a gasket located on a rim of the main tube between the main tube and the rear sidewall of the base.

16. The insulating container of claim 13, wherein the ratchet teeth are uniform and asymmetrical, with each tooth having a moderate slope on one edge and a steeper slope on the other edge.

* * * * *